US010255744B2

(12) United States Patent
Enomoto

(10) Patent No.: US 10,255,744 B2
(45) Date of Patent: Apr. 9, 2019

(54) DISK TRANSFERRING DEVICE AND DISK DISPENSING DEVICE

(75) Inventor: Minoru Enomoto, Saitama (JP)

(73) Assignee: ASAHI SEIKO CO., LTD., Tokyo (JP)

( * ) Notice: Subject to any disclaimer, the term of this patent is extended or adjusted under 35 U.S.C. 154(b) by 1090 days.

(21) Appl. No.: 13/316,847

(22) Filed: Dec. 12, 2011

(65) Prior Publication Data

US 2012/0145741 A1 Jun. 14, 2012

(30) Foreign Application Priority Data

Dec. 10, 2010 (JP) ..... 2010-275570
Apr. 11, 2011 (JP) ..... 2011-087128

(51) Int. Cl.

| | |
|---|---|
| ***B65D 83/04*** | (2006.01) |
| ***B65D 59/00*** | (2006.01) |
| ***G07D 9/00*** | (2006.01) |
| ***G07F 11/34*** | (2006.01) |

(52) U.S. Cl.
CPC ..... *G07D 9/008* (2013.01); *G07D 9/00* (2013.01); *G07F 11/34* (2013.01)

(58) Field of Classification Search
USPC ..... 221/208, 221, 222, 224, 225, 236, 237, 221/254, 277
See application file for complete search history.

(56) References Cited

U.S. PATENT DOCUMENTS 2,952,035 A * 9/1960 Gora ..... B29C 43/18 425/297
3,299,899 A * 1/1967 Nadherny ..... G07D 3/02 453/12
3,352,629 A * 11/1967 Iverson ..... B65B 55/10 221/135
3,680,566 A * 8/1972 Tanaka ..... G07D 9/008 194/219

(Continued)

FOREIGN PATENT DOCUMENTS

CN 1311741 9/2001
CN 101025838 8/2007

(Continued)

OTHER PUBLICATIONS

Japan Office action, dated May 29, 2014.

(Continued)

*Primary Examiner* — Gene O Crawford
*Assistant Examiner* — Kelvin L Randall, Jr.
(74) *Attorney, Agent, or Firm* — Greenblum & Bernstein, P.L.C.

(57) ABSTRACT

A disk transferring device transferring disks delivered one by one from an disk reception opening to an disk ejection opening includes: a disk guide path having left and right guide surfaces that guide a peripheral surface of each of the disks and front and back guide surfaces that guide an front surface and a back surface of the disk, the disk guide path extending from the disk reception opening toward the disk (Continued)

ejection opening; and a plurality of disk pushers protruding into the disk guide path and pushing the disks by making a rotational movement about a plurality of rotational axis lines approximately at a right angle with respect to the front and back guide surfaces.

37 Claims, 50 Drawing Sheets

(56) References Cited

U.S. PATENT DOCUMENTS

| | | | | |
|---|---|---|---|---|
| 3,930,512 | A * | 1/1976 | Woodland | G07B 15/066 453/32 |
| 4,518,001 | A * | 5/1985 | Branham | 453/49 |
| 4,943,258 | A * | 7/1990 | Abe | 453/30 |
| 5,143,253 | A * | 9/1992 | Takahashi et al. | 221/197 |
| 5,688,166 | A * | 11/1997 | Chen | 453/57 |
| 5,810,655 | A * | 9/1998 | Suzukawa et al. | 453/50 |
| 6,080,057 | A * | 6/2000 | Bell et al. | 453/57 |
| 7,426,987 | B2 * | 9/2008 | Umeda | G07D 3/10 194/303 |
| 7,607,909 | B2 * | 10/2009 | Bergami | B29C 31/048 425/186 |
| 8,517,808 | B2 * | 8/2013 | Chang et al. | 453/57 |
| 2007/0207717 | A1 * | 9/2007 | Enomoto | 453/49 |
| 2008/0090509 | A1 * | 4/2008 | Enomoto | 453/57 |
| 2008/0299886 | A1 * | 12/2008 | Enomoto | 453/3 |
| 2011/0117827 | A1 * | 5/2011 | Chang et al. | 453/57 |

FOREIGN PATENT DOCUMENTS

| | | |
|---|---|---|
| CN | 101315713 | 12/2008 |
| DE | 20 02 360 | 7/1971 |
| EP | 0957456 | 11/1997 |
| GB | 1 564 660 | 4/1980 |
| JP | S61-263473 A | 11/1986 |
| JP | 3-284518 | 12/1991 |
| JP | 5-94575 | 4/1993 |
| JP | 6-103439 | 4/1994 |
| JP | 6-119527 | 4/1994 |
| JP | 6-333120 | 12/1994 |
| JP | 3003410 | 11/1999 |
| JP | 3206699 | 7/2001 |
| JP | 2008-97322 | 4/2008 |
| JP | 2009-70008 | 4/2009 |
| JP | 2009-93557 | 4/2009 |
| JP | 2000-72212 | 3/2012 |
| WO | WO 00/07881 | 2/2000 |

OTHER PUBLICATIONS

Extended European Search Report, dated May 18, 2012.
Chinese Search Report received in Application No. 201110412538X having a filing date of Dec. 12, 2011.

* cited by examiner

DISK TRANSFERRING DEVICE AND DISK DISPENSING DEVICE

BACKGROUND

1. Field of the Disclosure

The present disclosure relates to a disk transferring device transferring disks delivered one by one to a predetermined position and discharging the disks and a disk dispensing device separating disks in bulk one by one and then transferring each disk to a predetermined position and discharging the disk. In detail, the present disclosure relates to a disk transferring device and disk dispensing device to be suitably used when disks of a plurality of types with at least different outer diameters are processed.

Note that a "disk" for use in the specification include a coin as a currency; a token money such as a medal, token, or the like for game machines; and those similar to the above.

2. Background Information

Conventionally, various types of disk transferring devices using a belt, a chain, a screw, or others have been suggested.

For example, Patent Document 1 and Patent Document 2 each disclose a device using a belt. A disk-shaped medium lifting device is configured to include a lifting belt lifting up a disk-shaped medium and a depression belt depressing the disk-shaped medium to be lifted up to this lifting belt, the disk-shaped medium being lifted up as being interposed between the lifting belt and the depression belt. The lifting belt is disposed as being put around paired pulleys arranged on upper and lower sides, and the depression belt is disposed as being put around other paired pulleys arranged on upper and lower sides.

A coin lift of Patent Document 2 is a device in which projected receiving seats are provided a predetermined space apart from each other along a belt traveling direction on a belt surface of an endless belt circulating around both of a driving pulley and a passive pulley and coins are received by the projected receiving seats for lifting.

Also, Patent Document 3 discloses a device using a chain. Coin transferring means is configured of a chain that is arranged above a support surface so as to extend in a coin transferring direction and includes pins for delivering coins provided at predetermined spaces.

Furthermore, Patent Document 4 discloses a coin lifting device using a screw. In the coin lifting device of Patent Document 4, a screw bar is mounted on a vertical rotating shaft and formed as a screw with a pitch exceeding the diameter of a coin around the shaft as an axis line. With the rotation of the screw bar, respective parts for every pitch are positioned so as to successively penetrate at a right angle through an opposite space of respective guides. The respective parts positioned at the penetrating points ascend with the rotation of the screw bar, thereby pushing up the coin to vertically shift the coin upward.

These conventional disk transferring devices have the following problems.

In a belt-type disk transferring device as disclosed in Patent Document 1 and Patent Document 2, it is disadvantageously difficult to increase a transfer distance. That is, to increase the transfer distance, the number of maximum disks to be mounted on the belt is increased, and the load on the belt is also increased accordingly. Since the motive power is transmitted to the belt by a friction force from the pulleys, as the load on the belt is large, a slip occurs between the pulleys and the belt, and therefore there is a limitation to extend the belt length. Although a slip can be suppressed if synchronous belt is used, cost is increased, and therefore such use cannot be easily adopted.

Also when the rotation speed of the pulleys are increased, a slip occurs between the pulleys and the belt, thereby disadvantageously being unable to sufficiently increase the rotation speed and being unable to obtain a desired transfer speed.

Furthermore, when a belt is used, a selection is made from among ready-made belts with a predetermined length, and therefore the belt length can be set only stepwise. This means that the transfer distance cannot be freely set. To use one with a desired belt length, a specially-made one has to be used and, in this case, cost is increased. Therefore, it is disadvantageously difficult to freely set a transfer distance while suppressing cost.

In a chain-type disk transferring device as disclosed in Patent Document 3, since the structure is complex, it is disadvantageously difficult to decrease the size of the chain, thereby increasing the size of the entire device.

In the case of a screw type as disclosed in Patent Document 4, since disks are transferred as being slid over the screw, heat and abrasion occur in association with friction, thereby disadvantageously decreasing durability.

Also, in the case of a screw type, a twist tends to occur as the rotating shaft is longer, thereby making it impossible to normally transfer disks. This twist of the rotating shaft is increased as the rotating shaft length is longer. Therefore, the rotating shaft length cannot be sufficiently made long, thereby disadvantageously being unable to obtain a desired transfer distance. Furthermore, when the device is used in a twisted state for a long period of time, the device may be broken, and durability is decreased after all.

If a metal material with high stiffness is adopted for the rotating shaft and the screw to enhance mechanical strength, the twist of the rotating shaft can be suppressed, allowing the transfer distance to be easily extended and durability to be improved. However, this involves an increase in cost and weight, and therefore cannot be easily adopted.

There is a plurality of types of coins with different outer diameters or thicknesses. As for coin processing devices, various so-called free-size-support devices capable of handling these plurality of types (that is, plurality of denominations) of coins have been conventionally suggested. For example, regarding a coin delivering device separating coins in bulk one by one and delivering the coins, a coin hopper device disclosed in Patent Document 5 and Patent Document 6.

In the device disclosed in Patent Document 5 and Patent Document 6, on an upper surface of a rotary disk tilted upward, a circular support rack protruding to the center of the rotary disk is arranged. Also, coin stoppers are radially arranged from the support rack, and coins pushed by the coin stoppers as being supported by the support rack are guided and delivered in a peripheral direction of the rotary disk by coin receiving means arranged at a predetermined position. Note that Patent Document 7 discloses an improved version of the coin hopper device of Patent Document 6.

On the other hand, in a money changer, a vending machine, a game machine, or the like, in some cases, a coin delivered from a coin delivering device is transferred to a predetermined position. For example, Patent Document 8 discloses a coin delivering device having a coin guide path called an escalator. Also, Patent Document 9 discloses a coin lifting device using a screw, and the coin lifting device also supports a plurality of denominations.

However, in the device disclosed in Patent Document 8, the coins in the escalator are delivered as a lower coin among the coins in an aligned state pushes an upper coin, and therefore the device cannot support denominations with different outer diameters. That is, the inside dimension of a coin path formed in the escalator has to fit the dimension of the denomination to be transferred, and the range of fitting coin outer diameters is small. For example, even if coins with an outer diameter smaller than the inner dimension of the coin path are tried to be transferred, these coins cannot be neatly aligned in the escalator and are in a zigzag state, thereby increasing frictional resistance at the time of transfer. Therefore, stable coin transfer and discharge is difficult. Moreover, if coins even with the same outer diameter but with different thicknesses are mixed together, since the thickness of the coin path is set correspondingly to coins with a maximum thickness, a range of movement in a thickness direction is large for thin coins, and a lower end of an upper-side coin cannot be pushed up by an upper end of a lower-side coin, resulting in stacking of the upper end and the lower end and causing the coins to become unmovable in the coin path to cause coin clogging.

Furthermore, in the device disclosed in Patent Document 8, if no coin is present in the hopper and the escalator, coin transfer cannot be performed, and therefore coins may be left in the hopper and the escalator. To remove the left coins, for example, a cover plate configuring the escalator has to be removed to take out the coins from inside. A technique for solving this problem has been conventionally suggested. For example, in a coin delivering device disclosed in Patent Document 10, an open/close gate is proved on a side wall of a coin path, and coins left in a hopper and an escalator are discharged via the gate in an open state to a collection opening.

In the improved device of Patent Document 10, since the coins left in the escalator is discharged to the collection opening, the coins thrown to the hopper cannot be all transferred to a predetermined position. In other words, to transfer a predetermined number of coins to a predetermined position, extra coins are required to be thrown to the hopper in consideration of the number of coins left (that is, the number of coins to be discharged). Moreover, a collecting device for collecting left coins is also required, and therefore a collection opening is provided, thereby disadvantageously increasing the size of the device.

In a device disclosed in Patent Document 9, although the device can easily support denominations with different outer diameters or thicknesses, as the outer diameter of the coin is larger, the peripheral surface of the coin tends to be disengaged more from the screw surface edge of the screw. In the case of a large-diameter coin, the coin is caught between the screw and the guide path, thereby causing so-called biting. Therefore, realistically, the screw has to be replaced according to the coin outer diameter, and the supportable outer diameter range is disadvantageously insufficient. Moreover, since the screw causes coins to slide, the screw tends to abrade, thereby disadvantageously degrading durability.

Therefore, a novel free-size-support coin transferring device with a wide range of outer diameters or thicknesses of coins to be supported and capable of transferring various denominations of coins has been desired. If this novel coin transferring device is achieved, for example, by combining this device with the coin delivering device of Patent Document 2, a free-size-support coin delivering device can also be achieved.

When the above-described novel coin delivering device is used for transfer vertically upward, in the coin hopper device of Patent Document 6, coins are delivered from the rotary disk upward, and therefore the traveling direction of coins is required to be changed from diagonally upward to vertically upward. Moreover, for supporting size-free, the traveling direction is desired to be changed for coins of a plurality of types with different outer diameters or thicknesses. However, a structure for achieving the functions described above has not been present so far.

PRIOR ART DOCUMENTS

Patent Documents

[Patent Document 1] Japanese Unexamined Patent Application Publication No. 2009-93557 (FIG. 1, paragraph numbers 0007, 0033 to 0035)

[Patent Document 2] Japanese Unexamined Patent Application Publication No. 2000-72212 (FIG. 2, paragraph numbers 0007, 0018)

[Patent Document 3] Japanese Unexamined Patent Application Publication No. H6-119527 (FIG. 1, paragraph numbers 0007, 0011)

[Patent Document 4] Japanese Unexamined Patent Application Publication No. H6-103439 (FIG. 1, paragraph numbers 0006, 0020)

[Patent Document 5] European Patent Application Publication No. 0957456 (FIG. 1 to FIG. 7, pp. 2 to 4)

[Patent Document 6] Japanese Unexamined Patent Application Publication No. 2008-97322 (FIG. 4, paragraph numbers 0006, 0026 to 0028)

[Patent Document 7] Japanese Unexamined Patent Application Publication No. 2009-70008 (FIG. 4, paragraph numbers 0051 to 0058)

[Patent Document 8] Japanese Unexamined Patent Application Publication No. H5-94575 (FIG. 1, FIG. 2, paragraph numbers 0011)

[Patent Document 9] Japanese Patent No. 3003410 (FIG. 2 to FIG. 4, paragraph numbers 0007, 0021)

[Patent Document 10] Japanese Patent No. 3206699 (FIG. 1, paragraph numbers 0022 to 0024)

SUMMARY OF THE DISCLOSURE

The present disclosure was made in consideration of the problems of the conventional art described above, and has a feature of providing a disk transferring device that can be configured without using any of a belt, a chain, and a screw.

Another feature of the present disclosure is to provide a disk transferring device in which a transfer distance can be easily extended.

Still another feature of the present disclosure is to provide a disk transferring device in which the transfer distance can be extended while cost is suppressed.

Still another feature of the present disclosure is to provide a disk transferring device in which the transfer distance can be extended without increasing weight and size.

Still another feature of the present disclosure is to provide a disk transferring device in which a desired transfer speed can be easily obtained.

Still another feature of the present disclosure is to provide a disk transferring device with excellent durability.

Still another feature of the present disclosure is to provide a disk transferring device capable of transferring a delivered disk as its traveling angle is changed.

Still another feature of the present disclosure is to provide a disk transferring device capable of transferring even delivered disks of a plurality of types with different outer diameters or thicknesses as their traveling angle is changed.

Still another feature of the present disclosure is to provide a disk transferring device with a wide range of outer diameters or thicknesses of transferrable disks.

Still another feature of the present disclosure is to provide a disk transferring device capable of discharging all delivered disks without any disk being left.

Still another feature of the present disclosure is to provide a disk transferring device without requiring collection of a left disk.

Still another feature of the present disclosure is to provide a disk dispensing device capable of separating stored disks of a plurality of types with different outer diameters or thicknesses one by one and then transferring the disks to a predetermined position and dispensing them.

Still another feature of the present disclosure is to provide a disk dispensing device with a wide range of outer diameters or thicknesses of dispensable disks.

Still another feature of the present disclosure is to provide a disk dispensing device capable of discharging all disks thrown into a disk delivering device without any disk being left.

Still another feature of the present disclosure is to provide a disk dispensing device without requiring collection of a left disk.

Other features of the present disclosure not clearly described herein are obvious from the following description and the attached drawings.

The disk transferring device and the disk dispensing device according to a non-limiting feature of the present disclosure are configured as follows.

(1) A disk transferring device according to a first aspect of the present disclosure is a disk transferring device delivered one by one from an disk reception opening toward an disk ejection opening, including: a disk guide path having first and second guide surfaces that guide a peripheral surface of each of the disks and third and fourth guide surfaces that guide an front surface and a back surface of the disk, the disk guide path extending from the disk reception opening toward the disk ejection opening; and a plurality of disk pushers protruding into the disk guide path and pushing the disks by making a rotational movement about a plurality of rotational axis lines approximately at a right angle with respect to the third and fourth guide surfaces.

The disk transferring device according to the first aspect of the present disclosure includes the disk guide path extending from the disk reception opening toward the disk ejection opening and the plurality of disk pushers making a rotational movement about the plurality of rotational axis lines approximately at a right angle with respect to the third and fourth guide surfaces. The disk guide path has the first and second guide surfaces that guide a peripheral surface of each of the disks and the third and fourth guide surfaces that guide an front surface and a back surface of the disk. The plurality of disk pushers protrude into the disk guide path and make a rotational movement to push the disks. Therefore, when the disks delivered one by one are introduced into the disk guide path, the disks are sequentially pushed by the plurality of pushers making a rotational movement as being guided with the first, second, third and fourth guide surfaces to be transferred through the disk guide path.

As such, the disk transferring device according to the first aspect of the present disclosure has a function of transferring the disks by causing the plurality of disk pushers protruding into the disk guide path to make a rotational movement. This can be achieved if only there is a mechanism of causing the plurality of disk pushers to make a rotational movement, which means that the structure can be achieved without using any of a belt, a chain, and a screw. Therefore, various problems occurring in the conventional disk transferring device of a type using any of a belt, a chain, and a screw can be solved.

That is, unlike the conventional disk transferring device of the belt type, belt slipping does not occur, and therefore the transfer distance can be easily extended and a desired transfer speed can be easily obtained. Furthermore, if a member for forming the disk guide path is processed, the length of the disk guide path can be relatively freely set. Therefore, it is not required to prepare a specially-fabricated belt, and thus the transfer distance can be extended while cost is suppressed.

Also, compared with the conventional disk transferring device of the chain type, the structure is not complex, and therefore the entire device can be relatively made small. Therefore, the transfer distance can be extended without increasing the size of the entire device.

Unlike the conventional disk transferring device of the screw type, it is not necessary to consider torsion occurring to the rotating shaft of the screw, and therefore durability is excellent and a desired transfer distance can be easily obtained. Furthermore, it is little required to adopt a metal material with high stiffness, and therefore the transfer distance can be extended without increasing weight.

Note that in the disk transferring device according to the first aspect of the present disclosure, "third and fourth guide surfaces" include those substantially functioning as surfaces and, for example, string-shaped members may be arranged in parallel to each other and caused to function as a surface. Also, a "rotational axis line" means a straight line as a center of rotation, and "making a rotational movement about the rotational axis line" means a thing at a position away from the rotational axis line rotates about the rotational axis line.

(2) In a preferred example of the disk transferring device according to the first aspect of the present disclosure, in the disk transferring device according to (1) described above, the plurality of rotational axis lines are arranged in the disk guide path a predetermined space apart from each other alternately on first and second axis arrangement lines positioned in parallel to each other along the disk guide path and are arranged in a zigzag manner along a direction in which the disk guide path extends.

In other words, the device includes a plurality of disk pushers with the rotational axis lines arranged on the first axis arrangement line (hereinafter referred to as disk pushers of a first group) and a plurality of disk pushers with the rotational axis lines arranged on the second axis arrangement line (hereinafter referred to as disk pushers of a second group), and the rotational axis lines corresponding to the disk pushers of the first and second groups are arranged in a zigzag manner. The disk pushers of the first and second groups make a rotational movement about the rotational axis lines arranged in the zigzag manner.

Therefore, by making the rotating directions of the disk pushers of the first and second groups in reverse to each other and providing an appropriate phase difference to the rotational movement, the disk pushers of the first and second groups make contact with the peripheral surface of the disk with a predetermined cycle and a time difference, thereby allowing the disks to be alternately pushed. When the disks delivered one by one are introduced from the disk reception opening into the disk guide path, the disks are alternately pushed by the disk pushers of the first and second groups making a rotational movements as being guided with the first, second, third and fourth guide surfaces, thereby transferring the disks through the disk guide path.

In this case, since the plurality of disk pushers are arranged in two lines as the disk pushers of the first and second groups, the transfer speed of the disks can be increased. That is, the moving speed of the disk pushers making a rotational movement is formed of a speed component along a transferring direction and a speed component at a right angle with respect to the transferring direction, and these speed components are changed according to the rotation angle of the disk pushers. As the speed component along the transferring direction is larger, the transfer speed of the disks is faster. When the plurality of disk pushers are arranged in two lines, a range of rotation angles with relatively large speed components along the transferring direction can be easily used from out of a range of rotation angles of the disk pushers, and therefore the transfer speed of the disks can be increased.

(3) In another preferred example of the disk transferring device according to the first aspect of the present disclosure, in the disk transferring device according to (1) described above, the plurality of rotational axis lines are arranged in the disk guide path a predetermined space apart from each other on one axis arrangement line along a direction in which the disk guide path extends.

In other words, the rotational axis lines of the plurality of disk pushers are arranged in one line on the axis arrangement line. In still other words, the device includes a plurality of disk pushers corresponding to the odd-numbered rotational axis lines arranged on the axis arrangement line (hereinafter referred to as disk pushers of a first group) and a plurality of disk pushers corresponding to the even-numbered rotational axis lines arranged on the axis arrangement line (hereinafter referred to as disk pushers of a second group), and the disk pushers of the first and second groups make a rotational movement about the rotational axis lines on the axis arrangement line.

Therefore, by making the rotating directions of the disk pushers of the first and second groups in reverse to each other and providing an appropriate phase difference to the rotational movement, the disk pushers of the first and second groups make contact with the peripheral surface of the disk with a predetermined cycle and a time difference, thereby allowing the disks to be alternately pushed. When the disks delivered one by one are introduced from the disk reception opening into the disk guide path, the disks are alternately pushed by the disk pushers of the first and second groups making a rotational movements as being guided with the first, second, third and fourth guide surfaces, thereby transferring the disks through the disk guide path.

In this case, although the transfer speed of the disks is lower than that when the plurality of disk pushers are arranged in two lines, the number of disk pushers required to obtain a predetermined transfer distance can be advantageously decreased.

(4) In still another preferred example of the disk transferring device according to the first aspect of the present disclosure, in the disk transferring device according to any of (1) to (3) described above, at least two or more of the disk pushers are provided to each of the plurality of rotational axis lines. In this case, two or more of the disk pushers each push the disks, the number of disks that can be transferred per one rotational movement can be advantageously increased. In other words, efficiency of transferring the disks can be advantageously increased.

(5) In still another preferred example of the disk transferring device according to the first aspect of the present disclosure, in the disk transferring device according to any one of (1) to (3) described above, the first and second guide surfaces are each formed along a curve formed by connecting a plurality of segments of circles respectively centering on the plurality of rotational axis lines. In this case, the circular trails of the disk pushers making a rotational movement and the flat shape of the first and second guide surfaces are coaxial with each other. Therefore, the disk pushers can advantageously push the disks smoothly. In other words, the load when the disk pushers are caused to make a rotational movement can be advantageously reduced.

(6) In still another preferred example of the disk transferring device according to the first aspect of the present disclosure, in the disk transferring device according to any one of (1) to (3) described above, a plurality of rotary disks respectively corresponding to the plurality of rotational axis lines are arranged on the fourth guide surface of the disk guide path, and the plurality of disk pushers are each provided to a peripheral part of a corresponding one of the rotary disks. In this case, the rotational movement of the disk pushers can be advantageously achieved easily with a simple structure. Also, if the outer diameter of the rotary disk is changed, it is advantageously possible to support varied outer diameters of the disks and easily make a design change.

(7) In still another preferred example of the disk transferring device according to the first aspect of the present disclosure, in the disk transferring device according to (6) described above, gear wheels are respectively and coaxially arranged on the plurality of rotary disks, the gear wheels each rotate integrally with a corresponding one of the rotary disks, and adjacent ones of the gear wheels engage with each other. In this case, with any of the gear wheels positioned at both ends being taken as a driving gear wheel and the other gear wheel being taken as a driven gear wheel, the rotating directions of the disk pushers of the first and second groups are automatically reversed and, furthermore, all of the disk pushers make a rotational movement in synchronization with each other. Therefore, it is advantageously possible to easily achieve the function of reversing the rotating directions of the disk pushers of the first and second groups and providing an appropriate phase difference to a rotational movement with a simple structure.

(8) In still another preferred example of the disk transferring device according to the first aspect of the present disclosure, in the disk transferring device according to (6) described above, the plurality of rotary disks are arranged so as to each have a surface approximately flush with the fourth guide surface of the disk guide path. In this case, since the front surface of the rotary disk guides the disks in cooperation with the fourth guide surface, it is advantageously possible to transfer the disks more smoothly.

(9) A disk transferring device according to a second aspect of the present disclosure is a disk transferring device receiving disks delivered one by one at an disk reception opening and discharging the disks to an disk ejection opening, including: a disk guide path having first and second guide surfaces that guide a peripheral surface of each of the disks and third and fourth guide surfaces that guide an front surface and a back surface of the disk, the disk guide path extending from the disk reception opening toward the disk ejection opening; first disk pusher protruding into the disk guide path and pushing the delivered disks by making a rotational movement in a first rotational direction about a first rotational axis line approximately perpendicular to the third and fourth guide surfaces; and second disk pusher protruding into the disk guide path and pushing the disks moved with the pushing of the first disk pusher by making a rotational movement in a second rotational direction opposite to the first rotational direction about a second rotational axis line approximately perpendicular to the third and fourth guide surfaces, the first and second rotational axis lines being arranged to cross at a predetermined angle when viewed from either one of the first and second guide surfaces.

The disk transferring device according to the second aspect of the present disclosure includes the disk guide path extending from the disk reception opening to the disk ejection opening, the first disk pusher making a rotational movement in the first rotational direction about the first rotational axis line approximately perpendicular to the third and fourth guide surfaces, and second disk pusher making a rotational movement in the second rotational direction opposite to the first rotational direction about the second rotational axis line approximately perpendicular to the third and fourth guide surfaces. The disk guide path has the first and second guide surfaces that guide a peripheral surface of each of the disks and the third and fourth guide surfaces that guide an front surface and a back surface of the disk. The first and second disk pushers protrude into the disk guide path and push the peripheral surfaces of the disks by making a rotational movement in directions in reverse to each other. Therefore, when the rotational movements of the first and second disk pushers are synchronized with each other and an appropriate phase difference is provided, the disk received at the disk reception opening is pushed by the first disk pusher to move along the disk guide path, and then is pushed by the second disk pusher to be moved along the disk guide path. Furthermore, the first and second rotational axis lines are arranged so as to cross each other at a predetermined angle when viewed from either one of the first and second guide surfaces. Therefore, by setting this angle in accordance with the change amount of the traveling angle in the disk transferring device, the disk can be transferred while its traveling direction is changed.

When the disks with their peripheral surfaces being guided with the first and second guide surfaces and with their front surfaces and back surfaces being guided with the third and fourth guide surfaces are pushed and moved by the disk pusher making a rotational movement, the range of outer diameters or thicknesses of transferrable disks is widened. That is, since the disk pusher protruding into the disk guide path are arranged between the first and second guide surfaces, if a disk is larger than a space between the first and second guide surfaces and the disk pusher and has an outer diameter in a range smaller than the space between the first and second guide surfaces, the disk can be transferred while being supported by either one of the first and second guide surfaces and the disk pusher. Therefore, the range of outer diameters of the transferrable disks is widened. On the other hand, since the disks are pushed by each of the disk pushers one by one, adjacent disks are prevented from overlapping each other in the disk guide path. Therefore, even if a space between the third and fourth guide surfaces is set widely, disk clogging does not occur. Therefore, the range of the thicknesses of the transferrable disks can be widened. Thus, even disks of a plurality of types with different outer diameters or thicknesses can be transferred as their traveling angle is changed.

Furthermore, since the disks are transferred with the rotational movement of the first and second disk pushers, unlike the device of the conventional art in which an upper disk is pushed with a lower disk for transfer, a disk is prevented from being left. Therefore, collection of a left disk is not required. Also, all disks can be discharged from the disk ejection opening without having the delivered disks left.

(10) A disk transferring device according to a third aspect of the present disclosure is a disk transferring device receiving disks delivered one by one at an disk reception opening and discharging the disks to an disk ejection opening, including: a disk guide path having first and second guide surfaces that guide a peripheral surface of each of the disks and third and fourth guide surfaces that guide an front surface and a back surface of the disk, the disk guide path extending from the disk reception opening toward the disk ejection opening; and first to n-th disk pushers each protruding into the disk guide path and pushing the disks by making a rotational movement about a corresponding one of first to n-th (where n is a positive integer) rotational axis lines approximately perpendicular to the third and fourth guide surfaces, the first and n-th rotational axis lines being arranged in a predetermined sequence from the disk reception opening toward the disk ejection opening, in ones among the first to n-th disk pushers that are adjacent to each other as a pair corresponding to each of the rotational axis lines, one of the disk pushers making a rotational movement in a first rotational direction and another of the disk pushers making a rotational movement in a second rotational direction opposite to the first rotational direction, and at least adjacent rotational axis line as a pair among the first to n-th rotational axis lines being arranged to cross at a predetermined angle when viewed from either one of the first and second guide surfaces.

The disk transferring device according to the third aspect of the present disclosure includes the disk guide path extending from the disk reception opening toward the disk ejection opening and the first to n-th disk pushers making a rotational movement about a corresponding one of the first to n-th rotational axis lines approximately perpendicular to the third and fourth guide surfaces. The disk guide path has the first and second guide surfaces that guide a peripheral surface of each of the disks and the third and fourth guide surfaces that guide an front surface and a back surface of the disk. The first to n-th rotational axis lines are arranged in a predetermined sequence from the disk reception opening toward the disk ejection opening. In ones among the first to n-th disk pushers that are adjacent to each other as a pair corresponding to each of the rotational axis lines, with one of the disk pushers making a rotational movement in a first rotational direction and another of the disk pushers making a rotational movement in a second rotational direction opposite to the first rotational direction, the peripheral surface of the disk is pushed. Therefore, when the rotational movements of the first and n-th disk pushers are synchronized with each other and an appropriate phase difference is provided, the disk received at the disk reception opening is pushed by the first to n-th disk pushers sequentially to move along the disk guide path. Furthermore, at least paired rotational axis lines among the first to n-th rotational axis lines are arranged so as to cross each other at a predetermined angle when viewed from either one of the first and second guide surfaces. Therefore, by setting this angle in accordance with the change amount of the traveling angle in the disk transferring device, the disk can be transferred while its traveling direction is changed.

When the disks with their peripheral surfaces being guided with the first and second guide surfaces and with their front surfaces and back surfaces being guided with the third and fourth guide surfaces are pushed and moved by the disk pusher making a rotational movement, the range of outer diameters or thicknesses of transferrable disks is widened. That is, since the disk pushers protruding into the disk guide path are arranged between the first and second guide surfaces, if a disk is larger than a space between the first and second guide surfaces and the disk pusher and has an outer diameter in a range smaller than the space between the first and second guide surfaces, the disk can be transferred while being supported by either of the first and second guide surfaces and the disk pusher. Therefore, the range of outer diameters of the transferrable disks is widened. On the other hand, since the disks are pushed by each of the disk pushers one by one, adjacent disks are prevented from overlapping each other in the disk guide path. Therefore, even if a space between the third and fourth guide surfaces is set widely, disk clogging does not occur. Therefore, the range of the thicknesses of the transferrable disks can be widened. Thus, even disks of a plurality of types with different outer diameters or thicknesses can be transferred as their traveling angle is changed.

Furthermore, since the disks are transferred with the rotational movement of the first and n-th disk pushers, unlike the device of the conventional art in which an upper disk is pushed with a lower disk for transfer, a disk is prevented from being left. Therefore, collection of a left disk is not required, and process efficiency can be increased. Also, all disks can be discharged from the disk ejection opening without having the delivered disks left. Furthermore, by causing the first to n-th disk pushers to make a rotational movement in a rotating direction in reverse to that at the time of normal transfer of the disks, the disks in the disk guide path can be transferred in a reversed direction from the disk ejection opening toward the disk reception opening.

(11) A disk transferring device according to a forth aspect of the present disclosure is a disk transferring device receiving disks delivered one by one at an disk reception opening and discharging the disks to an disk ejection opening, including: a disk guide path having first and second guide surfaces that guide a peripheral surface of each of the disks and third and fourth guide surfaces that guide an front surface and a back surface of the disk, the disk guide path extending from the disk reception opening toward the disk ejection opening; and first to n-th disk pushers each protruding into the disk guide path and pushing the disks by making a rotational movement about a corresponding one of first to n-th (where n is a positive integer) rotational axis lines approximately perpendicular to the third and fourth guide surfaces, the first and n-th rotational axis lines being arranged in a predetermined sequence from the disk reception opening toward the disk ejection opening, in ones among the first to n-th disk pushers that are adjacent to each other as a pair corresponding to each of the rotational axis lines, one of the disk pushers making a rotational movement in a first rotational direction and another of the disk pushers making a rotational movement in a second rotational direction opposite to the first rotational direction, and the first and second rotational axis lines being arranged to cross at a predetermined angle when viewed from either one of the first and second guide surfaces.

The disk transferring device according to the fourth aspect of the present disclosure includes the disk guide path extending from the disk reception opening toward the disk ejection opening and the first to n-th disk pushers making a rotational movement about a corresponding one of the first to n-th rotational axis lines approximately perpendicular to the third and fourth guide surfaces. The disk guide path has the first and second guide surfaces that guide a peripheral surface of each of the disks and the third and fourth guide surfaces that guide an front surface and a back surface of the disk. The first to n-th rotational axis lines are arranged in a predetermined sequence from the disk reception opening toward the disk ejection opening. In ones among the first to n-th disk pushers that are adjacent to each other as a pair corresponding to each of the rotational axis lines, with one of the disk pushers making a rotational movement in a first rotational direction and another of the disk pushers making a rotational movement in a second rotational direction opposite to the first rotational direction, the peripheral surface of the disk is pushed. Therefore, when the rotational movements of the first and n-th disk pushers are synchronized with each other and an appropriate phase difference is provided, the disk received at the disk reception opening is pushed by the first to n-th disk pushers sequentially to move along the disk guide path. Furthermore, the first and second rotational axis lines are arranged so as to cross each other at a predetermined angle when viewed from either one of the first and second guide surfaces. Therefore, by setting this angle in accordance with the change amount of the traveling angle in the disk transferring device, the disk can be transferred while its traveling direction is changed.

When the disks with their peripheral surfaces being guided with the first and second guide surfaces and with their front surfaces and back surfaces being guided with the third and fourth guide surfaces are pushed and moved by the disk pusher making a rotational movement, the range of outer diameters or thicknesses of transferrable disks is widened. That is, since the disk pushers protruding into the disk guide path are arranged between the first and second guide surfaces, if a disk is larger than a space between the first and second guide surfaces and the disk pusher and has an outer diameter in a range smaller than the space between the first and second guide surfaces, the disk can be transferred while being supported by either of the first and second guide surfaces and the disk pusher. Therefore, the range of outer diameters of the transferrable disks is widened. On the other hand, since the disks are pushed by each of the disk pushers one by one, adjacent disks are prevented from overlapping each other in the disk guide path. Therefore, even if a space between the third and fourth guide surfaces is set widely, disk clogging does not occur. Therefore, the range of the thicknesses of the transferrable disks can be widened. Thus, even a plurality of types of disks with different outer diameters or thicknesses can be transferred as their traveling angle is changed.

Furthermore, since the disks are transferred with the rotational movement of the first and n-th disk pushers, unlike the device of the conventional art in which an upper disk is pushed with a lower disk for transfer, a disk is prevented from being left. Therefore, collection of a left disk is not required, and process efficiency can be increased. Also, all disks can be discharged from the disk ejection opening without having the delivered disks left. Furthermore, by causing the first to n-th disk pushers to make a rotational movement in a rotating direction in reverse to that at the time of normal transfer of the disks, the disks in the disk guide path can be transferred in a reversed direction from the disk ejection opening toward the disk reception opening.

Note that in the disk transferring device according to the second and third aspects of the present disclosure, "third and fourth guide surfaces" include those substantially functioning as surfaces and, for example, string-shaped members may be arranged in parallel to each other and caused to function as a surface. Also, a "rotational axis line" means a straight line as a center of rotation, and "the rotational axis lines cross each other" includes the meaning that the rotational axis lines cross each other on their extended lines. "Making a rotational movement about the rotational axis line" means a thing at a position away from the rotational axis line rotates about the rotational axis line.

(12) In a preferred example of the disk transferring device according to the forth aspect of the present disclosure, in the disk transferring device according to (11) described above, the second to n-th rotational axis lines are arranged in the disk guide path a predetermined space apart from each other alternately on first and second axis arrangement lines positioned in parallel to each other along the disk guide path and are arranged in a zigzag manner along a direction in which the disk guide path extends. In this case, since the second to n-th disk pushers are arranged in two lines on the first and second axis arrangement lines, the transfer speed of the disks can be increased. That is, the moving speed of the disk pushers making a rotational movement is formed of a speed component along a transferring direction and a speed component at a right angle with respect to the transferring direction, and these speed components are changed according to the rotation angle of the disk pushers. As the speed component along the transferring direction is larger, the transfer speed of the disks is faster. When the second to n-th disk pushers are arranged in two lines, the range of rotation angles with relatively large speed components along the transferring direction can be easily used from out of a range of rotation angles of the disk pushers, and therefore the transfer speed of the disks can be increased.

(13) In another preferred example of the disk transferring device according to the forth aspect of the present disclosure, in the disk transferring device according to (11) described above, the fourth guide surface has a first guide surface portion orthogonal to the first rotational axis line and a second guide surface portion orthogonal to the second rotational axis line, and the first and second guide surface portions are connected to each other via a first curved surface portion. In this case, since the disks are guided along the first curved surface portion, the traveling angle of the disks can be more smoothly changed.

(14) In still another preferred example of the disk transferring device according to the forth aspect of the present disclosure, in the disk transferring device according to (13) described above, the third guide surface has a second curved surface portion facing the first curved surface portion. In this case, since the disks are guided along the first and second curved surface portions, the traveling angle of the disks can be further more smoothly changed.

(15) In still another preferred example of the disk transferring device according to the forth aspect of the present disclosure, in the disk transferring device according to (13) described above, the first and second disk pushers are arranged so that trails of the rotational movements of the first and second disk pushers are formed a predetermined space apart from each other. In this case, since the first curved surface portion can be formed correspondingly with the predetermined space, it is advantageously possible to ensure a region required for the first curved surface portion.

(16) In still another preferred example of the disk transferring device according to the forth aspect of the present disclosure, in the disk transferring device according to (11) described above, the first to n-th disk pushers are configured of at least two or more disk pushers respectively arranged to the first to n-th rotational axis lines. In this case, since the disks are pushed by each of two or more of the disk pushers, the number of disks that can be moved per one rotational movement can be advantageously increased. In other words, efficiency of transferring the disks can be advantageously increased.

(17) In still another preferred example of the disk transferring device according to the forth aspect of the present disclosure, in the disk transferring device according to (11) described above, the first and second guide surfaces are each formed along a curve formed by connecting segments of circles respectively centering on the first to n-th rotational axis line. In this case, the circular trails of the first to n-th disk pushers making a rotational movement and the flat shape of the first and second guide surfaces are coaxial with each other. Therefore, the first to n-th disk pushers can advantageously push the disks smoothly. In other words, the load when the disk pushers are caused to make a rotational movement can be advantageously reduced.

(18) In still another preferred example of the disk transferring device according to the forth aspect of the present disclosure, in the disk transferring device according to (11) described above, first to n-th rotary disks respectively corresponding to the first to n-th rotational axis lines are arranged on the fourth guide surface of the disk guide path, and the first to n-th disk pushers are each provided to a peripheral part of a corresponding one of the first to n-th rotary disks. In this case, the rotational movement of the first to n-th disk pushers can be advantageously achieved with a simple structure.

(19) In still another preferred example of the disk transferring device according to the forth aspect of the present disclosure, in the disk transferring device according to (18) described above, first and second gear wheels are respectively and coaxially arranged on the first and second rotary disks, the first and second gear wheels each rotate integrally with a corresponding one of the first and second rotary disks, and the first and second gear wheels engage with each other. In this case, the first and second rotary disks rotate in synchronization with directions opposite to each other. In other words, the rotating directions of the first and second pushers are automatically reversed and, furthermore, the first and second disk pushers make a rotational movement in synchronization with each other. Therefore, it is advantageously possible to easily achieve the function of reversing the rotating directions of the first and second disk pushers and providing an appropriate phase difference to a rotational movement with a simple structure.

(20) In still another preferred example of the disk transferring device according to the forth aspect of the present disclosure, in the disk transferring device according to (19) described above, the first and second gear wheels each include a bevel gear portion having a cone angle corresponding to the predetermined angle. In this case, though a simple structure in which the first and second gear wheels engage with each other, with the predetermined angle being formed by the first and second rotational axis lines, the first and second disk pushers can be advantageously caused to make a rotational movement.

(21) In still another preferred example of the disk transferring device according to the forth aspect of the present disclosure, in the disk transferring device according to (19), the first gear wheel includes a spur gear portion, and a driving force is transmitted from driver (driving means) to the first gear wheel via the spur gear portion. In this case, when the disk transferring device is used together with the disk delivering device, it is advantageously possible to use driver of the disk delivering device with a relatively simple structure and omit driver dedicated to the disk transferring device. Furthermore, since the disk delivering device and the disk transferring device are driven by one driver, the disk delivering device and the disk transferring device can also be advantageously driven easily in synchronization with each other.

(22) In still another preferred example of the disk transferring device according to the forth aspect of the present disclosure, in the disk transferring device according to (19) described above, a driving force is transmitted from driver to the first gear wheel, and a torque limiter is arranged in a driving-force transmitting route between the driver and the first gear wheel. In this case, in the disk transferring device, even if biting of the disk occurs, the driving force transmitted from the driver to the first gear wheel is interrupted by the torque limiter. Therefore, an excessive load is not put on an associated component, such as the first to n-th disk pushers, thereby advantageously preventing component damage and improving durability. Furthermore, since an excessive load is not exerted, component strength to be required can be small, thereby advantageously decreasing component size and, in turn, decreasing the size of the entire device.

(23) In still another preferred example of the disk transferring device according to the forth aspect of the present disclosure, in the disk transferring device according to (18) described above, third gear wheels are respectively and coaxially arranged on the second to n-th rotary disks, the third gear wheels rotate integrally with a corresponding one of the second to n-th rotary disks, and adjacent ones of the third gear wheels engage with each other. In this case, paired adjacent rotary disks in the second to n-th rotary disks rotate in directions in reverse to each other, and all of the second to n-th rotary disks rotate in synchronization with each other. In other words, the disk pushers corresponding to the paired adjacent rotational axis lines in the second to n-th disk pushers make a rotational movement in directions in reverse to each other and, furthermore, all of these disk pushers make a rotational movement in synchronization with each other. Therefore, it is advantageously possible to easily achieve the function of reversing the rotating directions and providing an appropriate phase difference to a rotational movement with a simple structure.

(24) In still another preferred example of the disk transferring device according to the forth aspect of the present disclosure, in the disk transferring device according to (11) described above, a rotation monitoring sensor is provided detecting the presence or absence of any of the rotational movements of the first to n-th disk pushers and, when detecting a stop of any of the rotational movements of the first to n-th disk pushers, the rotation monitoring sensor outputs a signal indicating the stop of the rotational movement. In this case, when biting of the disk occurs in the disk transferring device and the rotational movement of the first to n-th disk pushers is stopped, delivery of the disks can be advantageously stopped based on a signal indicating a stop of the rotational movement. In other words, it is advantageously possible to avoid unnecessary load from occurring in the disk transferring device and improve durability.

(25) In still another preferred example of the disk transferring device according to the forth aspect of the present disclosure, in the disk transferring device according to (11) described above, the device includes a plurality of disk transferring units each having a disk guide path portion formed by dividing the disk guide path in an extending direction and an end face provided correspondingly to an disk reception opening or an disk ejection opening of the disk guide path portion, the end faces being able to abut on each other, and having arranged therein a rotational axis line among the first to n-th rotational axis lines corresponding to the disk guide path portion, and the plurality of disk transferring units are connected to each other with the end faces abutting on each other. In this case, by appropriately setting the number of disk transferring units to be connected, the transfer distance in the disk transferring device can be advantageously changed easily. Also, the coin transferring units of a plurality of types with different rotational axis lines to be disposed are prepared in advance, and by combining these as appropriate, any transfer distance can be obtained stepwise. That is, by appropriately setting the type and number of coin transferring units to be connected, the transfer distance can be easily changed.

(26) In still another preferred example of the disk transferring device according to the forth aspect of the present disclosure, in the disk transferring device according to (25) described above, a first disk ejection opening disk transferring unit and a second disk ejection opening disk transferring unit are prepared, the first disk ejection opening disk transferring unit having the n-th rotational axis line arranged therein and the disk ejection opening provided on a left side of the disk guide path, and the second disk ejection opening disk transferring unit having the n-th rotational axis line arranged therein and the disk ejection opening provided on a right side of the disk guide path. In this case, by selectively using either one of the first and second disk ejection opening disk transferring units, left and right dispensing can be both advantageously supported easily without changing the structure of other disk transferring units.

(27) In still another preferred example of the disk transferring device according to the forth aspect of the present disclosure, in the disk transferring device according to (11) described above, the device has disk discharger (disk discharging means) and a disk dispensing detection sensor, the disk discharger ejecting the disks in the disk guide path toward the disk ejection opening and the disk dispensing detection sensor detecting the disks ejected by the disk discharger. In this case, the disks are discharged from the disk ejection opening by the disk discharger, and the number of disks to be discharged from the disk ejection opening (that is, dispensed from the disk ejection opening) is counted by the disk dispensing detection sensor. Furthermore, by setting the force of ejecting the disks by the disk discharger constant, the disks are ejected at a predetermined speed, and therefore the disk dispensing detection sensor can reliably and easily detect the disks. In other words, the number of disks dispensed from the disk ejection opening can be advantageously counted in a stable manner.

(28) A disk dispensing device according to a fifth aspect of the present disclosure is a disk dispensing device having a disk delivering device separating disks in bulk one by one for delivery and a disk transferring device receiving the disks delivered from the disk delivering device at an disk reception opening and transferring the disks to the disk ejection opening, the disk dispensing device dispensing the disks to a predetermined place, the disk delivering device including: a storing bowl storing the disks in bulk; a rotary disk tilted upward at a predetermined angle, having a circular support rack formed at a center of an upper surface, having a plurality of disk stoppers radially extending from the support rack in a peripheral direction, receiving the disks stored in the storing bowl one by one with a surface contact with a holding surface between the plurality of disk stoppers, and pushing the disks with the plurality of disk stoppers while the disks are supported by the support rack and the holding surface; disk receiver (disk receiving means) extending near the support rack in the peripheral direction of the rotary disk, receiving the disks pushed by the rotary disk, and delivering the disks one by one in the peripheral direction of the rotary disk; and driver rotationally driving the rotary disk, the disk transferring device including: a disk guide path having first and second guide surfaces that guide a peripheral surface of each of the disks and third and fourth guide surfaces that guide an front surface and a back surface of the disk, the disk guide path extending from the disk reception opening toward the disk ejection opening; and first to n-th disk pushers each protruding into the disk guide path and pushing the disks by making a rotational movement about a corresponding one of first to n-th (where n is a positive integer) rotational axis lines approximately perpendicular to the third and fourth guide surfaces, the first and n-th rotational axis lines being arranged in a predetermined sequence from the disk reception opening toward the disk ejection opening, in ones among the first to n-th disk pushers that are adjacent to each other as a pair corresponding to each of the rotational axis lines, one of the disk pushers making a rotational movement in a first rotational direction and another of the disk pushers making a rotational movement in a second rotational direction opposite to the first rotational direction, and the first and second rotational axis lines being arranged to cross at a predetermined angle when viewed from either one of the first and second guide surfaces.

In the disk dispensing device according to the fifth aspect of the present disclosure, the disk delivering device includes: the storing bowl storing the disks in bulk; the rotary disk tilted upward at a predetermined angle, having a circular support rack formed at a center of an upper surface, having the plurality of disk stoppers evenly spaced and radially extending from the support rack in a peripheral direction; the disk receiver extending near the support rack in the peripheral direction of the rotary disk; and the driver rotationally driving the rotary disk. The rotary disk rotated by the driver receives the disks one by one with the disks in surface contact with the holding surface between the plurality of disk stoppers. Since the plurality of disk stoppers radially extend from the support rack side in the peripheral direction, the disks of the plurality of types with different outer diameters can be received between the plurality of disk stoppers. Then, the disk receiver receives the disks pushed by the plurality of disk stoppers as being supported by the support rack and the holding surface, and delivers the disks to outside in the peripheral direction of the rotary disk. Therefore, even if disks of a plurality of types with different outer diameters are thrown into the storing bowl, the disk delivering device can reliably deliver the disks.

Also, the disk transferring device includes the disk guide path extending from the disk reception opening toward the disk ejection opening and the first to n-th disk pushers making a rotational movement about a corresponding one of the first to n-th rotational axis lines approximately perpendicular to the third and fourth guide surfaces. The disk guide path has the first and second guide surfaces that guide a peripheral surface of each of the disks and the third and fourth guide surfaces that guide an front surface and a back surface of the disk. The first to n-th rotational axis lines are arranged in a predetermined sequence from the disk reception opening toward the disk ejection opening. In ones among the first to n-th disk pushers that are adjacent to each other as a pair corresponding to each of the rotational axis lines, with one of the disk pushers making a rotational movement in a first rotational direction and another of the disk pushers making a rotational movement in a second rotational direction opposite to the first rotational direction, the peripheral surface of the disk is pushed. Therefore, when the rotational movements of the first and n-th disk pushers are synchronized with each other and an appropriate phase difference is provided, the disk received at the disk reception opening is pushed by the first to n-th disk pushers sequentially to move along the disk guide path. Furthermore, the first and second rotational axis lines are arranged so as to cross each other at a predetermined angle when viewed from either one of the first and second guide surfaces. Therefore, by setting this angle in accordance with the change amount of the traveling angle in the disk transferring device, the disk can be transferred while its traveling direction is changed.

When the disks with their peripheral surfaces being guided with the first and second guide surfaces and with their front surfaces and back surfaces being guided with the third and fourth guide surfaces are pushed and moved by the disk pushers making a rotational movement, the range of outer diameters or thicknesses of transferrable disks is widened. That is, since the disk pushers protruding into the disk guide path are arranged between the first and second guide surfaces, if a disk is larger than a space between the first and second guide surfaces and the disk pushers and has an outer diameter in a range smaller than the space between the first and second guide surfaces, the disk can be transferred while being supported by either of the first and second guide surfaces and the disk pushers. Therefore, the range of outer diameters of the transferrable disks is widened. On the other hand, since the disks are pushed by each of the disk pushers one by one, adjacent disks are prevented from overlapping each other in the disk guide path. Therefore, even if a space between the third and fourth guide surfaces is set widely, disk clogging does not occur. Therefore, the range of the thicknesses of the transferrable disks can be widened. Thus, even a plurality of types of disks with different outer diameters or thicknesses can be transferred as their traveling angle is changed.

Furthermore, since the disks are transferred with the rotational movement of the first and n-th disk pushers, unlike the device of the conventional art in which an upper disk is pushed with a lower disk for transfer, a disk is prevented from being left. Therefore, collection of a left disk is not required, and process efficiency can be increased. Also, all disks can be discharged from the disk ejection opening without having the delivered disks left. Furthermore, by causing the first to n-th disk pushers to make a rotational movement in a rotating direction in reverse to that at the time of normal transfer of the disks, the disks in the disk guide path can be transferred in a reversed direction from the disk ejection opening to the disk reception opening.

Therefore, in the disk dispensing device according to the fifth aspect of the present disclosure, the disks of the plurality of types with different outer diameters or thicknesses in bulk can be separated one by one and be dispensed to a predetermined place. Also, the range of outer diameters of transferrable disks is widened. Furthermore, collection of a left disk is not required, and process efficiency can be increased. Still further, all of the disks can be discharged from the disk ejection opening of the disk transferring device with disk ejection opening the disks thrown into the storing bowl of the disk delivering device left.

Note that in the disk dispensing device according to the fifth aspect of the present disclosure, "third and fourth guide surfaces" include those substantially functioning as surfaces and, for example, string-shaped members may be arranged in parallel to each other and caused to function as a surface. Also, a "rotational axis line" means a straight line as a center of rotation, and "the rotational axis lines cross each other"

includes the meaning that the rotational axis lines cross each other on their extended lines. "Making a rotational movement about the rotational axis line" means a thing at a position away from the rotational axis line rotates about the rotational axis line.

(29) In a preferred example of disk dispensing device according to the fifth aspect of the present disclosure, in the disk dispensing device according to (28) described above, the second to n-th rotational axis lines are arranged in the disk guide path a predetermined space apart from each other alternately on first and second axis arrangement lines positioned in parallel to each other along the disk guide path and are arranged in a zigzag manner along a direction in which the disk guide path extends. In this case, since the second to n-th disk pushers are arranged in two lines on the first and second axis arrangement lines, the transfer speed of the disks can be increased. That is, the moving speed of the disk pushers making a rotational movement is formed of a speed component along a transferring direction and a speed component at a right angle with respect to the transferring direction, and these speed components are changed according to the rotation angle of the disk pushers. As the speed component along the transferring direction is larger, the transfer speed of the disks is faster. When the second to n-th disk pushers are arranged in two lines, the range of rotation angles with relatively large speed components along the transferring direction can be easily used from out of a range of rotation angles of the disk pushers, and therefore the transfer speed of the disks can be increased.

(30) In another preferred example of the disk dispensing device according to the fifth aspect of the present disclosure, in the disk dispensing device according to (28) described above, the fourth guide surface has a first guide surface portion orthogonal to the first rotational axis line and a second guide surface portion orthogonal to the second rotational axis line, and the first and second guide surface portions are connected to each other via a first curved surface portion. In this case, since the disks are guided along the first curved surface portion, the traveling angle of the disks can be more smoothly changed.

(31) In still another preferred example of the disk dispensing device according to the fifth aspect of the present disclosure, in the disk dispensing device according to (30) described above, the third guide surface has a second curved surface portion facing the first curved surface portion. In this case, since the disks are guided along the first and second curved surface portions, the traveling angle of the disks can be further more smoothly changed.

(32) In still another preferred example of the disk dispensing device according to the fifth aspect of the present disclosure, in the disk dispensing device according to (30) described above, the first and second disk pushers are arranged so that trails of the rotational movements of the first and second disk pushers are formed a predetermined space apart from each other. In this case, since the first curved surface portion can be formed correspondingly with the predetermined space, it is advantageously possible to ensure a region required for the first curved surface portion.

(33) In still another preferred example of the disk dispensing device according to the fifth aspect of the present disclosure, in the disk dispensing device according to (28) described above, the first to n-th disk pushers are configured of at least two or more disk pushers respectively arranged to the first to n-th rotational axis lines. In this case, since the disks are pushed by each of two or more of the disk pushers, the number of disks that can be moved per one rotational movement can be advantageously increased. In other words, efficiency of transferring the disks can be advantageously increased.

(34) In still another preferred example of the disk dispensing device according to the fifth aspect of the present disclosure, in the disk dispensing device according to (28) described above, the first and second guide surfaces are each formed along a curve formed by connecting segments of circles respectively centering on the first to n-th rotational axis line. In this case, the circular trails of the first to n-th disk pushers making a rotational movement and the flat shape of the first and second guide surfaces are coaxial with each other. Therefore, the first to n-th disk pushers can advantageously push the disks smoothly. In other words, the load when the disk pushers are caused to make a rotational movement can be advantageously reduced.

(35) In still another preferred example of the disk dispensing device according to the fifth aspect of the present disclosure, in the disk dispensing device according to (28) described above, first to n-th rotary disks respectively corresponding to the first to n-th rotational axis lines are arranged on the fourth guide surface of the disk guide path, and the first to n-th disk pushers are each provided to a peripheral part of a corresponding one of the first to n-th rotary disks. In this case, the rotational movement of the first to n-th disk pushers can be advantageously achieved with a simple structure.

(36) In still another preferred example of the disk dispensing device according to the fifth aspect of the present disclosure, in the disk dispensing device according to (35) described above, first and second gear wheels are respectively and coaxially arranged on the first and second rotary disks, the first and second gear wheels each rotate integrally with a corresponding one of the first and second rotary disks, and the first and second gear wheels engage with each other. In this case, the first and second rotary disks rotate in synchronization with directions opposite to each other. In other words, the rotating directions of the first and second disk pushers are automatically reversed and, furthermore, the first and second disk pushers make a rotational movement in synchronization with each other. Therefore, it is advantageously possible to easily achieve the function of reversing the rotating directions of the first and second disk pushers and providing an appropriate phase difference to a rotational movement with a simple structure.

(37) In still another preferred example of the disk dispensing device according to the fifth aspect of the present disclosure, in the disk dispensing device according to (36) described above, the first and second gear wheels each include a bevel gear portion having a cone angle corresponding to the predetermined angle. In this case, though a simple structure in which the first and second gear wheels engage with each other, with the predetermined angle being formed by the first and second rotational axis lines, the first and second disk pushers can be advantageously caused to make a rotational movement.

(38) In still another preferred example of the disk dispensing device according to the fifth aspect of the present disclosure, in the disk dispensing device according to (36) described above, the first gear wheel includes a spur gear portion, and a driving force is transmitted from driver to the first gear wheel via the spur gear portion. In this case, it is advantageously possible to use one or more drivers of the disk delivering device with a relatively simple structure and omit drivers dedicated to the disk transferring device. Furthermore, since the disk delivering device and the disk transferring device are driven by one driver, the disk delivering device and the disk transferring device can also be advantageously driven easily in synchronization with each other.

(39) In still another preferred example of the disk dispensing device according to the fifth aspect of the present disclosure, in the disk dispensing device according to (36) described above, a driving force is transmitted from driver to the first gear wheel, and a torque limiter is arranged in a driving-force transmitting route between the driver and the first gear wheel. In this case, in the disk transferring device, even if biting of the disk occurs, the driving force transmitted from the driver to the first gear wheel is interrupted by the torque limiter. Therefore, an excessive load is not put on an associated component, such as the first to n-th disk pushers, thereby advantageously preventing component damage and improving durability. Furthermore, since an excessive load is not exerted, component strength to be required can be small, thereby advantageously decreasing component size and, in turn, decreasing the size of the entire device.

(40) In still another preferred example of the disk dispensing device according to the fifth aspect of the present disclosure, in the disk dispensing device according to (35) described above, third gear wheels are respectively and coaxially arranged on the second to n-th rotary disks, the third gear wheels rotate integrally with a corresponding one of the second to n-th rotary disks, and adjacent ones of the third gear wheels engage with each other. In this case, paired adjacent rotary disks in the second to n-th rotary disks rotate in directions in reverse to each other, and all of the second to n-th rotary disks rotate in synchronization with each other. In other words, the disk pushers corresponding to the paired adjacent rotational axis lines in the second to n-th disk pushers make a rotational movement in directions in reverse to each other and, furthermore, all of these disk pushers make a rotational movement in synchronization with each other. Therefore, it is advantageously possible to easily achieve the function of reversing the rotating directions and providing an appropriate phase difference to a rotational movement with a simple structure.

(41) In still another preferred example of the disk dispensing device according to the fifth aspect of the present disclosure, in the disk dispensing device according to (28) described above, a rotation monitoring sensor is provided detecting the presence or absence of any of the rotational movements of the first to n-th disk pushers and, when detecting a stop of any of the rotational movements of the first to n-th disk pushers, the rotation monitoring sensor outputs a signal indicating the stop of the rotational movement. In this case, when biting of the disk occurs in the disk transferring device and the rotational movement of the first to n-th disk pushers is stopped, delivery of the disks can be advantageously stopped based on a signal indicating a stop of the rotational movement. In other words, it is advantageously possible to avoid unnecessary load from occurring in the disk transferring device and improve durability.

(42) In still another preferred example of the disk dispensing device according to the fifth aspect of the present disclosure, in the disk dispensing device according to (28) described above, the device includes a plurality of disk transferring units each having a disk guide path portion formed by dividing the disk guide path in an extending direction and an end face provided correspondingly to an disk reception opening or an disk ejection opening of the disk guide path portion, the end faces being able to abut on each other, and having arranged therein a rotational axis line among the first to n-th rotational axis lines corresponding to the disk guide path portion, and the plurality of disk transferring units are connected to each other with the end faces abutting on each other. In this case, by appropriately setting the number of disk transferring units to be connected, the transfer distance in the disk transferring device can be advantageously changed easily. Also, the coin transferring units of a plurality of types with different rotational axis lines to be disposed are prepared in advance, and by combining these as appropriate, any transfer distance can be obtained stepwise. That is, by appropriately setting the type and number of coin transferring units to be connected, the transfer distance can be easily changed.

(43) In still another preferred example of the disk dispensing device according to the fifth aspect of the present disclosure, in the disk dispensing device according to (32) described above, a first disk ejection opening disk transferring unit and a second disk ejection opening disk transferring unit are prepared, the first disk ejection opening disk transferring unit having the n-th rotational axis line arranged therein and the disk ejection opening provided on a left side of the disk guide path, and the second disk ejection opening disk transferring unit having the n-th rotational axis line arranged therein and the disk ejection opening provided on a right side of the disk guide path. In this case, by selectively using either one of the first and second disk ejection opening disk transferring units, left and right dispensing can be both advantageously supported easily without changing the structure of other disk transferring units.

(44) In still another preferred example of the disk dispensing device according to the fifth aspect of the present disclosure, in the disk dispensing device according to (28) described above, the device has disk discharger and a disk dispensing detection sensor, the disk discharger ejecting the disks in the disk guide path toward the disk ejection opening and the disk dispensing detection sensor detecting the disks ejected by the disk discharger. In this case, the disks are discharged from the disk ejection opening by the disk discharger, and the number of disks to be discharged from the disk ejection opening (that is, dispensed from the disk ejection opening) is counted by the disk dispensing detection sensor. Furthermore, by setting the force of ejecting the disks by the disk discharger constant, the disks are ejected at a predetermined speed, and therefore the disk dispensing detection sensor can reliably and easily detect the disks. In other words, the number of disks dispensed from the disk ejection opening can be advantageously counted in a stable manner.

In the disk transferring device according to the first aspect of the present invention, the following effects can be obtained: (a) the device can be configured without any of a belt, a chain, and a screw, (b) the transfer distance can be easily extended, (c) the transfer distance can be extended while cost is suppressed, (d) the transfer distance can be extended without increasing weight and size, and (e) a desired transfer speed can be easily obtained, and (f) durability is excellent.

In the disk transferring device according to any of the second to fourth aspects of the present invention, the following effects can be obtained: (a) a coin can be transferred as its traveling angle is changed, (b) even coins of a plurality of types with different outer diameters or thicknesses can be transferred as their traveling angle is changed, (c) the range of outer diameters and thicknesses of transferrable coins is wide, (d) all delivered coins can be discharged without any coin being left, and (e) collection of a left coin is not required, thereby increasing process efficiency.

In the disk transferring device according to the fifth aspect of the present invention, the following effects can be obtained: (a) it is possible to separate stored coins of a plurality of types with different outer diameters or thicknesses one by one and then transfer the coins to a predetermined position and discharge them, (b) the range of outer diameters or thicknesses of dispensable coins is wide, (c) all coins thrown into a disk delivering device can be discharged without any coin being left, and (d) collection of a left disk is not required, thereby increasing process efficiency.

DETAILED DESCRIPTION

Embodiments of the present invention are described below based on the attached drawings.

First Embodiment

Figure 1:
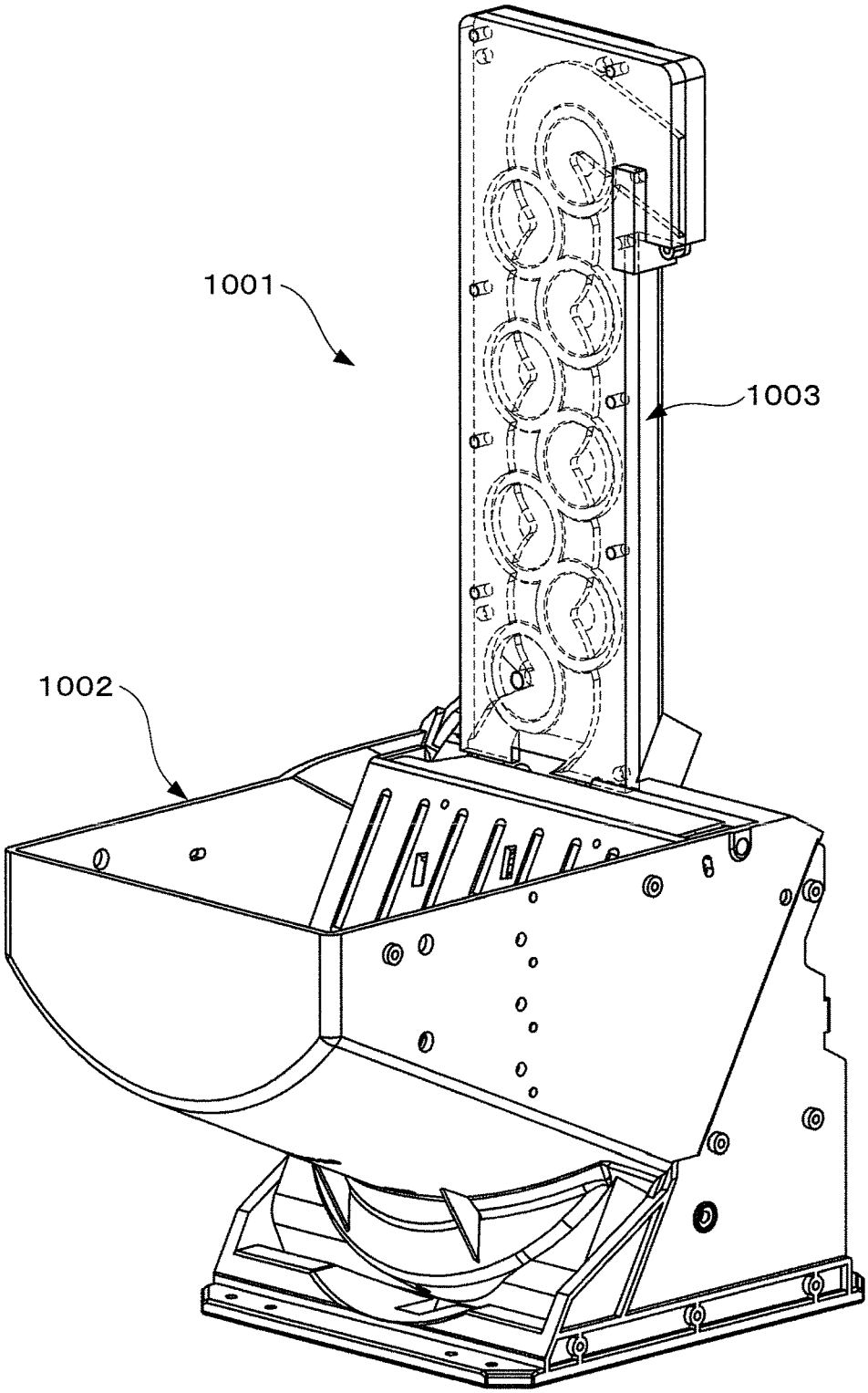
FIG. 1 is a perspective view of a disk dispensing device to which a disk transferring device of a first embodiment of the present invention is applied.

FIG. 1 shows a disk dispensing device 1001 to which a disk transferring device of a first embodiment of the present invention is applied. The disk dispensing device 1001 has a function of dispensing disks in bulk one by one from an disk ejection opening, and broadly includes a disk delivering device (which is also referred to as a hopper device) 1002 and a disk transferring device 1003.

As the disk delivering device 1002, any known device can used. For example, the disk delivering device disclosed in Japanese Unexamined Patent Application Publication No. 2001-216553 filed by the Applicant on Feb. 2, 2000 and published can be used.

As shown in FIGS. 2 to 7, the disk transferring device 1003 includes a disk guide part 1100 having a disk guide path 1110 extending from an disk reception opening 1102 toward an disk ejection opening 1104, a disk pushing mechanism 1400 having first to eighth rotary disks 1401 to 1408 provided with first disk pushers 1411*a* to 1418*a* and second disk pushers 1411*b* to 1418*b*, respectively, and a rotational driving device 1500 for rotationally driving the disk pushing mechanism 1400.

(Disk Guide Part)

Figure 2:
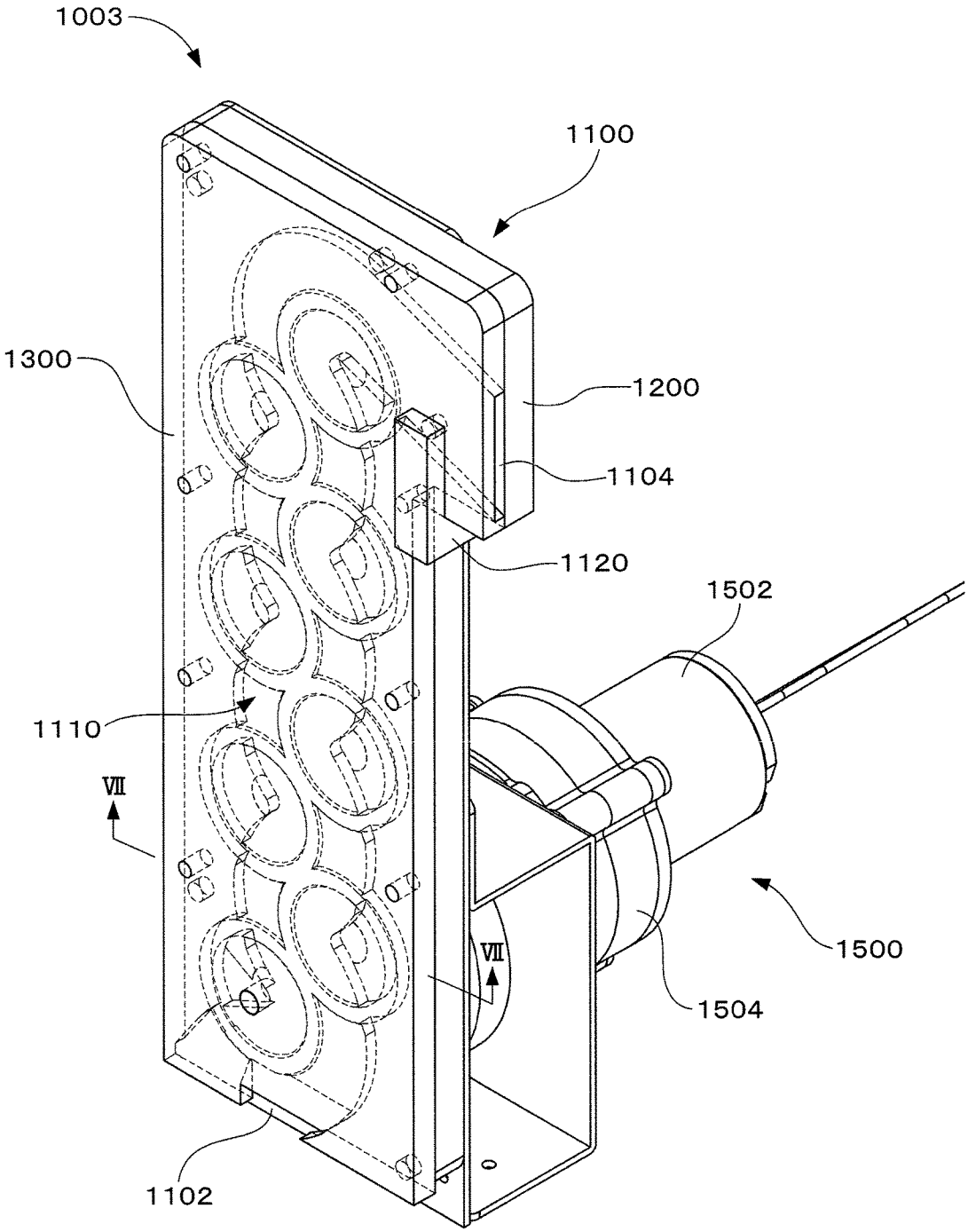
FIG. 2 is a perspective view of main parts of the disk transferring device of the first embodiment of the present invention.
Figure 3:
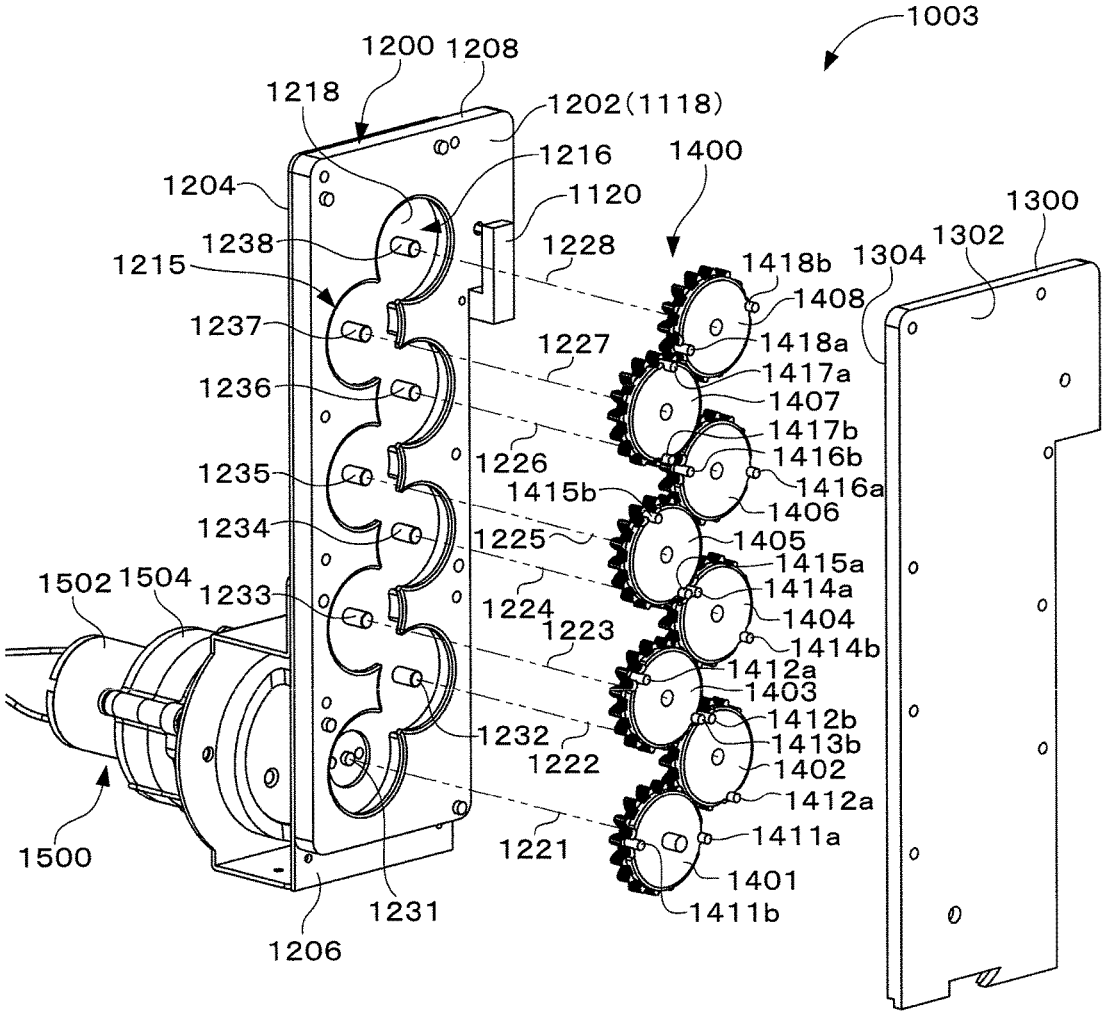
FIG. 3 is an exploded perspective view of main parts of the disk transferring device of FIG. 2 viewed from a front side.

As shown in FIGS. 2 and 3, a disk guide part 1100 is configured of a base part 1200 and a top plate 1300 provided on the base part 1200.

The base part 1200 is formed of a structure in which a flat-shaped first member 1206 has a second member 1208 placed thereon, and a through hole 1215 is formed in the second member 1208. The through hole 1215 has a flat shape with eight circular apertures connected in a zigzag manner, and has a recessed part 1216 that can accommodate the disk pushing mechanism 1400 on a front surface 1202 side of the base part 1200.

Figure 4:
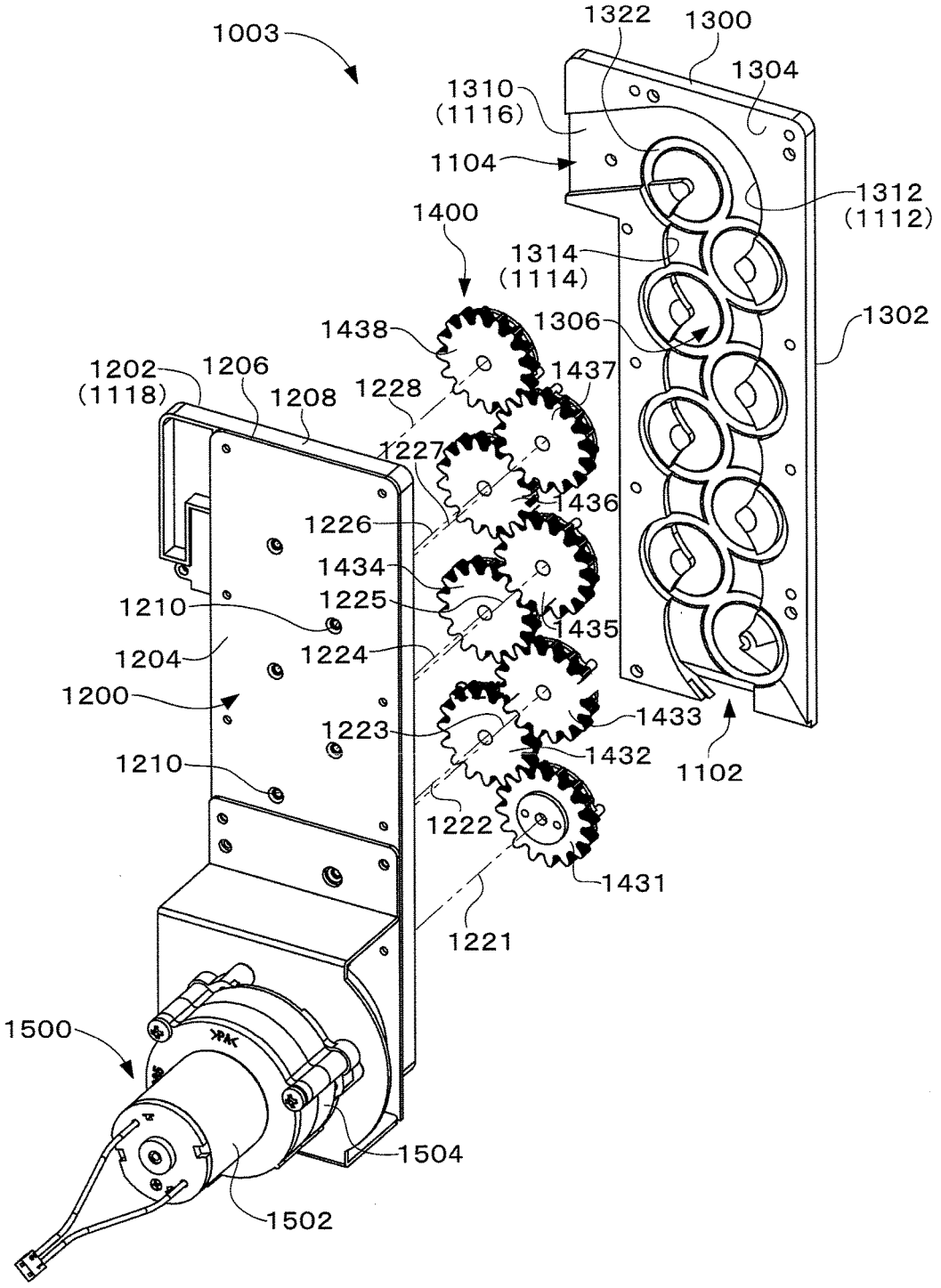
FIG. 4 is an exploded perspective view of main parts of the disk transferring device of FIG. 2 viewed from a back side.
Figure 7:
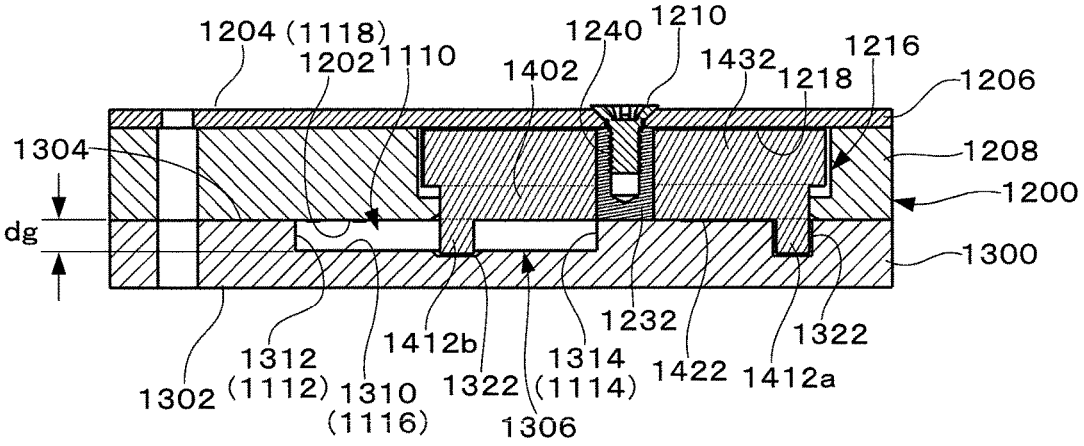
FIG. 7 is a sectional view along a VII-VIII line of FIG. 2.

On a bottom surface 1218 of the recessed part 1216, first to eighth rotating shafts 1231 to 1238 are provided having first to eighth rotational axis lines 1221 to 1228 approximately at a right angle with respect to the front surface of the base part 1200. As shown in FIGS. 4 and 7, the first to eighth rotating shafts 1231 to 1238 are fixed to fixing screws 1210 inserted in screw holes 1240 from the back surface 1204 side of the base part 1200 via the first member 1206.

Figure 5:
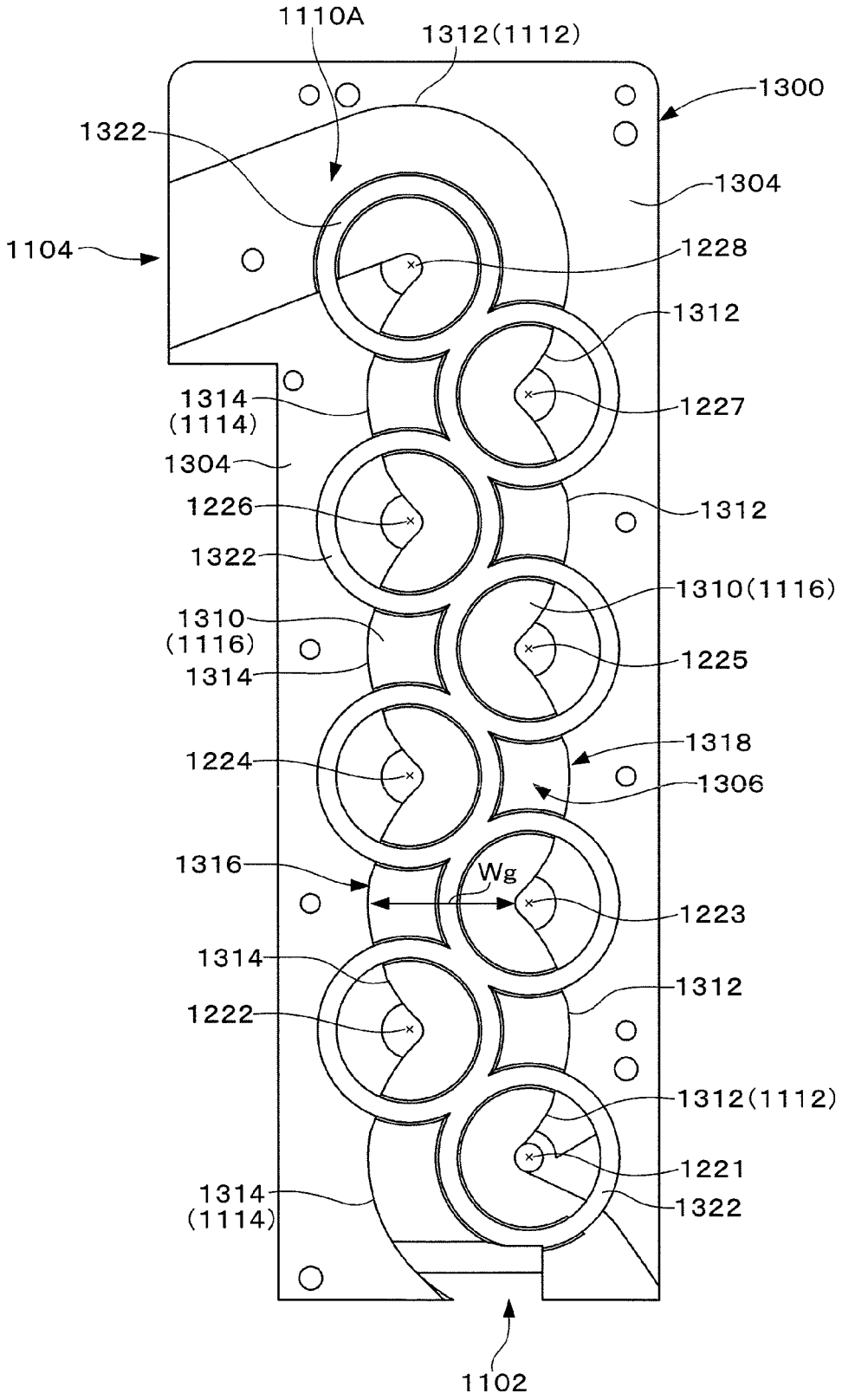
FIG. 5 is a plan view of a top plate configuring the disk transferring device of FIG. 2 viewed from a back side.

As shown in FIGS. 4, 5, and 7, the top plate 1300 has a front surface 1302 and a back surface 1304 parallel to each other, and is fixed to the base part 1200 with the back surface 1304 being placed on the front surface 1202 of the base part 1200. The front surface 1302 and the back surface 1304 of the top plate 1300 is approximately at a right angle with respect to the first to eighth rotational axis lines 1221 to 1228.

On the back surface 1304 side of the top plate 1300, a disk guide groove 1306 extending from the disk reception opening 1102 to the disk ejection opening 1104 is formed. The disk guide groove 1306 has a bottom surface 1310 and first and second side surfaces 1312 and 1314, and the bottom surface 1310 is approximately at a right angle with respect to the first to eighth rotational axis lines 1221 to 1228.

The disk guide groove 1306 has a width wg and a depth dg that are set so as to be slightly larger than the width and depth of a disk to be transferred. In other words, the width wg and the depth dg of the disk guide groove 1306 are set so that the disk to be transferred can pass through the inside the disk guide groove 1306 as being guided with the bottom surface 1310 and the first and second side surfaces 1312 and 1314. Note that when a plurality of denominations of disks with different diameters and thickness are transferred, the width wg and the depth dg of the disk guide groove 1306 are set according to a maximum diameter and a maximum thickness of the disks.

The first side surface 1312 is formed along a curve 1318 with a plurality of segments of circles centering on the second, fourth, sixth, and eighth rotational axis lines 1222, 1224, 1226, and 1228 connected together. The second side surface 1314 is formed along a curve 1316 with a plurality of segments of circles centering on the first, third, fifth, and seventh rotational axis lines 1221, 1223, 1225, and 1227 connected together.

Furthermore, on the back surface 1304 of the top plate 1300, an annular groove 1322 preventing a contact of first disk pushers 1411*a* to 1418*a* and second disk pushers 1411*b* to 1418*b*, which will be described further below, with the top plate 1300 when these disk pushers make a rotational movement is provided, correspondingly to the respective first to eighth rotational axis lines 1221 to 1228.

The disk guide path 1110 is configured of the front surface 1202 of the base part 1200, the bottom surface 1310 of the disk guide groove 1306 of the top plate 1300, and the first and second side surfaces 1312 and 1314. In other words, the front surface 1202 of the base unit 1200 functions as a back guide surface 1118 of the disk guide path 1110, the bottom surface 1310 of the disk guide groove 1306 of the top plate 1300 functions as a front guide surface 1116 of the disk guide path 1110, and the first and second side surfaces 1312 and 1314 of the disk guide groove 1306 of the top plate 1300 function as left and right guide surfaces 1112 and 1114 of the disk guide path 1110. In the disk guide path 1110, the peripheral surface of a disk introduced from the disk reception opening 1102 is guided with the left and right guide surfaces 1112 and 1114 of the disk guide path 1110 (that is, the first and second side surfaces 1312 and 1314 of the disk guide groove 1306). Also, on an front surface and a back surface of a disk are guided with the front and back guide surfaces 1116 and 1118 of the disk guide path 1110 (that is, the bottom surface 1310 of the disk guide groove 1306 and the front surface 1202 of the base part 1200).

(Disk Pushing Mechanism)

As shown in FIGS. 3, 4, 6, and 7, the disk pushing mechanism 1400 has the first to eighth rotary disks 1401 to 1408 having the first to eighth rotating shafts 1231 to 1238, respectively, inserted therein. The first to eighth rotary disks 1401 to 1408 each have an approximately circular outer shape in a planar view, and are each rotatably supported in the corresponding first to eighth rotating shafts 1231 to 1238 in both forward and reverse directions. In other words, the first to eighth rotary disks 1401 to 1408 can rotate about the corresponding first to eighth rotational axis lines 1221 to 1228, respectively.

The first to eighth rotary disks 1401 to 1408 are provided with the first disk pushers 1411*a* to 1418*a* and the second disk pushers 1411*b* to 1418*b*, respectively, as a pair, each disk pusher having a columnar outer shape. That is, in a peripheral part 1424 of the first rotary disk 1401, the first and second disk pushers 1411*a* and 1411*b* protruding from the front surface 1422 of the rotary disk 1401 are provided. The first and second disk pushers 1411*a* and 1411*b* are arranged so as to interpose the first rotating shaft 1231. In other words, the first and second disk pushers 1411*a* and 1411*b* are arranged on a straight line passing through the first rotational axis line 1221 on the first rotary disk 1401.

Also for the second to eighth rotary disks 1402 to 1408, as with the first rotary disk 1401, in the peripheral parts 1424 of the second to eighth rotary disks 1402 to 1408, the first and second disk pushers 1412*a* and 1418*a* and 1412*a* to 1418*b* protruding from the front surfaces 1422 of the second to eighth rotary disks 1402 to 1408, respectively, are provided. The first and second disk pushers 1412*a* to 1418*a* and 1412*b* to 1418*b* are arranged so as to interpose the rotating shafts 1232 to 1238, respectively. In other words, the first and second disk pushers 1412*a* to 1418*a* and 1412*b* to 1418*b* are arranged on straight lines passing through the second to eighth rotational axis lines 1222 to 1228 on the second to eighth rotary disks 1402 to 1408, respectively.

When the first to eighth rotary disks 1401 to 1408 are rotated, the first and second pushers 1411*a* to 1418*a* and 1411*b* to 1418*b* make a rotational movement about the first to eighth rotational axis lines 1221 to 1228, respectively.

Figure 6:
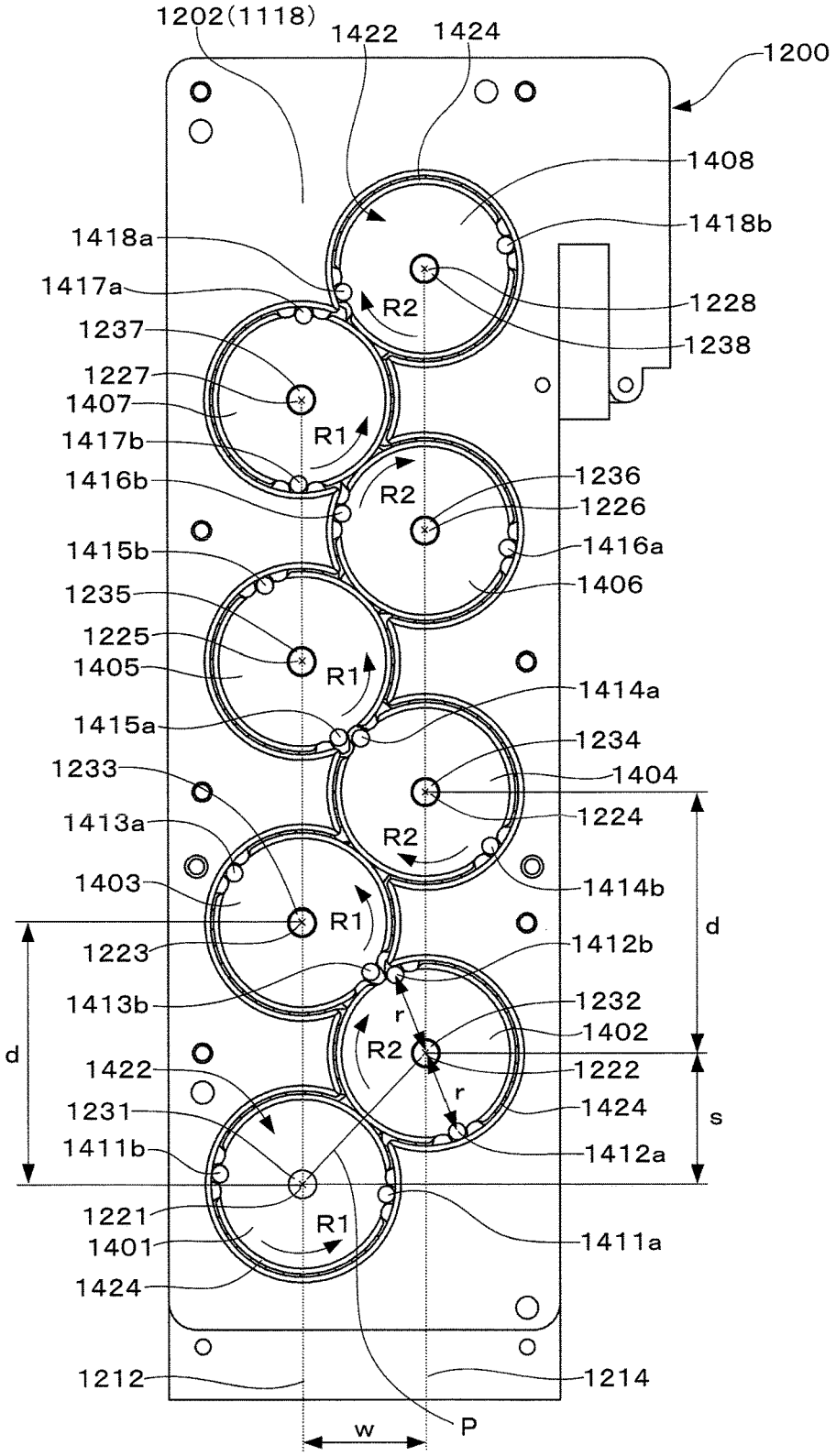
FIG. 6 is a plan view of a base part configuring the disk transferring device of FIG. 2.

Note that, as shown in FIG. 6, when a distance from a center axis of each of the first and second pushers 1411*a* to 1418*a* and 1411*b* to 1418*b* (a center axis of a cylinder) to a corresponding one of the first to eighth rotational axis lines 1221 to 1228 (that is, a radius of rotational movement of the first and second pushers 1411*a* to 1418*a* and 1411*b* to 1418*b*) is assumed to be r, a relation between the width of the disk guide groove 1306 (that is, the width of the disk guide path 1110) wg and the radius r is preferably established as represented by $$r<wg\leq 2r.$$

That is, the reason for this is such that it is difficult to form an effective disk guide path 1110 when r≥wg and it is difficult to smoothly transfer the disks when wg>2r. In particular, when the disk transferring device 1003 is caused to function as a lifter, it is required to resist not only against a friction force occurring between the disk and the disk guide path 1110 but also against gravity. For this purpose, wg≤2r is effective. Therefore, by setting the radius r and the width wg so that the above relation is established, the disks can be easily and smoothly transferred.

As shown in FIG. 6, the first, third, fifth, and seventh rotational axis lines 1221, 1223, 1225, and 1227 are arranged in a line a predetermined space d apart from each other on a first axis arrangement line 1212. The second, fourth, sixth, and eighth rotational axis lines 1222, 1224, 1226, and 1228 are arranged in a line the predetermined space d apart from each other on a second axis arrangement line 1214 parallel to and positioned a predetermined space w apart from the first axis arrangement line 1212. The second, fourth, sixth, and eighth rotational axis lines 1222, 1224, 1226, and 1228 have an offset by a predetermined distance s from the first, third, fifth, and seventh rotational axis lines 1221, 1223, 1225, and 1227. In other words, the first to eighth rotational axis lines 1221 to 1228 are arranged in a zigzag manner (that is, in a staggered manner) along a direction in which the disk guide path 1110 extends.

The first and second disk pushers 1411*a*, 1413*a*, 1415*a*, 1417*a*, 1411*b*, 1413*b*, 1415*b*, and 1417*b* corresponding to the first, third, fifth, and seventh rotational axis lines 1221, 1223, 1225, and 1227 configure a first pusher group. The first and second disk pushers 1412*a*, 1414*a*, 1416*a*, 1418*a*, 1412*b*, 1414*b*, 1416*b*, and 1418*b* corresponding to the second, fourth, sixth, and eighth rotational axis lines 1222, 1224, 1226, and 1228 configure a second pusher group.

The first, third, fifth, and seventh rotary disks 1401, 1403, 1405, and 1407 corresponding to the first, third, fifth, and seventh rotational axis lines 1221, 1223, 1225, and 1227 configure a first rotary disk group. The second, fourth, sixth, and eighth rotary disks 1402, 1404, 1406, and 1408 corresponding to the second, fourth, sixth, and eighth rotational axis lines 1222, 1224, 1226, and 1228 configure a second rotary disk group.

On the back surfaces of the first to eighth rotary disks 1401 to 1408, first to eighth gear wheels 1431 to 1438 are provided, respectively. In shaft insertion holes (not shown) of the first to eighth gear wheels 1431 to 1438 the first to eighth rotating shafts 1231 to 1243 are inserted, respectively. The first to eighth gear wheels 1431 to 1438 are fixed to the first to eighth rotary disks 1401 to 1408, respectively, and the first to eighth gear wheels 1431 to 1438 rotate together with the corresponding first to eighth rotary disks 1401 to 1408, respectively.

In this embodiment, to reduce fabrication cost of the disk pushing mechanism 1400, for the first to eighth rotary disks 1401 to 1408, the corresponding first to eighth gear wheels 1431 to 1438 and the corresponding first and second disk pushers 1411*a* to 1418*a* and 1411*b* to 1418*b* are integrally formed. However, the first to eighth rotary disks 1401 to 1408, the first to eighth gear wheels 1431 to 1438, and the first and second disk pushers 1411*a* to 1418*a* and 1411*b* to 1418*b* can be separately fabricated, they can be assembled with an appropriate method for use.

Adjacent ones of the first to eighth gear wheels 1431 to 1438 engage with each other. That is, the second gear wheel 1432 engages with the first and third gear wheels 1431 and 1433. Similarly, the fourth gear wheel 1434 engages with the third and fifth gear wheels 1433 and 1435, and the sixth gear wheel 1436 engages with the fifth and seventh gear wheels 1435 and 1437. The eighth gear wheel 1438 engages with the seventh gear wheel 1437. Therefore, the first, third, fifth, and seventh rotary disks 1401, 1403, 1405, and 1407 belonging to the first rotary disk group and the second, fourth, sixth, and eighth rotary disks 1402, 1404, 1406, and 1408 belonging to the second rotary disk group rotate in directions in reverse to each other, as indicated by arrows R1 and R2 in FIG. 6. In other words, the first and second disk pushers 1411*a*, 1411*b*, 1413*a*, 1413*b*, 1415*a*, 1415*b*, 1417*a*, and 1417*b* belonging to the first pusher group and the first and second disk pushers 1412*a*, 1412*b*, 1414*a*, 1414*b*, 1416*a*, 1416*b*, 1418*a*, and 1418*b* belonging to the second pusher group make a rotational movement in the directions R1 and R2 in reverse to each other.

In adjacent paired ones among the first to eighth rotary disks 1401 to 1408, the first and second disk pushers 1411*a* to 1418*a* and 1411*b* to 1418*b* are arranged so as to keep a predetermined rotational phase difference.

For example, in the adjacent first and second rotary disks 1401 and 1402, the first disk pushers 1411*a* and 1412*a* and the second disk pushers 1411*b* and 1412*b* are arranged so as to keep a predetermined rotational phase difference. Specifically, the first pushers 1411*a* and 1412*a* are arranged so that, when the first disk pusher 1411*a* making a rotational movement reaches a plane P including the first and second rotational axis lines 1221 and 1222, the first disk pusher 1412*a* making a rotational movement reaches a position ½ of a gear wheel pitch back from the plane P. Similarly, the second pushers 1411*b* and 1412*b* are arranged so that, when the second disk pusher 1411*b* making a rotational movement reaches the plane P including the first and second rotational axis lines 1221 and 1222, the second disk pusher 1412*b* making a rotational movement reaches a position ½ of the gear wheel pitch back from the plane P.

The same goes for the second and third rotary disks 1402 and 1403, the third and fourth rotary disks 1403 and 1404, the fourth and fifth rotary disks 1404 and 1405, the fifth and sixth rotary disks 1405 and 1406, and the sixth and seventh rotary disks 1406 and 1407, and the seventh and eighth rotary disks 1407 and 1408.

The disk pushing mechanism 1400 having the above-described structure is accommodated in the recessed part 1216 of the base part 1200. That is, the first to eighth rotary disks 1401 to 1408 and the first to eighth gear wheels 1431 to 1438 are accommodated in the recessed part 1216. The first to eighth rotary disks 1401 to 1408 are arranged so as to each have a surface 1422 approximately flush with the front surface 1202 of the base part 1200. Therefore, the first and second disk pushers 1411*a* to 1418*a*, 1411*b* to 1418*b* provided on the front surfaces 1422 of the first to eighth rotary disks 1401 to 1408, respectively protrude upward from the front surface 1202 of the base part 1200. In other words, the first and second disk pushers 1411*a* to 1418*a*, 1411*b* to 1418*b* each protrude into the disk guide path 1110.

Therefore, when the first and second disk pushers 1411*a* to 1418*a*, 1411*b* to 1418*b* make a rotational movement, the first and second disk pushers 1411*a* to 1418*a* and 1411*b* to 1418*b* move along a rotational direction in the disk guide path 1110 as they make contact with the peripheral surface of each disk, thereby pushing each disk for movement.

Note that, as described above, since the first to eighth rotary disks 1401 to 1408 are arranged so as to each have the front surface 1422 approximately flush with the front surface 1202 of the base unit 1200, the front surface 1422 guides each disk in cooperation with the back guide surface 1118 of the disk guide path 1110, thereby allowing the disks to be smoothly transferred.

(Rotational Driving Device)

The rotational driving device 1500 has an electric motor 1502 and a decelerating mechanism 1504 having connected thereto a driving shaft (not shown) of the electric motor 1502. An output shaft (not shown) of the decelerating mechanism 1504 is connected to the first rotating shaft 1231. The first rotary disk 1401 and the first gear wheel 1431 are connected to the output shaft of the decelerating mechanism 1504 via the first rotating shaft 1231.

For the first gear wheel 1431 to be caused to function as a driving gear wheel, the first rotary disk 1401 and the first gear wheel 1431 are fixed to the first rotating shaft 1231. Therefore, when the electric motor 1502 is activated, the rotation of the driving shaft of the electric motor 152 is transmitted via the decelerating mechanism 1504 to the first rotating shaft 1231, thereby rotating the first rotary disk 1401 and the first gear wheel 1431. Since adjacent ones of the first to eighth gear wheels 1431 to 1438 engage with each other, the rotation of the first gear wheel 1431 is transmitted to the second to eighth gear wheels 1432 to 1438 sequentially. That is, the second to eighth gear wheels 1432 to 1438 function as driven gear wheels. As such, the disk pushing mechanism 1400 is driven, thereby causing the first to eighth rotary disks 1401 to 1408 to rotate and causing the first and second disk pushers 1411*a* to 1418*a* and 1411*b* to 1418*b* to make a rotational movement.

(Operation of Disk Transferring Device)

Figure 8:
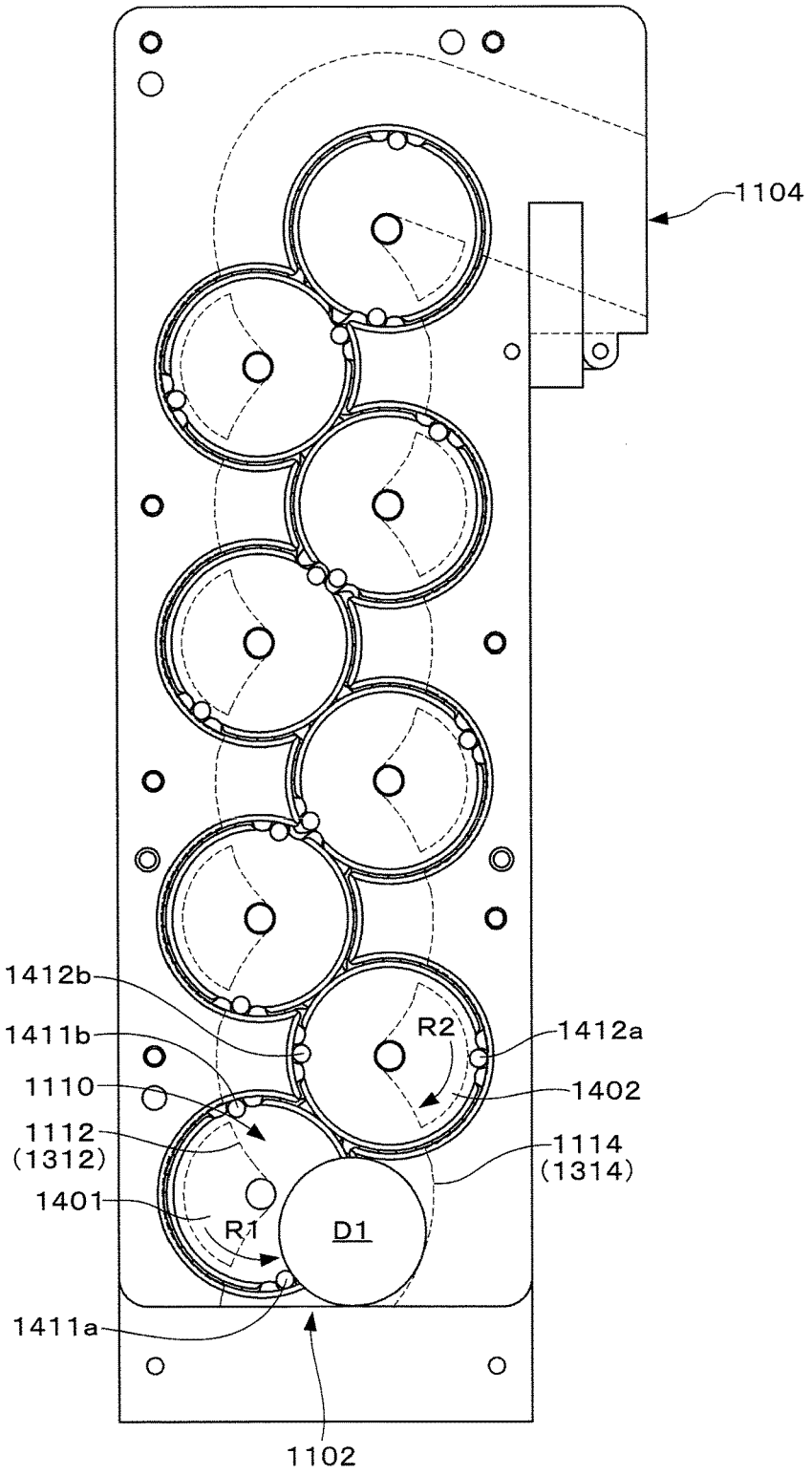
FIG. 8 is a plan view for describing the operation of the disk transferring device of FIG. 2 with the top plate removed.

FIG. 8 shows the state in which, with the electric motor 1502 being activated to drive the disk pushing mechanism 1400, a disk D1 is introduced from the disk reception opening 1102 into the disk guide path 1110. In FIG. 8, the first rotary disk 1401 rotates in a counterclockwise direction (that is, in the R1 direction), and the second rotary disk 1402 rotates in a clockwise direction (that is, in the R2 direction). In accordance with the rotation of the first rotary disk 1401, the first disk pusher 1411*a* makes a rotational movement in the R1 direction to make contact with the peripheral surface of the disk D1. When the first disk pusher 1411*a* further moves in the R1 direction, the disk D1 is pushed by the first disk pusher 1411*a* in an upper right direction of FIG. 8, and the peripheral surface of the disk D1 is pushed onto the right guide surface 1114 of the disk guide path 1110.

Figure 9:
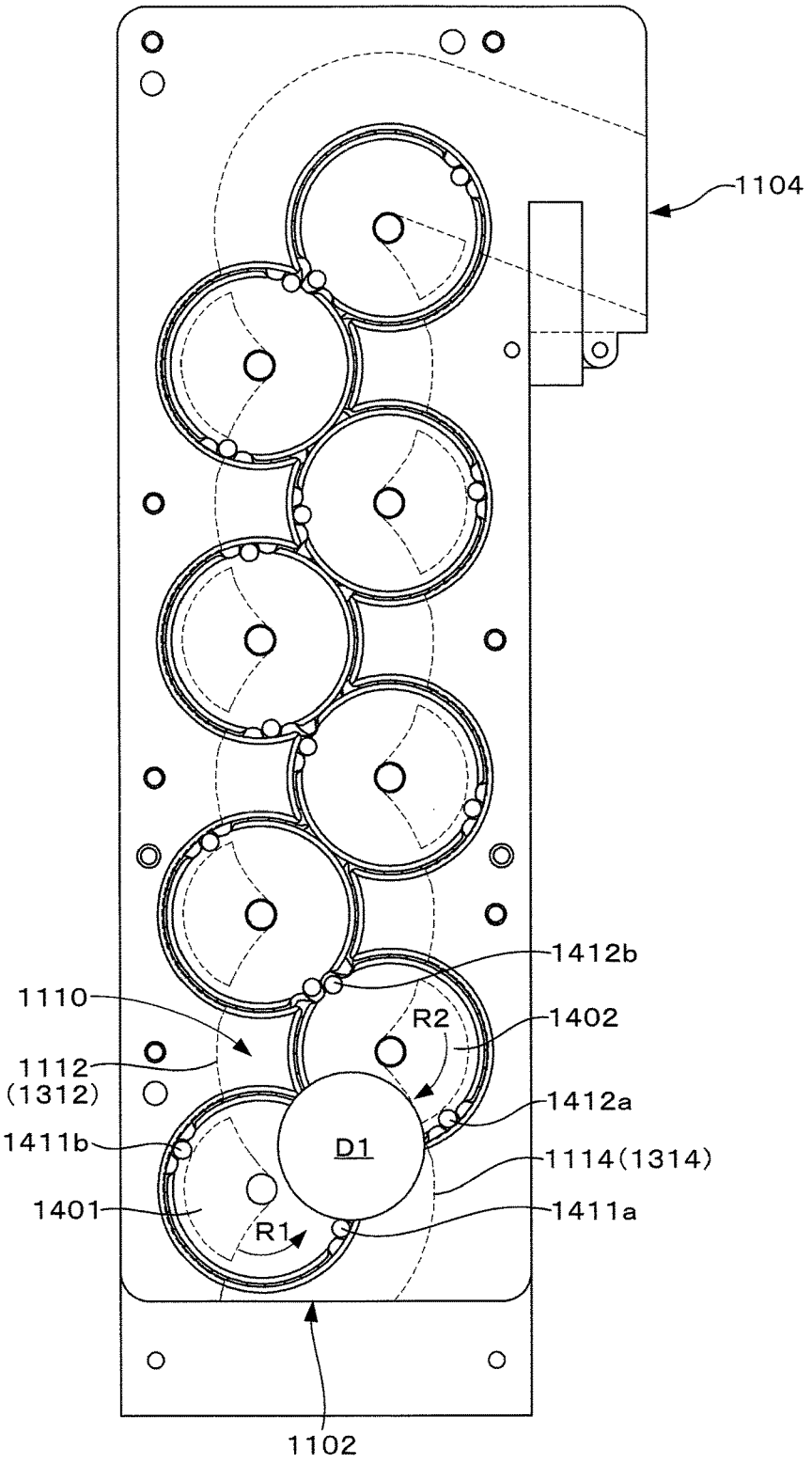
FIG. 9 is a plan view continued from FIG. 8 for describing the operation of the disk transferring device of FIG. 2 with the top plate removed.

Furthermore, when the first disk pusher 1411*a* continues to press the disk D1, as shown in FIG. 9, the disk D1 has the peripheral surface guided with the right guide surface 1114 to be moved to a direction in which the disk guide path 1110 extends (that is, in an upper direction of FIG. 9).

Figure 10:
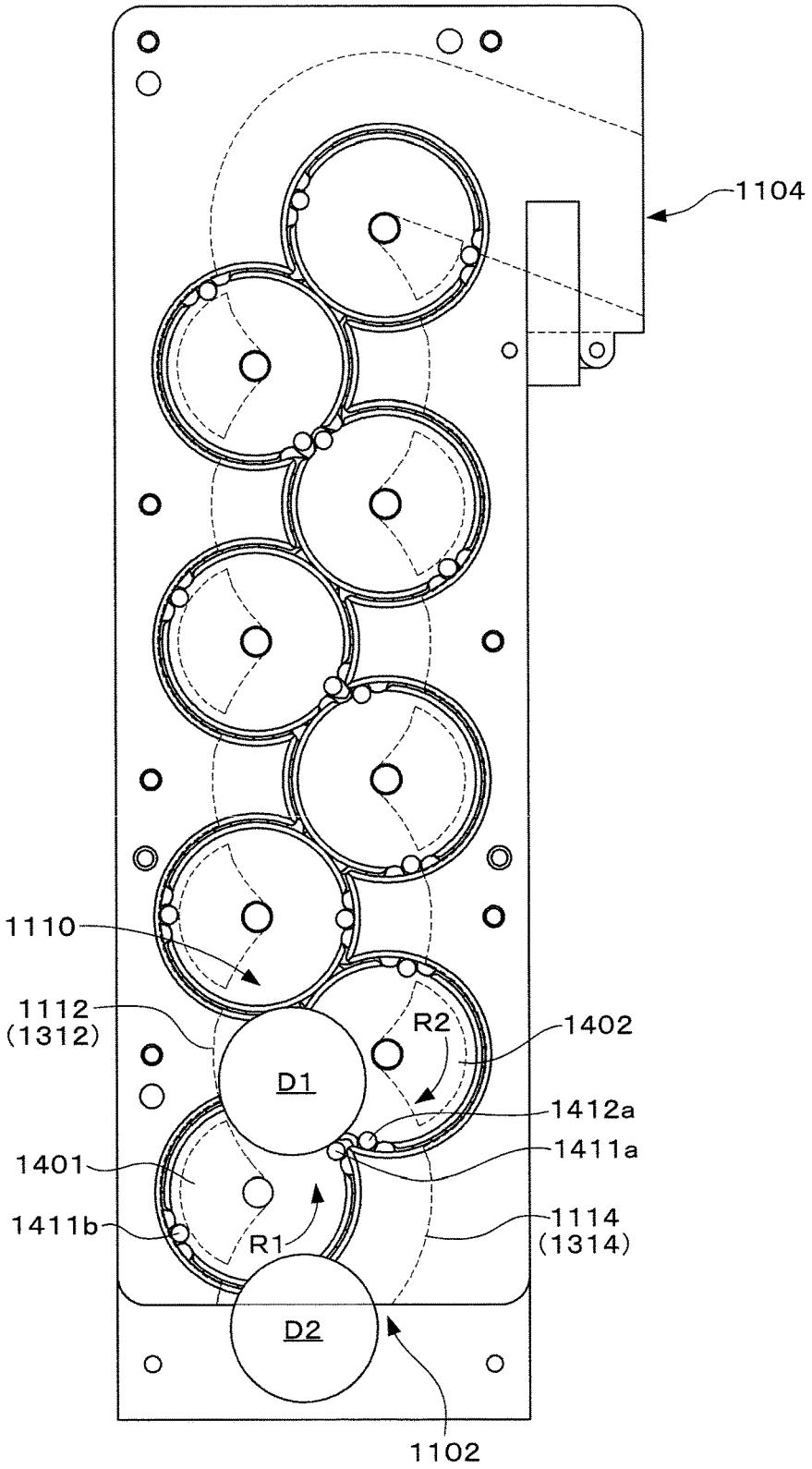
FIG. 10 is a plan view continued from FIG. 9 for describing the operation of the disk transferring device of FIG. 2 with the top plate removed.

When the first disk pusher 1411*a* passes through 3 o'clock position, as shown in FIG. 10, the disk D1 is pushed by the first disk pusher 1411*a* in an upper left direction, and the peripheral surface of the disk D1 is pushed onto the left guide surface 1112 of the disk guide path 1110. Then, the disk D1 has the peripheral surface guided with the left guide surface 1112 to be moved through the disk guide path 1110 in an upper direction. Also, in accordance with the rotation of the second rotary disk 1402 in the R2 direction, the first disk pusher 1412*a* comes close to the disk D1.

Figure 11:
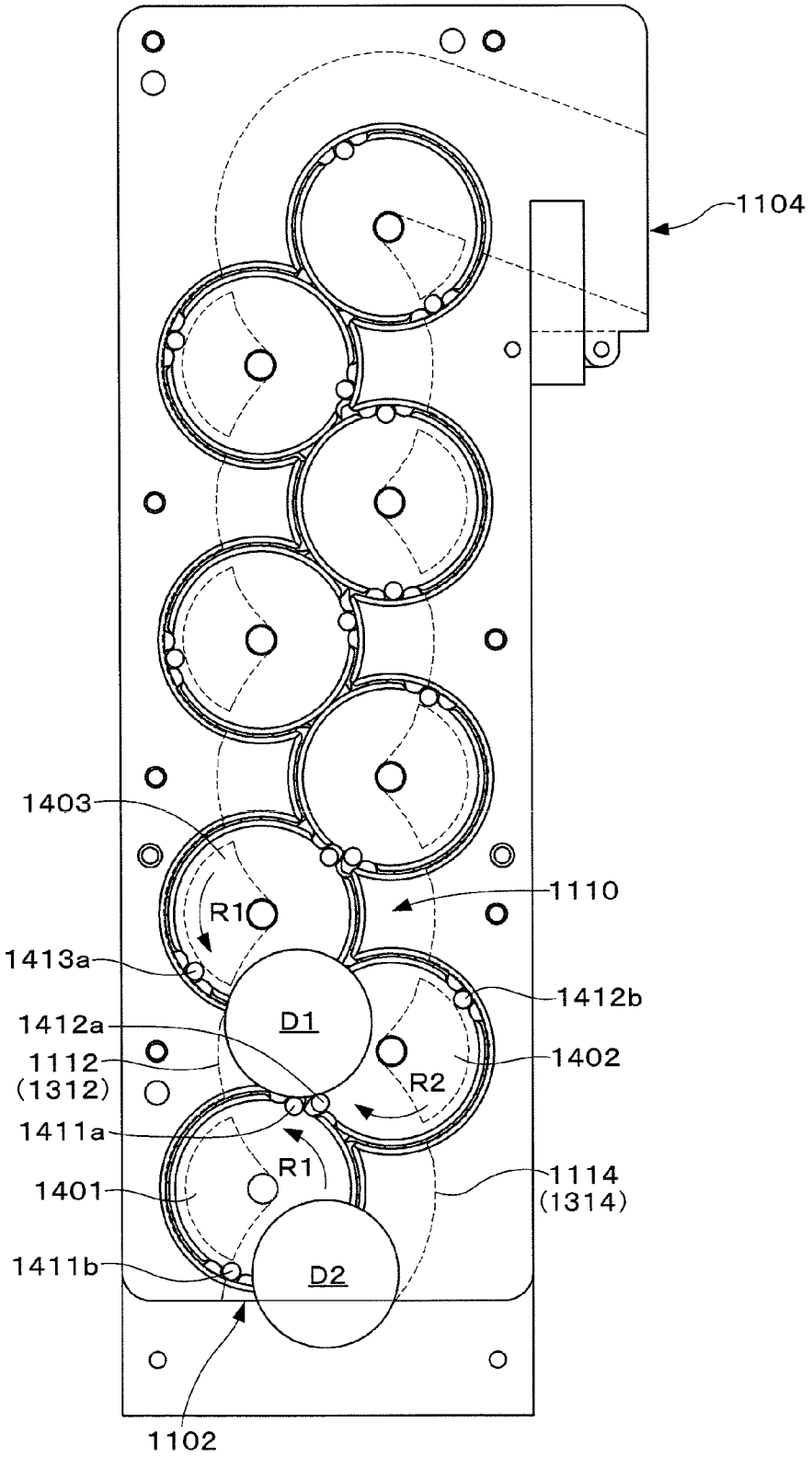
FIG. 11 is a plan view continued from FIG. 10 for describing the operation of the disk transferring device of FIG. 2 with the top plate removed.

Next, as shown in FIG. 11, with the first disk pusher 1411*a* of the first rotary disk 1401 being in contact with the peripheral surface of the disk D1, the first disk pusher 1412*a* of the second rotary disk 1402 further becomes in contact with the peripheral surface of the disk D1. In this state, both of the first disk pushers 1411*a* and 1412*a* push the disk D1 in an upper left direction, the disk D1 has the peripheral surface guided with the left guide surface 1112 to be moved trough the disk guide path 1110 in an upper direction. Also, from the disk reception opening 1102, a next disk D2 is introduced into the disk guide path 1110.

Figure 12:
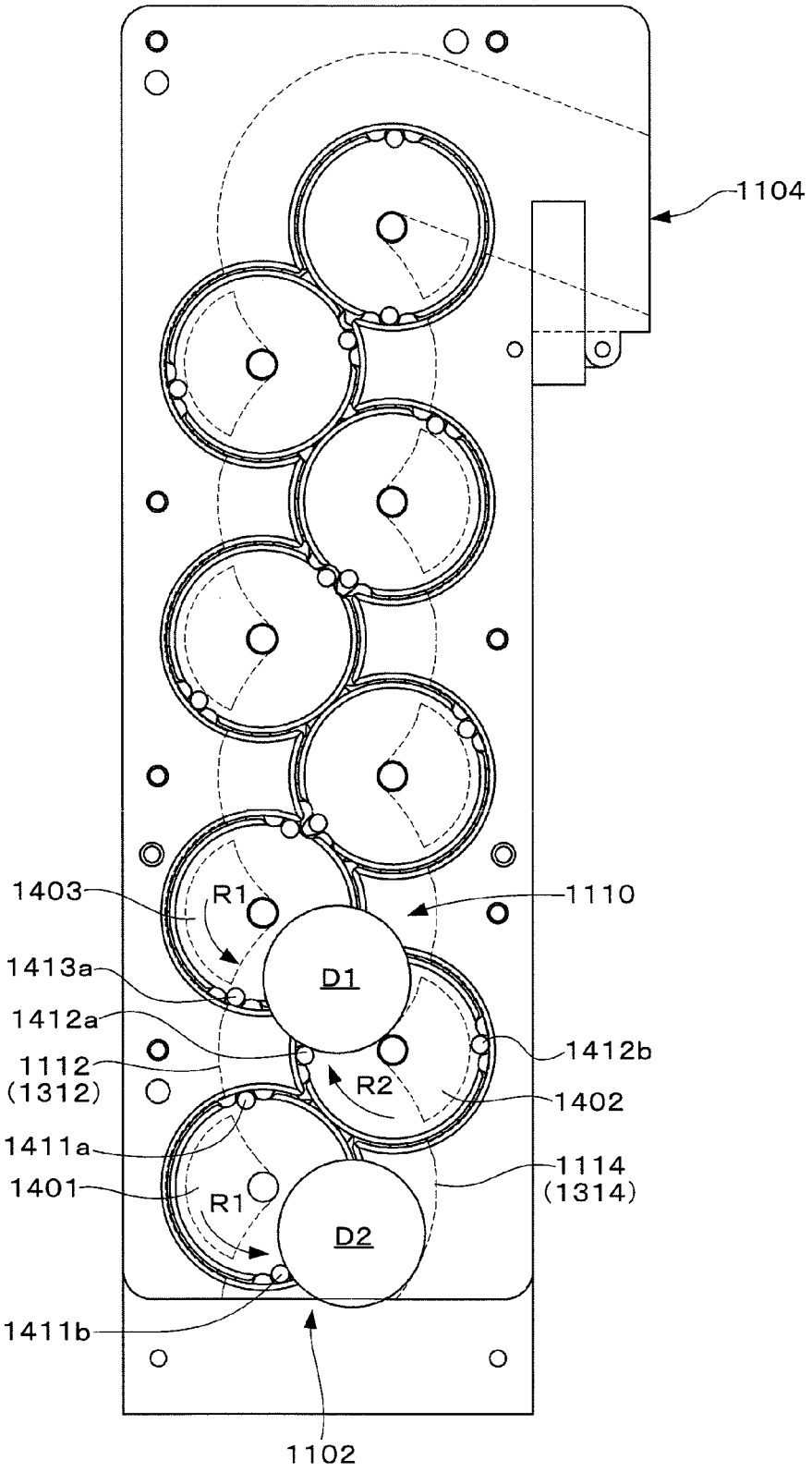
FIG. 12 is a plan view continued from FIG. 11 for describing the operation of the disk transferring device of FIG. 2 with the top plate removed.

Next, as shown in FIG. 12, with further rotation of the first rotary disk 1401, the contact of the first disk pusher 1411*a* with the peripheral surface of the disk D1 is released, and also the second disk pusher 1411*b* becomes in contact with the peripheral surface of the disk D2. Therefore, the disk D1 is pushed by the first disk pusher 1412*a* of the second rotary disk 1402, and the disk D2 is pushed by the second disk pusher 1411*b* of the first rotary disk 1401. As with the disk D1, the disk D2 is guided with the right guide surface 1114 of the disk guide path 1110 to be moved in an upper direction.

Figure 13:
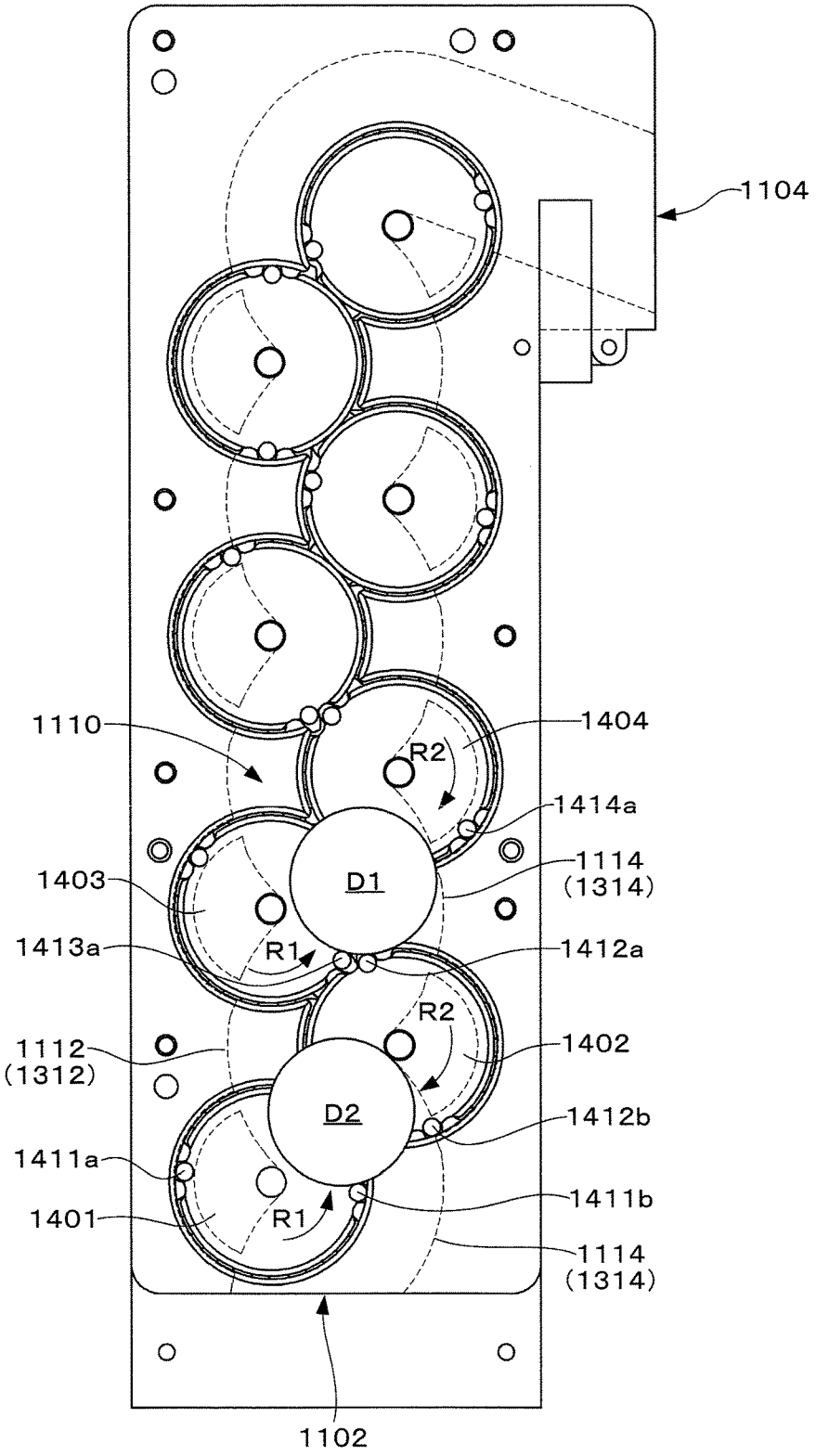
FIG. 13 is a plan view continued from FIG. 12 for describing the operation of the disk transferring device of FIG. 2 with the top plate removed.

Furthermore, as shown in FIG. 13, the first disk pusher 1413*a* of the third rotary disk 1403 becomes in contact with the peripheral surface of the disk D1, and both of the first disk pushers 1412*a* and 1413*a* push the disk D1 in an upper right direction. The disk D1 has the peripheral surface guided with the right guide surface 1114 of the disk guide path 1110 to be moved in an upper direction. Also, the disk D2 is pushed by the second disk pusher 1411*b* of the first rotary disk 1401 to be guided with the right guide surface 1114 of the disk guide path 1110 to be moved in an upper direction.

Figure 14:
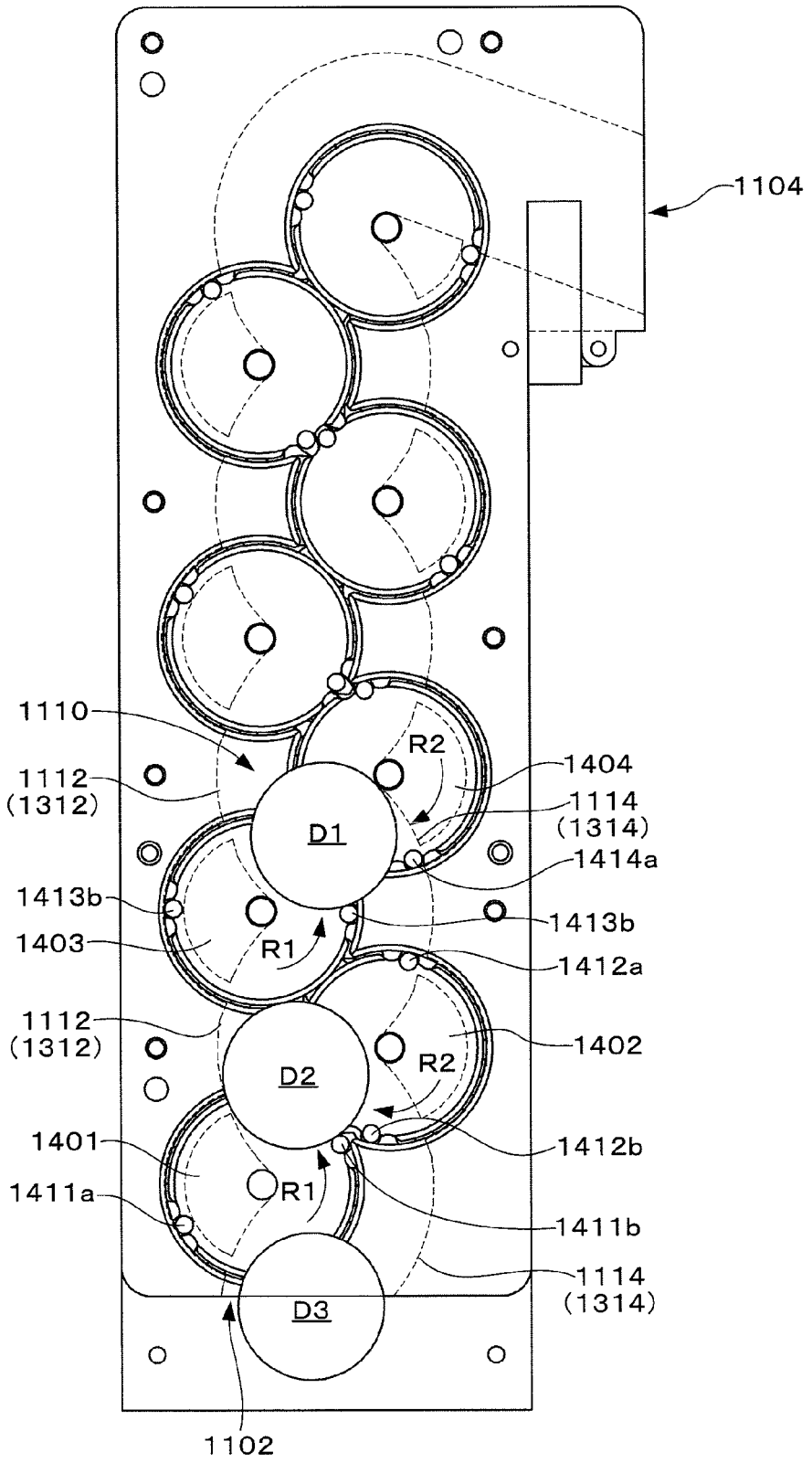
FIG. 14 is a plan view continued from FIG. 13 for describing the operation of the disk transferring device of FIG. 2 with the top plate removed.

Next, as shown in FIG. 14, with further rotation of the second rotary disk 1402, the contact of the first disk pusher 1412*a* with the peripheral surface of the disk D1 is released. Therefore, the disk D1 is pushed by the first disk pusher 1413*a* of the third rotary disk 1403, and has the peripheral surface guided with the right guide surface 1114 of the disk guide path 1110 to be moved in an upper direction. Also, the disk D2 is pushed by the second disk pusher 1411*b* of the first rotary disk 1401, and has the peripheral surface guided with the left guide surface 1112 of the disk guide path 1110 to be moved in an upper direction. Furthermore, from the disk reception opening 1102, a next disk D3 is introduced into the disk guide path 1110.

Figure 15:
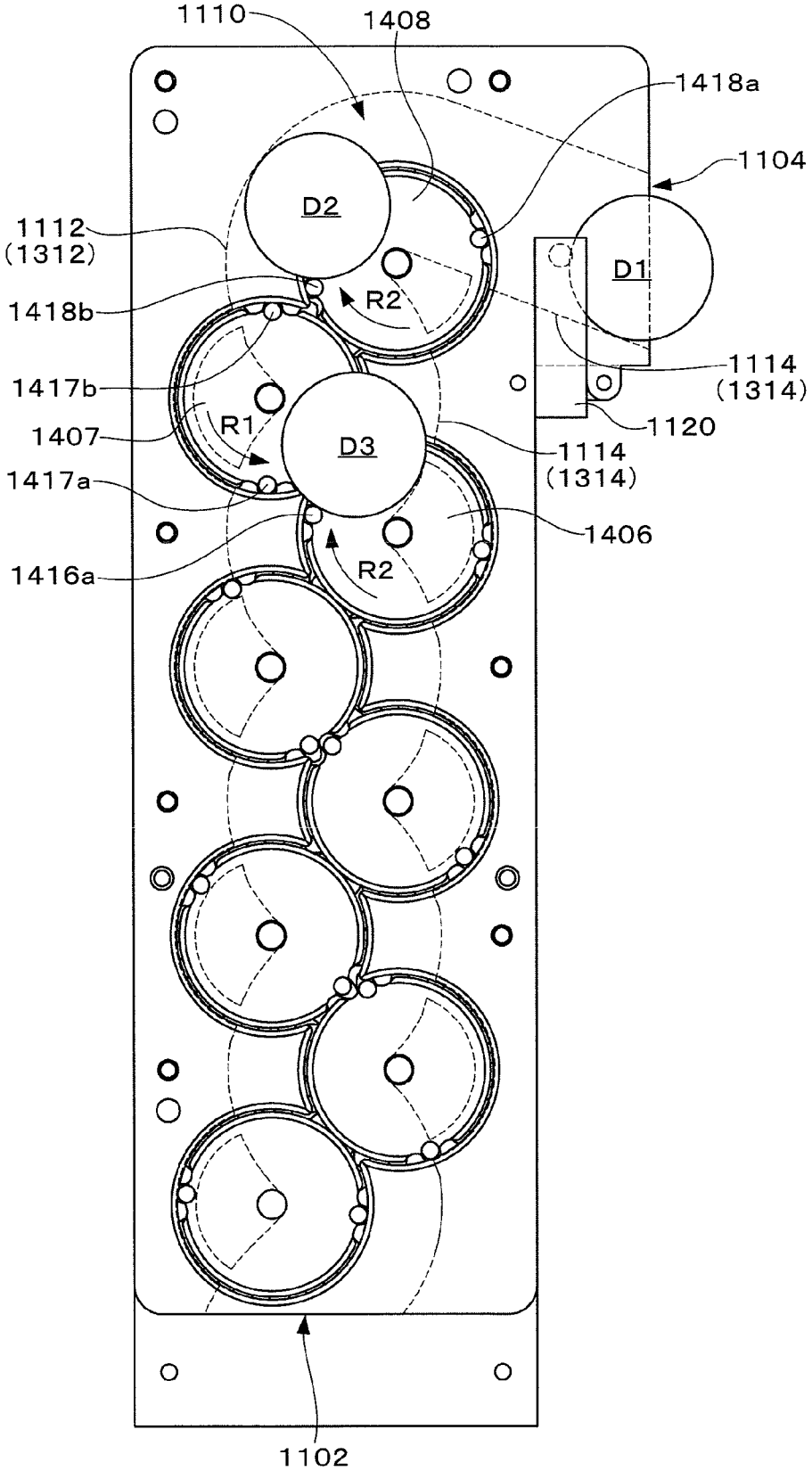
FIG. 15 is a plan view continued from FIG. 14 for describing the operation of the disk transferring device of FIG. 2 with the top plate removed.

With the above-described operation of the disk pushing mechanism 1400 being repeated, as shown in FIG. 15, the disks D1, D2, and D3 are transferred from the disk reception opening 1102 toward the disk ejection opening 1104 in the disk guide path 1110. Then, from the disk ejection opening 1104, the disks D1, D2, and D3 are sequentially discharged. Note that at the time of discharging the disks D1, D2, and D3, the number of discharged disks is counted by a disk counter 1120 provided near the disk ejection opening 1104.

As described above, in the disk transferring device 1003 of the first embodiment of the present invention, the first to eighth rotational axis lines 1221 to 1228 are alternately arranged the space d apart from each other on the first and second axis arrangement lines 1212 and 1214, and are arranged in a zigzag manner along the direction in which the disk guide path 1110 extends. The first to eighth rotary disks 1401 to 1408 rotatably supported by the first to eighth rotating shafts 1231 to 1238 are provided with the first and second disk pushers 1411*a* to 1418*a* and 1411*b* to 1418*b*, respectively, protruding into the disk guide path 1110. The first and second disk pushers 1411*a*, 1413*a*, 1415*a*, 1417*a*, 1411*b*, 1413*b*, 1415*b*, and 1417*b* corresponding to the first, third, fifth, and seventh rotational axis lines 1221, 1223, 1225, and 1227 arranged on the first axis arrangement line 1212 configure the first pusher group, and the first and second disk pushers 1412*a*, 1414*a*, 1416*a*, 1418*a*, 1412*b*, 1414*b*, 1416*b*, and 1418*b* corresponding to the second, fourth, sixth, and eighth rotational axis lines 1222, 1224, 1226, and 1228 arranged on the second axis arrangement line 1214 configure the second pusher group.

The first and second disk pushers 1411*a* to 1418*a* and 1411*b* to 1418*b* make a rotational movement about the first to eighth rotational axis lines 1221 to 1228 with the rotation of the rotationally-driven first to eighth rotary disks 1401 to 1408. The first and second disk pushers 1411*a*, 1413*a*, 1415*a*, 1417*a*, 1411*b*, 1413*b*, 1415*b*, and 1417*b* belonging to the first pusher group make a rotational movement in a first direction, and the first and second disk pushers 1412*a*, 1414*a*, 1416*a*, 1418*a*, 1412*b*, 1414*b*, 1416*b*, and 1418*b* belonging to the second pusher group make a rotational movement in a second direction opposite to the first direction.

In adjacent paired ones of the first to eighth rotary disks 1401 to 1408, the first and second disk pushers 1411*a* to 1418*a* and 1411*b* to 1418*b* are disposed so as to keep a predetermined rotational phase difference. In other words, the arrangement is made so that the first and second disk pushers 1412*a*, 1414*a*, 1416*a*, 1418*a*, 1412*b*, 1414*b*, 1416*b*, and 1418*b* belonging to the second pusher group make a rotational movement with a predetermined temporal difference with respect to the first and second disk pushers 1411*a*, 1413*a*, 1415*a*, 1417*a*, 1411*b*, 1413*b*, 1415*b*, and 1417*b* belonging to the first pusher group, respectively.

Therefore, when the disks D1 to D3 delivered one by one are introduced from the disk reception opening 1102 into the disk guide path 1110, the first and second disk pushers 1411*a*, 1413*a*, 1415*a*, 1417*a*, 1411*b*, 1413*b*, 1415*b*, and 1417*b* belonging to the first pusher group making a rotational movement and the first and second disk pushers 1412*a*, 1414*a*, 1416*a*, 1418*a*, 1412*b*, 1414*b*, 1416*b*, and 1418*b* belonging to the second pusher group making a rotational movement act on the disks D1 to D3 one after another just like a relay. Then, as being guided with the left and right guide surfaces 1112 and 1114 and the front and back guide surfaces 1116 and 1118, the disks D1 to D3 are pushed to be transferred through the disk guide path 1110.

As such, the disk transferring device 1003 has a function of transferring the disks D1 to D3 by causing the first and second disk pushers 1411*a* to 1418*a* and 1411*b* to 1418*b* protruding into the disk guide path 1110 to make a rotational movement. Therefore, as a mechanism for causing a rotational movement, the first to eighth gear wheels 1431 to 1438 can be used for the first to eighth rotary disks 1401 to 1408, and the structure can be made without using a belt, a chain, or a screw. Therefore, various problems occurring in the conventional disk transferring device of a type using any of a belt, a chain, and a screw can be solved.

Second Embodiment

Figure 16:
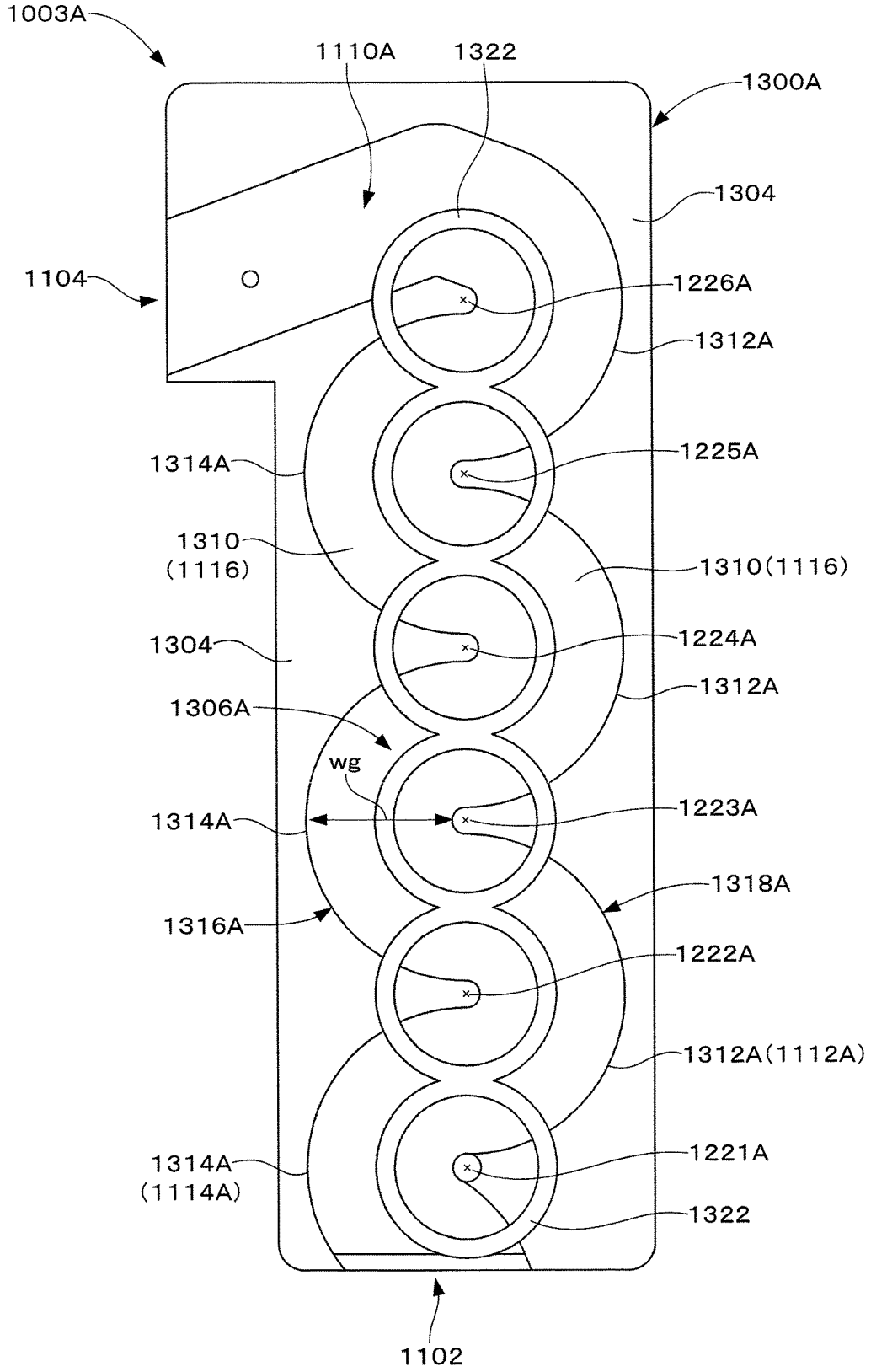
FIG. 16 is a plan view of a top plate configuring the disk transferring device of the second embodiment of the present invention viewed from a back side.
Figure 17:
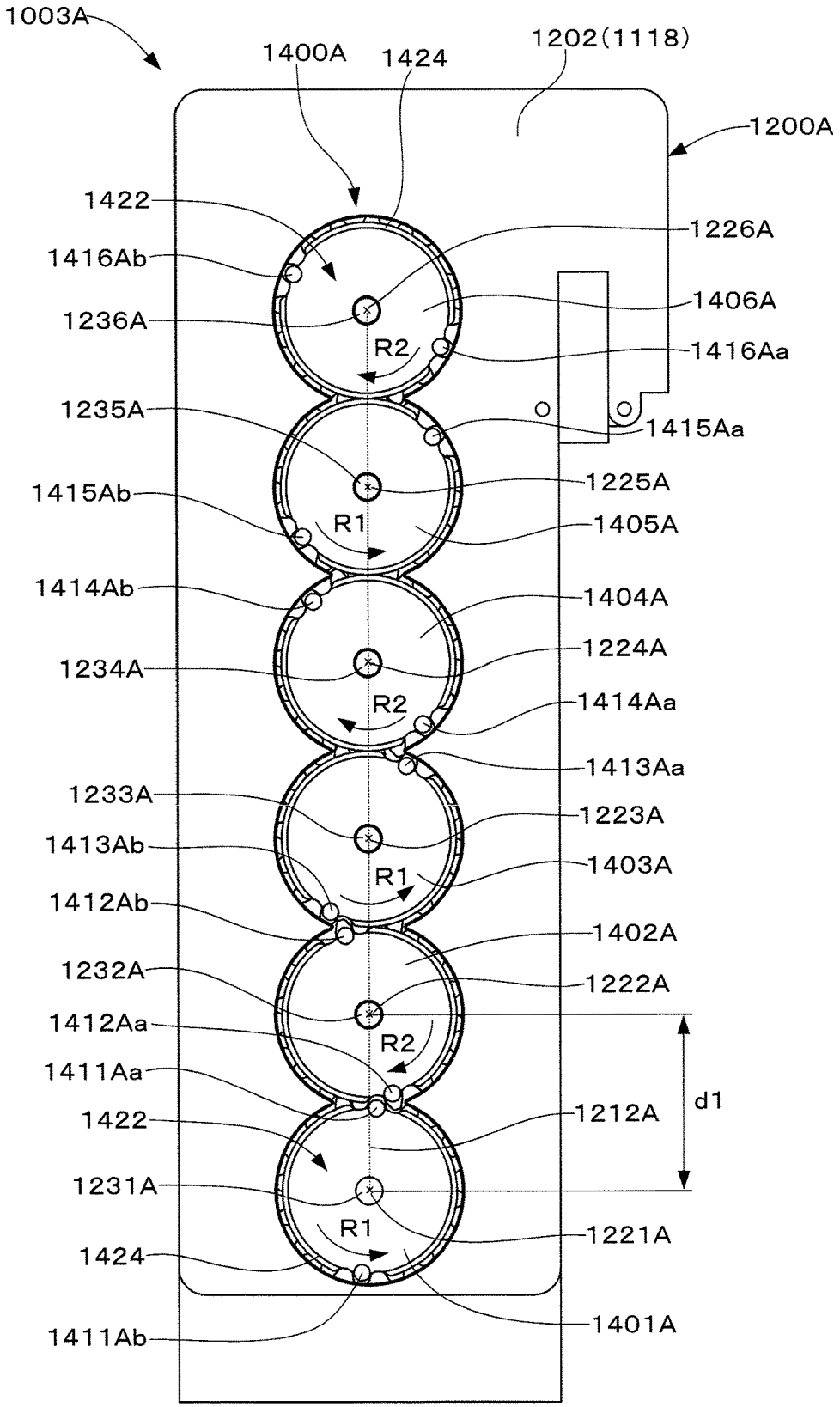
FIG. 17 is a plan view of a base part configuring the disk transferring device of the second embodiment of the present invention.

FIGS. 16 and 17 show a top plate 1300A and a base part 1200A configuring a disk transferring device 1003A of a second embodiment of the present invention.

The disk transferring device 1003A of the second embodiment is different from the disk transferring device 1003 of the first embodiment in that all rotational axis lines are arranged on one axis arrangement line 1212A and, other than that, has an approximately same structure as that of the disk transferring device 1003 of the first embodiment. Therefore, in FIGS. 16 and 17, component identical to those of the disk transferring device 1003 of the first embodiment are provided with the same reference characters and are not described herein.

(Disk Pushing Mechanism)

In the disk transferring device 1003A, as shown in FIG. 17, a disk pushing mechanism 1400A of a base part 1200A has first to sixth rotary disks 1401A to 1406A. In the first to sixth rotary disks 1401A to 1406A, as with the disk transferring device 1003 of the first embodiment, first to sixth rotating shafts 1231A to 1236A are inserted, and have the respective peripheral parts 1424 provided with first and second disk pushers 1411Aa to 1416Aa and 1411Ab to 1416Ab. The first and second disk pushers 1411Aa to 1416Aa and 1411Ab to 1416Ab can rotate about corresponding first to sixth rotational axis lines 1221A to 1226A.

The first to sixth rotational axis lines 1221A to 1226A are arranged a predetermined space d1 apart from each other on one axis arrangement line 1212A. In other words, the first to sixth rotational axis lines 1221A to 1226A are arranged in a line, and the first to sixth rotary disks 1401A to 1406A are also arranged in a line on the axis arrangement line 1212A.

Among the first and second disk pushers 1411Aa to 1416Aa and 1411Ab to 1416Ab, the first and second disk pushers 1411Aa, 1413Aa, 1415Aa, 1411Ab, 1413Ab, and 1415Ab corresponding to odd-numbered rotational axis lines on the axis arrangement line 1212A, that is, the first, third, and fifth rotational axis lines 1221A, 1223A, and 1225A configure a first pusher group. On the other hand, the first and second disk pushers 1412Aa, 1414Aa, 1416Aa, 1412Ab, 1414Ab, and 1416Ab corresponding to even-numbered rotational axis lines on the axis arrangement line 1212A, that is, the second, fourth, and sixth rotational axis lines 1222A, 1224A, and 1226A configure a second pusher group. As with the case of the disk transferring device 1003 of the first embodiment, the first and second disk pushers 1411Aa, 1413Aa, 1415Aa, 1411Ab, 1413Ab, and 1415Ab belonging to the first pusher group and the first and second disk pushers 1412Aa, 1414Aa, 1416Aa, 1412Ab, 1414Ab, and 1416Ab make a rotational movement in directions opposite to each other as indicated by arrows R1 and R2 in FIG. 17.

In adjacent paired ones among the first to sixth rotary disks 1401A to 1406A, the first and second disk pushers 1411Aa to 1416Aa and 1411Ab to 1416Ab are arranged so as to keep a predetermined rotational phase difference. In other words, the arrangement is made so that the first and second disk pushers 1412Aa, 1414Aa, 1416Aa, 1412Ab, 1414Ab, and 1416Ab belonging to the second pusher group make a rotational movement with a predetermined temporal difference with respect to the first and second disk pushers 1411Aa, 1413Aa, 1415Aa, 1411Ab, 1413Ab, and 1415*b* belonging to the first pusher group, respectively.

(Disk Guide Unit)

As shown in FIG. 16, a disk guide groove 1306A formed in the top plate 1300A has first and second side surfaces 1312A and 1314A. The first side surface 1312A is formed is formed along a curve 1318A formed by connecting a plurality of segments of circles centering on even-numbered rotational axis lines on the axis arrangement line 1212A, that is, the second, fourth, and sixth rotational axis lines 1222A, 1224A, and 1226A. The second side surface 1314A is formed along a curve 1316A formed by connecting a plurality of segments of circles centering on odd-numbered rotational axis lines on the axis arrangement line 1212A, that is, the first, third, and fifth rotational axis lines 1221A, 1223A, and 1225A. As with the case of the disk transferring device 1003 of the first embodiment, the first and second side surfaces 1312A and 1314 function as the left and right guide surfaces 1112A and 1114A, and configure the disk guide path 1110A together with the front and back surfaces 1116 and 1118.

(Operation of Disk Transferring Device)

Also in the disk transferring device 1003A having the above structure, the disk transferring device 1003 of the first embodiment operates similarly.

That is, when disks delivered one by one are introduced from the disk reception opening 1102 into the disk guide path 1110A, the first and second disk pushers 1411Aa, 1413Aa, 1415Aa, 1411Ab, 1413Ab, and 1415Ab belonging to the first pusher group making a rotational movement and the first and second disk pushers 1412Aa, 1414Aa, 1416Aa, 1412Ab, 1414Ab, and 1416Ab belonging to the second pusher group making a rotational movement act on the disks one after another just like a relay. Then, as being guided with the left and right guide surfaces 1112A and 1114A and the front and back guide surfaces 1116 and 1118, the disks are pushed to be transferred through the disk guide path 1110A.

Therefore, as with the case of the disk transferring device 1003 of the first embodiment, as a mechanism for causing a rotational movement, first to sixth gear wheels (not shown) can be used for first to sixth rotary disks (not shown), and the structure can be made without using a belt, a chain, or a screw.

As shown in FIG. 16, the disk guide path 1100A of the disk transferring device 1003A of the second embodiment is more meandered, compared with the disk guide path 1100 of the first embodiment shown in FIG. 5. Therefore, the disk transferring device 1003A of the second embodiment has a slower disk transfer speed, compared with the disk transferring device 1003 of the first embodiment. However, the number of rotary disks 1401A to 1406A and, in turn, the number of disk pushers 1411Aa to 1416Aa and 1411Ab to 1416Ab required to obtain a predetermined transfer distance can be advantageously reduced.

Note that while the rotary disks 1401 to 1408 and 1401A to 1406A are provided with the first and second disk pushers 1411*a* to 1418*a*, 1411*b* to 1418*b*, 1411Aa to 1416Aa, and 1411Ab to 1416Ab, respectively, in the first and second embodiments described above, the present invention is not meant to be restricted to this and, for example, one disk pusher can be provided to each of the rotary disks 1401 to 1408 and 1401A to 1406A. However, providing two or more disk pushers to each of the rotary disks 1401 to 1408 and 1401A to 1406A is preferable for increasing transfer efficiency.

Also, while the disk pushing mechanisms 1400 and 1400A have eight rotary disks 1401 to 1408 and six rotary disks 1401A to 1406A, respectively, the number of rotary disks is not meant to be restricted to this, and any number can be selected.

Furthermore, while the base part 1200 is configured of the first and second members 1206 and 1208, it goes without saying that the first and second members 1206 and 1208 can be integrally formed to be as one member.

Third Embodiment

Figure 18:
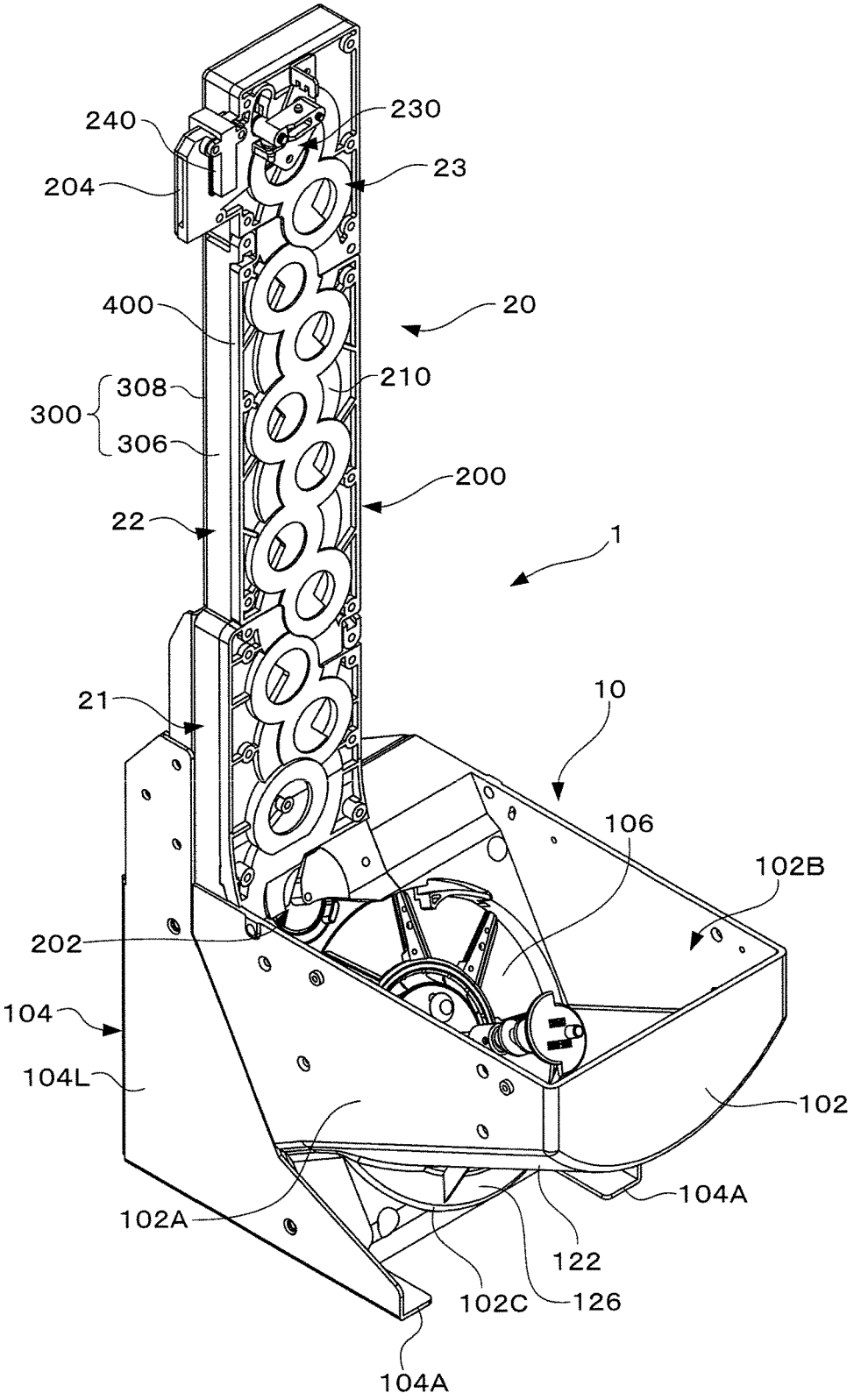
FIG. 18 is a perspective view of a coin dispensing device of a third embodiment of the present invention.
Figure 19:
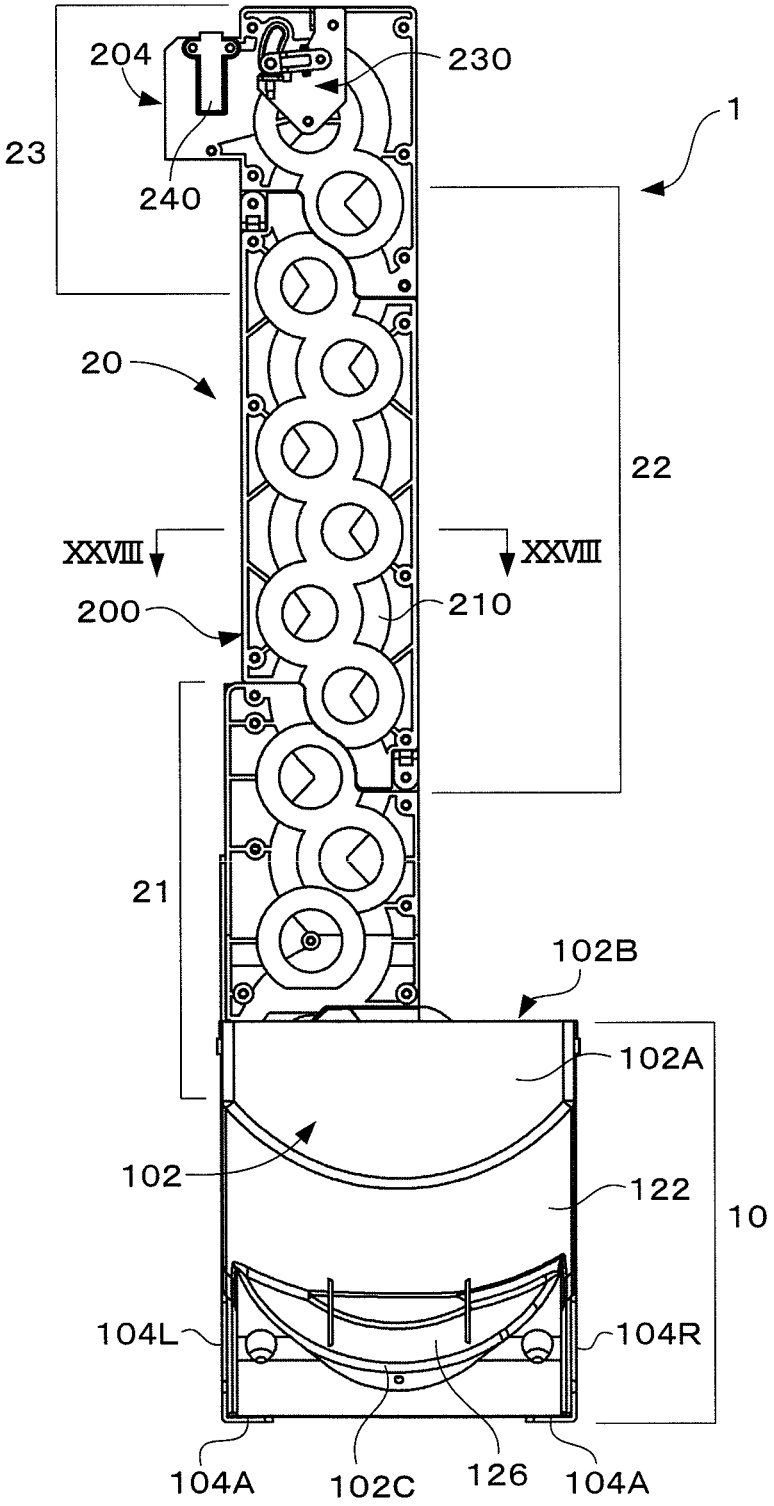
FIG. 19 is a front view of the coin dispensing device of FIG. 18.
Figure 20:
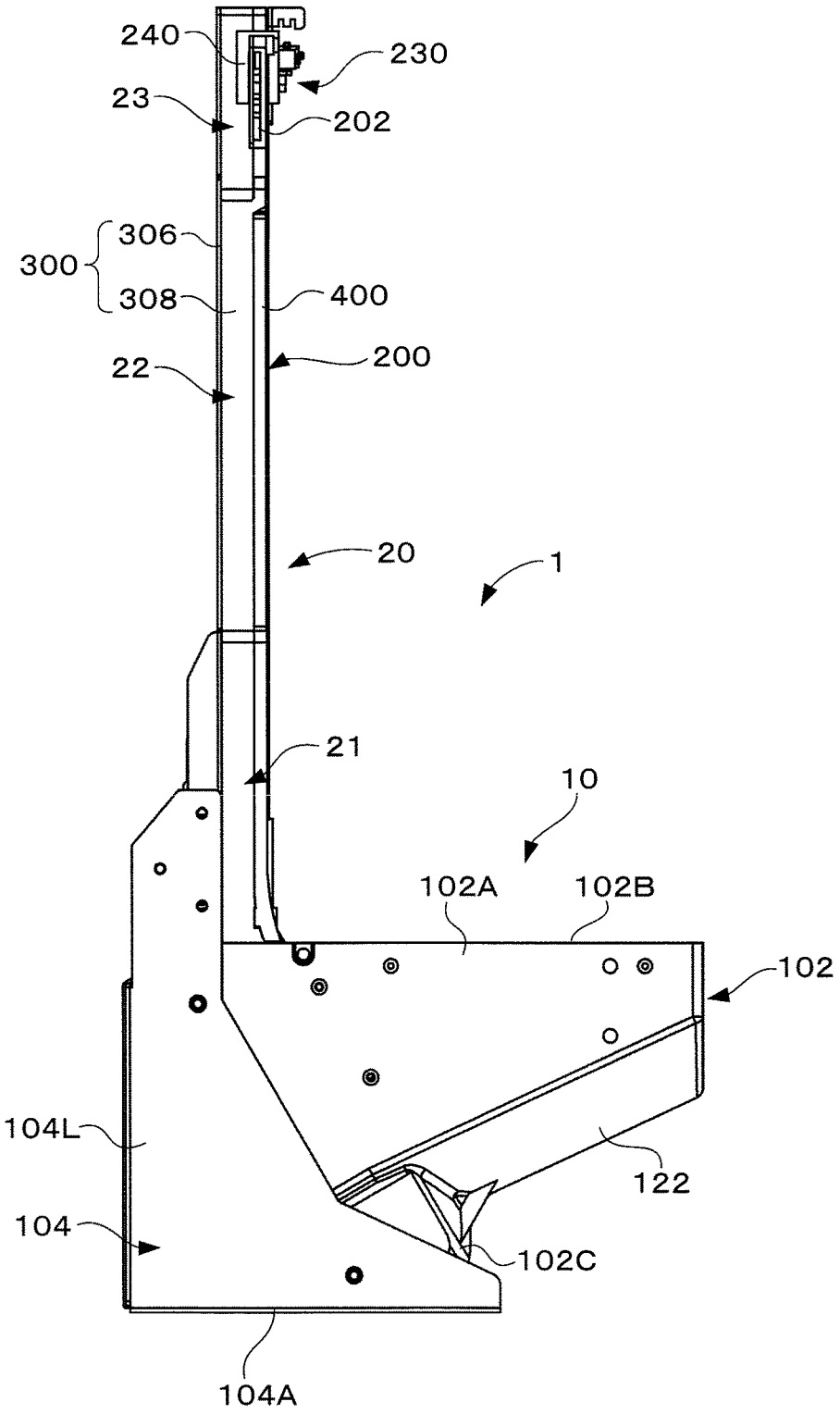
FIG. 20 is a side view of the coin dispensing device of FIG. 18.

As an example of the disk dispensing device of the present invention, FIGS. 18, 19, and 20 show a coin dispensing device 1 of a third embodiment. This coin dispensing device 1 has a function of dispensing coins in bulk one by one to a predetermined dispensing position, and is configured to broadly include a coin delivering device 10 and a coin transferring device 20. The coin dispensing device 1 can dispense coins of a plurality of types (that is, denominations) with different outer diameters or thicknesses, and functions as a free-size-support coin dispensing device.

(Coin Delivering Device)

First, the coin delivering device 10 is described with reference to FIGS. 18 to 23. The coin delivering device 10 has a function of separating coins in bulk one by one and delivering the coins, and has a storing bowl 102 storing many coins, a mount base 104 for supporting and fixing the storing bowl 102 by tilting the storing bowl upward, a rotary disk 106 separating the coins one by one, driver (driving means) 108 driving the rotary disk 106, coin receiver (coin receiving means) 112 receiving the coins from the rotary disk 106, and coin dropper 118.

(Storing Bowl)

The storing bowl 102 has a function of storing many coins in bulk and feeding the coins toward the rotary disk 106. The storing bowl 102 protrudes forward from the mount base 104 (a right side in FIG. 20), and has a depth increased as being closer to the rotary disk 106. In other words, the storing bowl 102 has a head part 102A with a bottom wall 122 tilted downward toward the rotary disk 106, a coin reception opening 102B for throwing coins, and an exterior part 102C being in close contact with the mount base 104 and surrounding at least a lower peripheral surface of the rotary disk 106.

Figure 22:
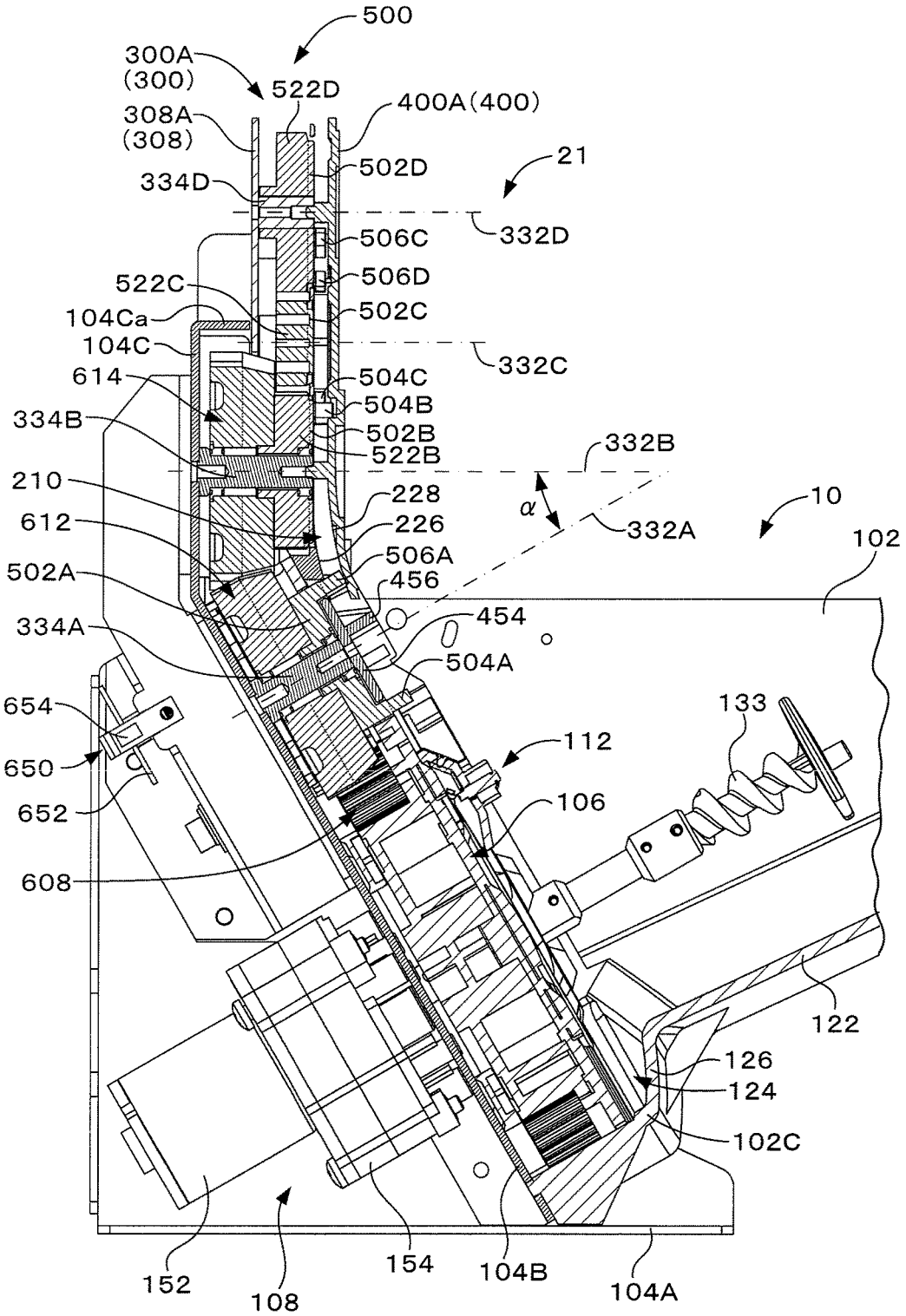
FIG. 22 is a sectional view along a XXII-XXII line of FIG. 21.

The tilt of the bottom wall 122 has an angle allowing coins to slide down to a rotary disk 106 side under their own weights. The head part 102A is in a shape of a manger with the rotary disk 106 side open, and its open end is fixed in close contact with the mount base 104. Toward the front of a lower part of the rotary disk 106, a narrow-width longitudinal groove 124 is formed as shown in FIG. 22 so that falling coins can easily stand. The longitudinal groove 124 is formed of a longitudinal wall 126 tilted to the rotary disk 106 side with respect to a perpendicular line approximately in parallel to the rotary disk 106 formed continuously to the exterior part 102C, the rotary disk 106, and the exterior part 102C, and has a width, in other words, a space between the upper surface of the rotary disk 106 and the longitudinal wall 126 of the storing bowl 102, smaller than the diameter of a minimum coin and is set to be five to ten times as thick as the thickness of a maximum-thickness coin and is set so that the space is widened more to a downstream side in a direction of rotation of the rotary disk 106. The reason for this is that the coin is caused to stand and be further tilted to the rotary disk 106 side, and the coins are stopped to the last one by coin stoppers, which will be described further below, for dispensing.

The exterior part 102C is in a shape of a ring, and is arranged near the peripheral surface of the rotary disk 106. Therefore, coins with different diameters are stored in bulk in the storing bowl 102, slide down onto the tilted bottom wall 122 by their own weights, and are fed to the rotary disk 106. Furthermore, the coins pushed around by the rotary disk 106 are guided by the exterior part 102C so as to be stored on the rotary disk 106.

(Mount Base)

The mount base 104 has a function of rotatably supporting the rotary disk 106, fixing the storing bowl 102, and others. The mount base 104 includes two horizontal mounting stage parts 104A, a first mounting part 104B tilted with respect to the mounting stage parts 104A, a second mounting part 104C extending from an upper end of the first mounting part 104B vertically upward, and support side walls 104L and 104R standing approximately at a right angle with respect to the mounting stage parts 104A. The mounting stage parts 104A are each in a rectangular flat shape, and are integrally formed with the support side walls 104L and 104R. The first mounting part 104B is in a flat shape, and is tilted upward at an angle of approximately 60 degrees with respect to the mounting stage parts 104A. On an upward-oriented upper surface 104U side, the rotary disk 106 is arranged. On a back surface side, driver (driving means) 108 is mounted. The tilt angle of the first mounting part 104B is preferable in a range of 50 degrees to 70 degrees. The reason for this is such that, the amount of storing coins is decreased if the tilt angle is smaller than 50 degrees, and the coins tend to fall down from the coin stoppers 128, which will be described further below, if the tilt angle is larger than 70 degrees. The second mounting part 104C is integrally formed with the first mounting part 104B to support the coin transferring device 20.

(Rotary Disk)

The rotary disk 106 has a function of separating coins in bulk with different outer diameters one by one and transferring them to the coin receiver 112. The rotary disk 106 is in a shape of a circular plate, with a circular center protrusion 132 formed at the center and a ring-shaped holding surface 134 formed so as to surround the center protrusion 132. On the holding surface 134, the coin stoppers 128 are radially formed, with their back surfaces adjacently arranged to the upward upper surface 104U. The rotary disk 106 is tilted upward, and is rotated in a counterclockwise direction in FIG. 21. A protrusion 133 is formed on an upper surface of the center protrusion 132, thereby preferably agitating coins.

The center protrusion 132 has a peripheral surface as a support rack 136. The support rack 136 forms an approximately right angle with respect to the holding surface 134, and the amount of protrusion from the holding surface 134 is set lower than the thickness of a thinnest coin assumed to be used. The support rack 136 has a function of holding only one coin on the holding surface 134 between the coin stoppers 128. This is for the purpose of preventing two coins from being supported by the support rack 136.

The holding surface 134 has a function of holding a coin by making contact with one surface of the coin with its peripheral surface supported by the support rack 136. The holding surface 134 is a flat surface in a ring shape formed around the center protrusion 132, and is tilted at approximately 60 degrees with respect to a horizontal plane.

The coin stoppers 128 has a function of being in contact with the peripheral surface of the coin and pushing coin. The coin stoppers 128 are rib-shaped projecting lines radially and equidistantly formed in a fixed state with respect to a rotational axis line of the rotary disk 106. In the present embodiment, each coin stopper 128 is in a shape of a trapezoid in a front view and a sectional view, and pushes a coin by a pushing edge 138 at a front end in a rotational direction. The pushing edge 138 vertical extends upward with respect to the holding surface 134, and a height from the holding surface 134 can be a height allowing a coin to be pushed. However, if the height of the pushing edge 138 is low, a contact pressure per unit length at the time of pushing a coin is increased, and therefore the height is preferably as high as possible. On the hand, if the height of the pushing edge 138 is higher than a predetermined amount, the length of an overriding slope 142 of the coin receiver 112, which will be described further below, is increased, and a coin with a minimum diameter is pushed over the overriding slope 142 when being pushed by the pushing edge 138, thereby causing the coin with the minimum diameter to easily falling from the coin receiver 112. Therefore, the pushing edge 138 is preferably formed as high as possible within a range in which the coin with the minimum diameter is not pushed up over the overriding slope 142 while it is being pushed by the pushing edge 138. According to an experiment, when coins with a diameter of 20 millimeters or longer are taken as targets, the height of the pushing edge 138 is preferably approximately 2 millimeters.

Figure 21:
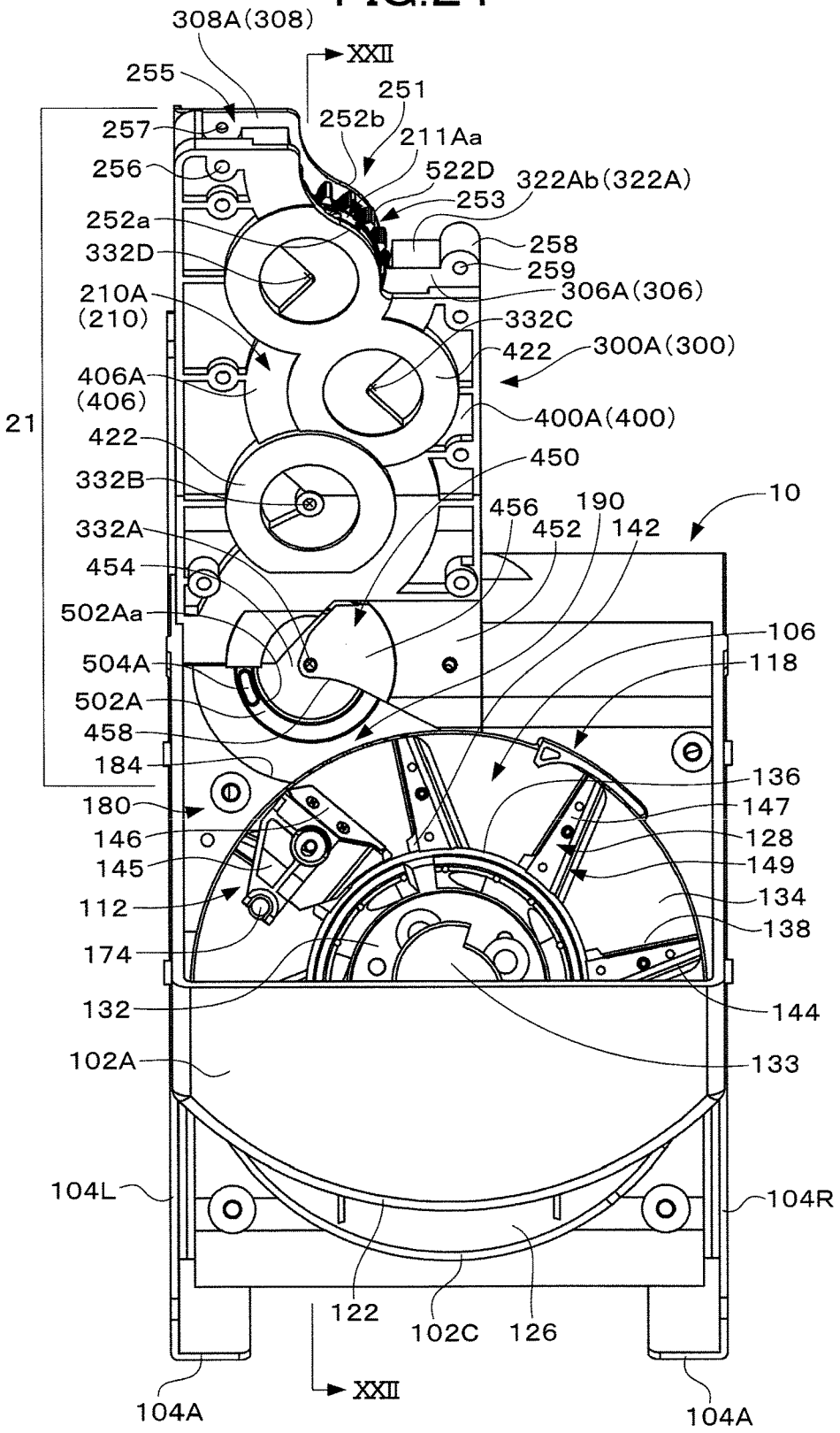
FIG. 21 is a front view of a coin delivering device and a first coin transferring unit of a coin transferring device configuring the coin dispensing device of FIG. 18.

The coin stopper 128 has a side edge 144 that is downstream in the rotating direction, the downstream side edge 144 preferably formed as being tilted with respect to the pushing edge 138 so that, as shown in FIG. 21, an overall length of a receiving edge 146 of the coin receiver 145 configuring the coin receiver 112 is simultaneously in the vicinity of the holding surface 134. The reason for this is such that a coin is prevented from being interposed between the holding surface 134 and the coin receiver 145 when the coin receiver 145 becomes in the vicinity of the holding surface 134. The coin stopper 128 has a top 147 and the downstream side edge 144 formed on a joggled slope 149. On the holding surface 134 between adjacent coin stoppers 128, one surface of the coin is held in a surface contact state. Therefore, a space between the pushing edge 138 and the downstream side edge 144 on the holding surface 134 is in a shape of being narrow on a support rack 136 side and being gradually extended as being closer to the peripheral edge of the rotary disk 106, and the holding surface 134 has a shape of an inverted trapezoid with respect to the center protrusion 132. It is set that when one of minimum-diameter coins assumed to be used is supported by the support rack 136, another minimum-diameter coin is not supported by the support rack 136. In other words, it is set that two minimum-diameter coins are not in a surface contact with the holding surface 134 at a position close to the support rack 136. The reason for this is to prevent two coins from being dispensed successively.

The overriding slope 142 has a function of pushing therealong an end of the receiving edge 146 of the coin receiver 145 on a support rack 136 side from the holding surface 134. As shown in FIG. 21, the overriding slope 142 is a slope formed at a corner formed by the support rack 136 and the pushing edge 138 and being tilted from the holding surface 134 to the top 147 of the coin stopper 128, and, when a coin with a minimum diameter is in contact with the support rack 136 and the pushing edge 138, the slope is preferably formed in a triangular space formed thereby. The reason for this is such that when the overriding slope 142 is too large, part of coins override the overriding slope 142 with the coins being guided to the receiving edge 146, thereby causing the coins to easily fall from the receiving edge 146.

(Driver)

The driver 108 has a function of rotationally driving the rotary disk 106 at a predetermined speed. In the present embodiment, the driver 108 includes the electric motor 152 and the decelerator 154. The decelerator 154 is fixed to the back surface of a first mounting part 104B, and its input gear wheel engages with an output wheel (not shown) of the electric motor 152 fixed to the decelerator 154. The decelerator 154 has an output shaft (not shown) penetrating through the first mounting part 104B and closely inserted in a fitting hole (not shown) of the rotary disk 106 at the center for being fixed.

Note that the driver 108 has a function of an overload preventive function. That is, when the driver 108 becomes in an overloaded state due to an anomaly such as coin clogging, a current with a reversed polarity is caused to flow through the electric motor 152 by a control device not shown, thereby rotating the rotary disk 106 in reverse. With this, when the anomaly is eliminated and the load state of the driver 108 is back to normal, the rotary disk 106 is again rotated forward by the control device.

(Coin Receiver)

The coin receiver 112 has a function of moving coins separated one by one by the rotary disk 106 in a peripheral direction of the rotary disk 106 and performing a relieving motion on the coin stoppers 128. In the present embodiment, the coin receiver 112 is a pentagonal plate, has a linear-shaped receiving edge 146 at an end edge facing the pushing edge 138, has another end part floatably supported by floating support (floating support means) 174, and has a coin receiver 145 at an intermediate part with the pushing edge 138 being pressed by a presser (pressing means, not shown) to a rotary disk 106 side.

The receiving edge 146 extends in a straight line from the vicinity of the support rack 136 to a peripheral direction of the rotary disk 106, and is formed such that when having a facing relation with the pushing edges 138 (when a coin is positioned therebetween), lines extended from these edges form an acute angle. In other words, as shown in FIG. 21, the receiving edge 146 is offset upward with respect to the center of the rotary disk 106, and faces the overall length of the width of the holding surface 134 in a peripheral direction.

The floating support 174 has a function of supporting the coin receiver 112 so that the posture can be changed in any of upward, downward, leftward, and rightward directions in a predetermined range. In detail, a motion is possible in which the receiving edge 146 of the coin receiver 112 can override the coin stopper 128 as being at a position in the vicinity of the holding surface 134 and being in contact with the overriding slope 142. The floating support 174 has a structure identical to that of the art disclosed in the above-described Patent Document 2 (Japanese Unexamined Patent Application Publication No. 2008-97322), and its detailed description is omitted herein.

(Coin Dropper)

The coin dropper (coin falling means) 118 has a function of dropping a coin on a coin held in contact with the holding surface 134 so that the stacked coins do not reach the coin receiver 112. The coin dropper 118 is arranged upper than the axis line of the rotary disk 106 so as to face the peripheral edge of the rotary disk 106. In other words, the coin dropper 118 is approximately at 2 o'clock position with respect to the rotary disk 106 and, as shown in FIG. 21, is in the vicinity of the holding surface 134 of the rotary disk 106, and is configured to advance or retreat in a parallel plane. The coin dropper 118 has a structure identical to that of the art disclosed in the above-described Patent Document 2 (Japanese Unexamined Patent Application Publication No. 2008-97322), and its detailed description is omitted herein.

(Coin Transferring Device)

Next, the coin transferring device 20 is described with reference to FIGS. 18 to 36. As shown in FIGS. 18 to 36, the coin transferring device 20 includes a coin guide part 200 having a coin guide path 210 extending from the coin reception opening 202 toward an coin ejection opening 204, a coin pushing mechanism 500 having first to twelfth rotary disks 502A to 502L provided with paired coin pushers 504A to 504L and 506A to 506L, respectively, and coin discharger (coin discharging means) 230 and coin dispensing detection sensor 240 arranged in the vicinity of the coin ejection opening 204. Also, the coin transferring device 20 is configured of first to third coin transferring units 21 to 23 dividing the coin guide path 210 into three in its extending direction. In other words, the coin transferring device 20 is configured so that the coin guide path 210 is formed by connecting the first and third coin transferring units 21 and 23 together via the second coin transferring unit 22. The coin reception opening 202 of the coin guide path 210 is provided at a lower part of the first coin transferring unit 21, and the coin ejection opening 204 is provided on an upper left side of the third coin transferring unit 23.

(Coin Guide Part)

Figure 23:
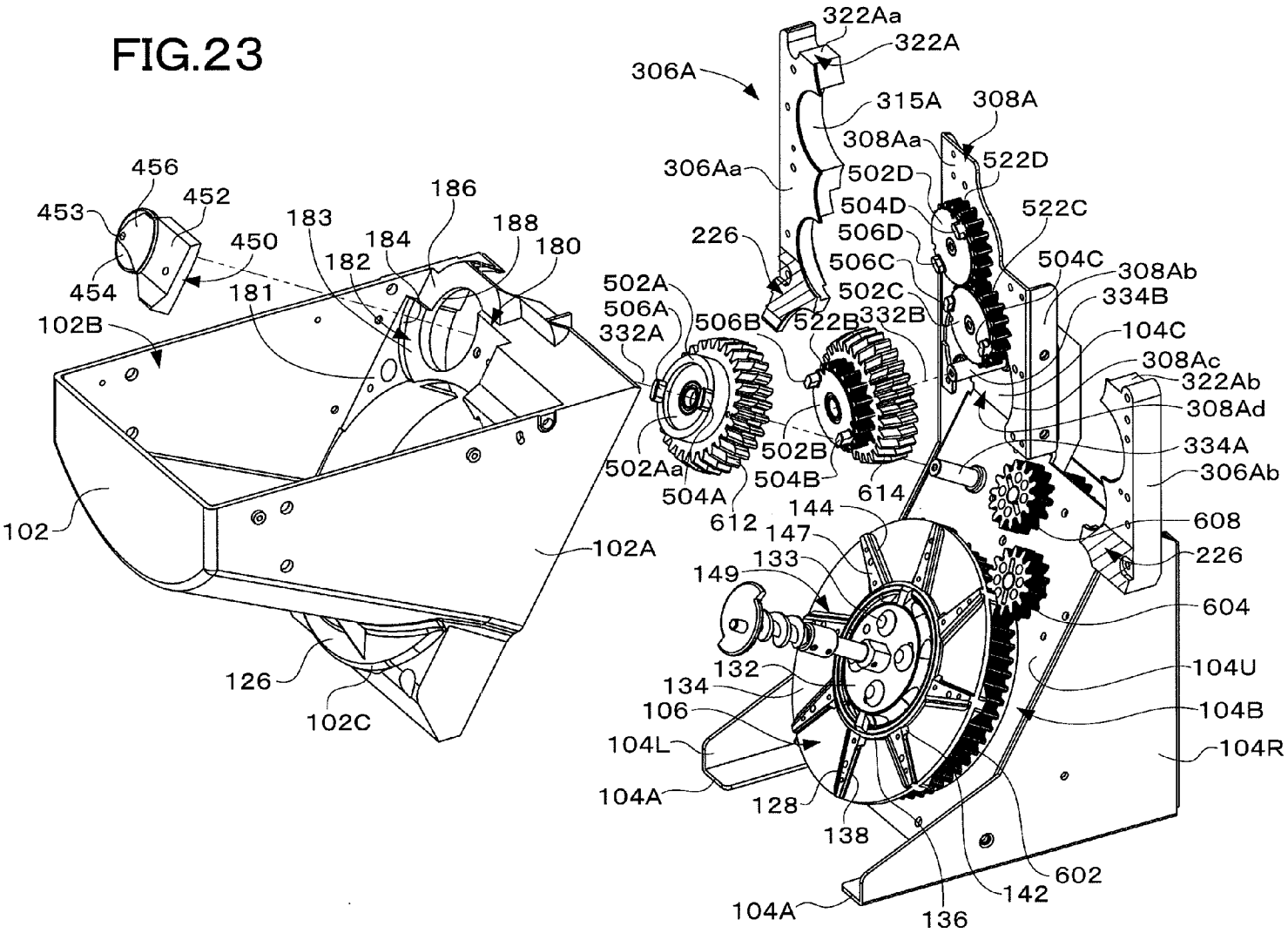
FIG. 23 is an exploded perspective view of main parts of the coin delivering device and the first coin transferring unit of FIG. 21.
Figure 24:
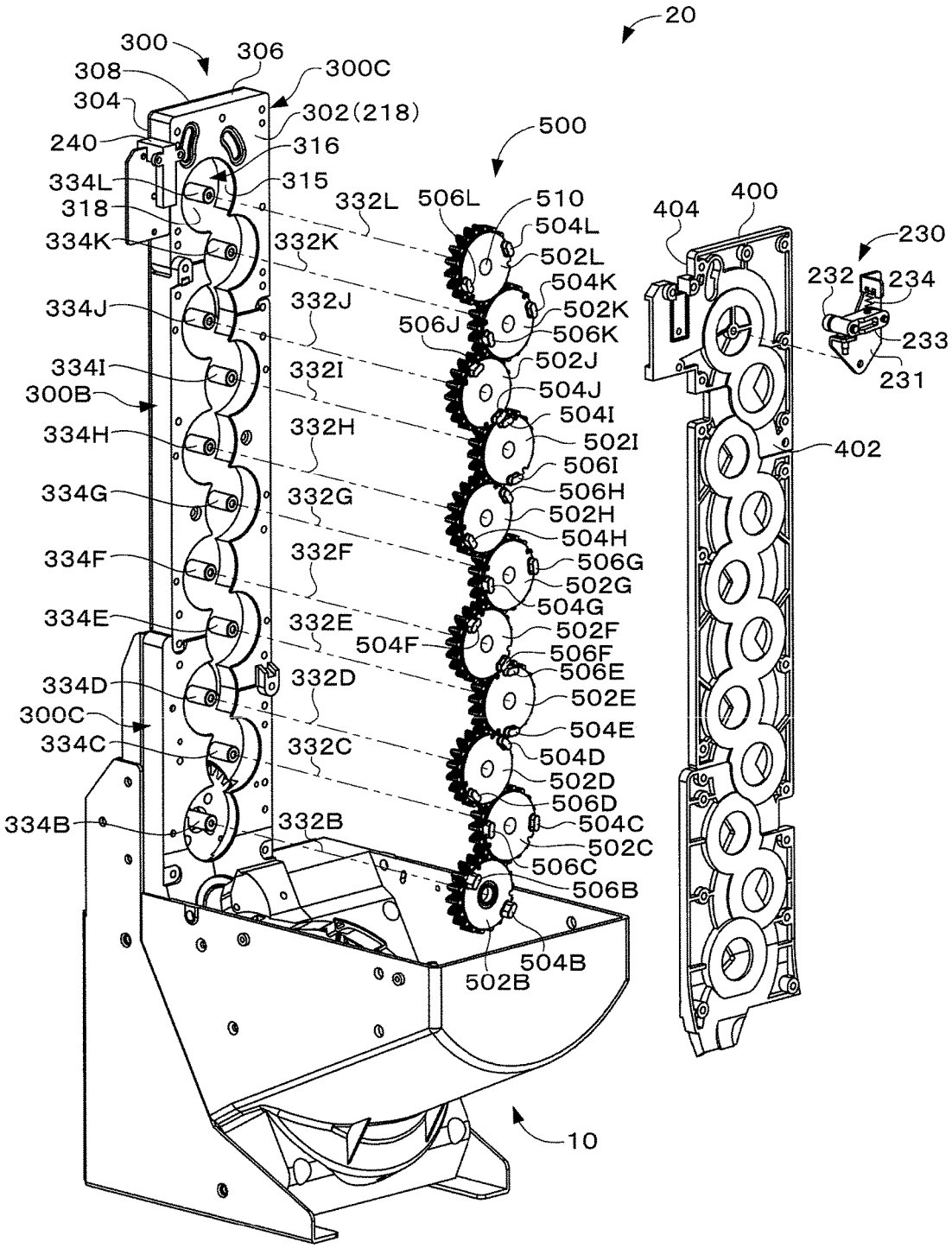
FIG. 24 is an exploded perspective view of main parts of the coin transferring device configuring the coin dispensing device of FIG. 18 when viewed from a front side.
Figure 27:
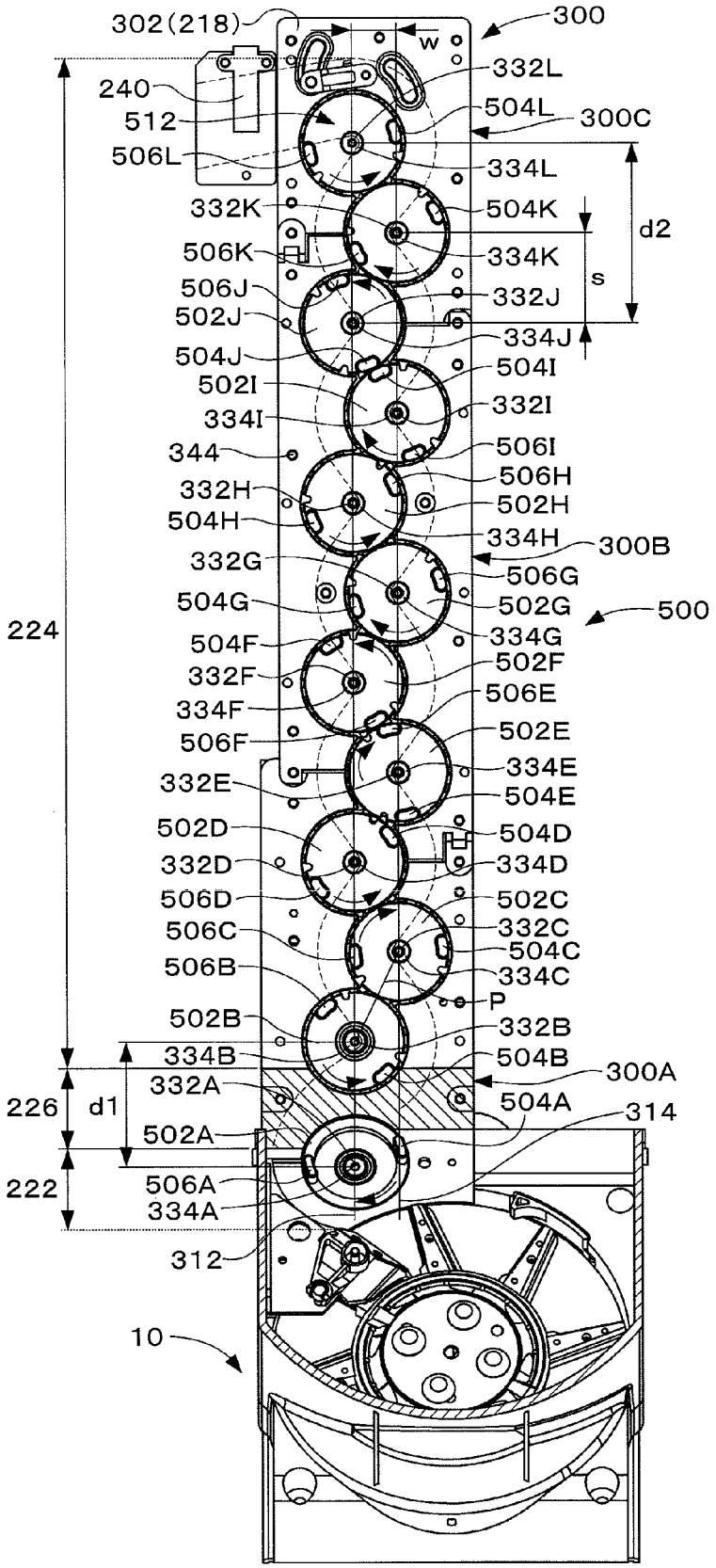
FIG. 27 is a front view of a base part of the coin transferring device configuring the coin dispensing device of FIG. 18.

The coin guide part 200 is configured to include a base body 300 and a top plate 400 and an coin reception guide member 450 provided on a front surface 302 of the base unit 300. On a front surface 302 side of the base body 300, as shown in FIGS. 23, 24, and 27, the first to twelfth rotary disks 502A to 502L rotatably supported about first to twelfth rotational axis lines 332A to 332L are arranged. The first to twelfth rotational axis lines 332A to 332L are approximately at a right angle with respect to the front surface 302 of the base body 300.

As shown in FIG. 27, the front surface 302 of the base body 300 has a first guide surface portion 222 and a second guide surface portion 224. The first guide surface portion 222 is parallel to the upward upper surface 104U of the first mounting part 104B and, in other words, as with the holding surface 134 of the rotary disk 106, has a tilt angle of approximately 60 degrees with respect to a horizontal plane.

The second guide surface portion 224 is approximately at a right angle with respect to the horizontal plane, and crosses the first guide surface portion 222 at an angle of approximately 150 degrees. In other words, the first and second guide surface portions 222 and 224 have normal lines crossing each other at an angle of approximately 30 degrees. Between the first and second guide surface portions 222 and 224, a first curved surface portion 226 is formed. In other words, the first and second guide surface portions 222 and 224 are connected smoothly via the first curved surface portion 226.

The first and second rotational axis lines 332A to 332B are arranged a predetermined space d1 apart from each other on a first axis arrangement line 312 and, as shown in FIG. 22, are arranged so as to cross each other at a predetermined angle α when viewed from a side of the base body 300 (that is when viewed from either one of the left and right guide surfaces 212 and 214, which will be described further below). In other words, the rotational axis lines are arranged so as to cross each other approximately at a right angle in a direction in which the coin guide path 210 extends and at the predetermined angle α when viewed from a direction approximately parallel to the front surface 302 of the base body 300. The first rotational axis line 332A is approximately at a right angle with respect to the first guide surface portion 222, and the second rotational axis line 332B is approximately at a right angle with respect to the second guide surface portion 224. Therefore, the angle α is approximately 30 degrees.

The second to twelfth rotational axis lines 332B to 332L are approximately parallel to each other. The second, fourth, sixth, eighth, tenth, and twelfth rotational axis lines 332B, 332D, 332F, 332H, 332J, and 332L are arranged in a line a predetermined space d2 apart from each other on the first axis arrangement line 312, and the third, fifth, seventh, ninth, and eleventh rotational axis lines 332C, 332E, 332G, 332I, and 332K are arranged in a line the predetermined space d2 apart from each other on the second axis arrangement line 314. In other words, among the second to twelfth rotational axis lines 332B to 332L, the even-numbered lines are arranged in a line on the first axis arrangement line 312, and the odd-numbered lines are arranged in a line on the second axis arrangement line 314. The first an second axis arrangement lines 312 and 314 are parallel to each other and are arranged a predetermined space w apart from each other. The third, fifth, seventh, ninth, and eleventh rotational axis lines 332C, 332E, 332G, 332I, and 332K are offset a predetermined distance s from the second, fourth, sixth, eighth, tenth, and twelfth rotational axis lines 332B, 332D, 332F, 332H, 332I, and 332L. In other words, the second to twelfth rotational axis lines 332B to 332L are arranged in a zigzag manner (that is, in a staggered manner) along a direction in which the coin guide path 210 extends.

Figure 25:
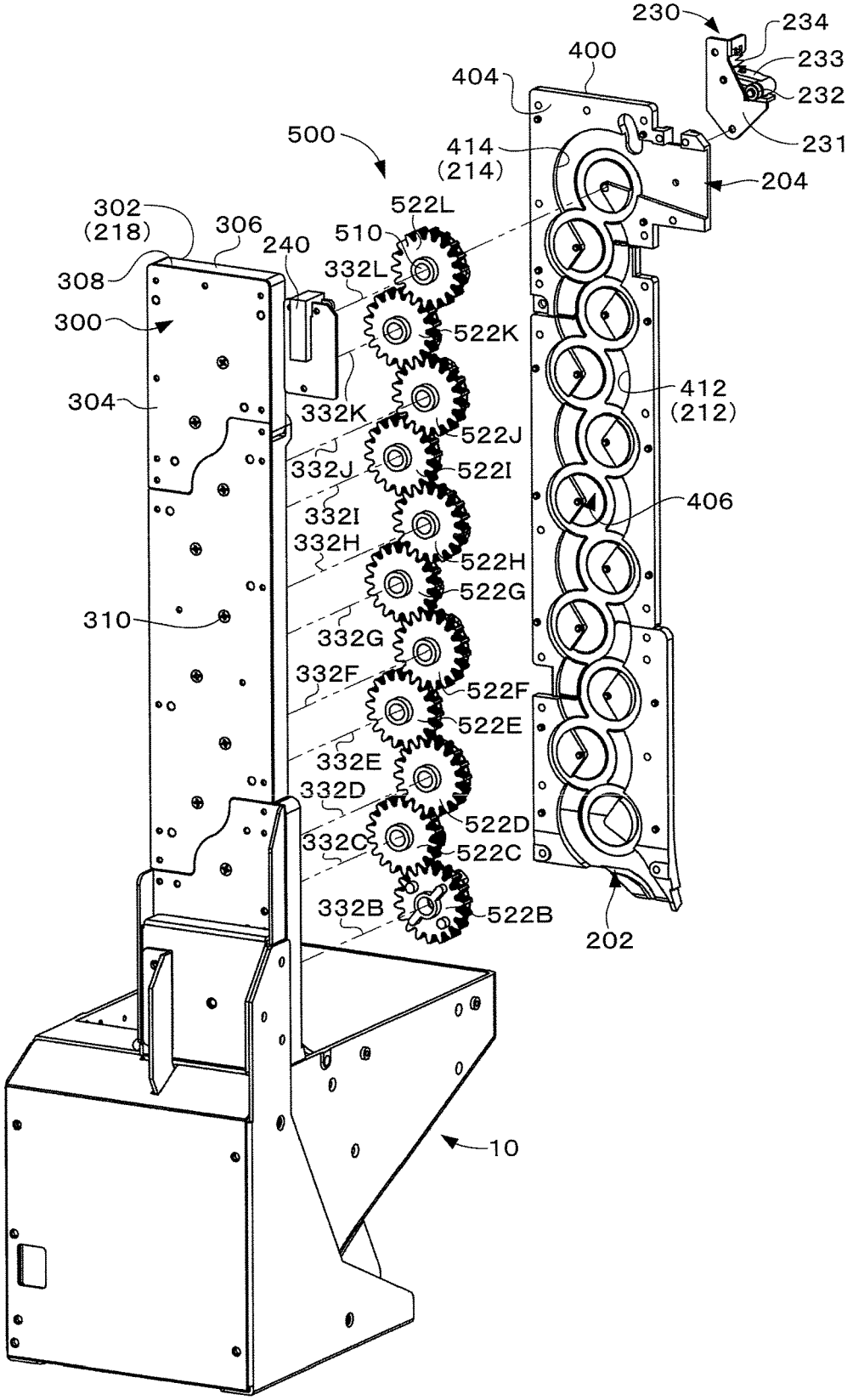
FIG. 25 is an exploded perspective view of main parts of the coin transferring device configuring the coin dispensing device of FIG. 18 when viewed from a rear side.
Figure 26:
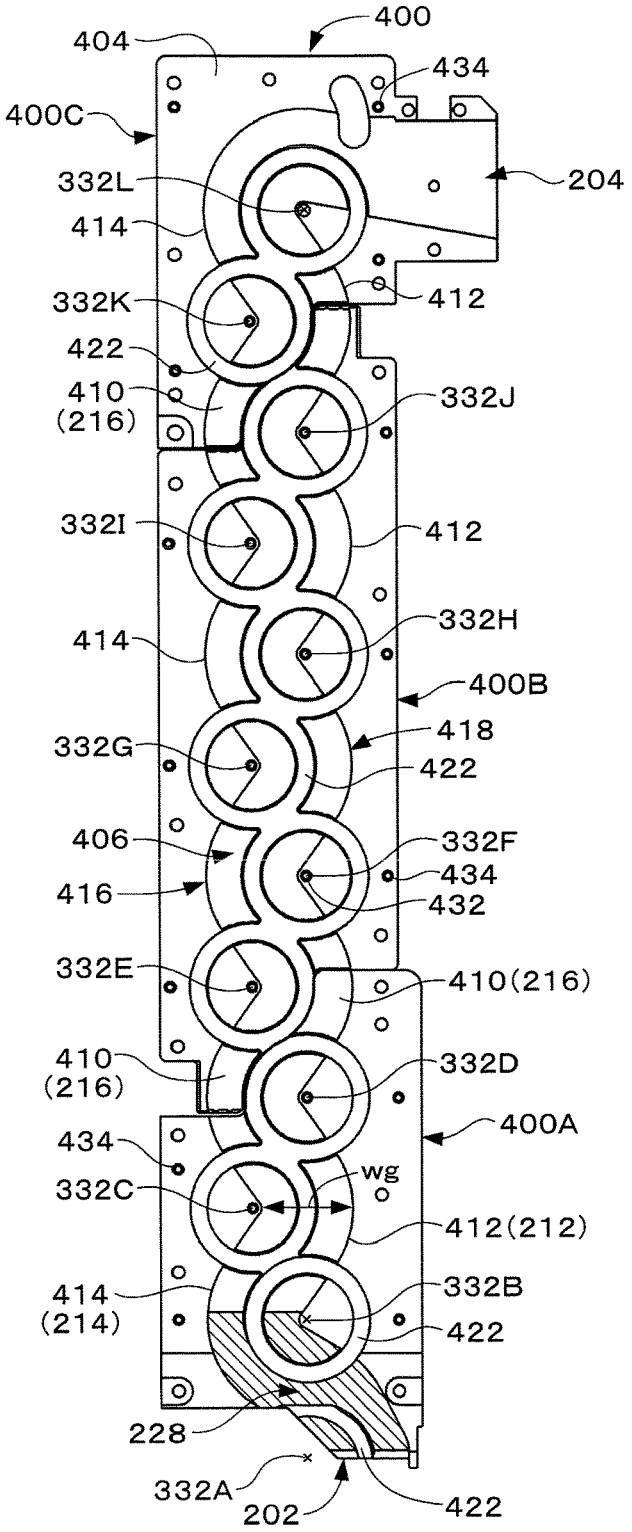
FIG. 26 is a plan view of a top plate of the coin transferring device configuring the coin dispensing device of FIG. 18 when viewed from a rear side.

On a back surface 404 side of the top plate 400, as shown in FIGS. 25 and 26, a coin guide groove 406 is formed from the coin reception opening 202 toward the coin ejection opening 204. The coin guide groove 406 has a bottom surface 410 and first and second side surfaces 412 and 414, and is fixed to the base body 300 with the back surface 404 placed on the front surface 302 of the base body 300. The coin guide groove 406 has a width wg set to be slightly larger than the diameter of a maximum-diameter coin, and a depth dg (refer to FIG. 28) set to be slightly larger than the thickness of a maximum-thickness coin. In other words, the width wg and the depth dg of the coin guide groove 406 are set so that a plurality of denominations of coins with different diameters and thicknesses can pass through the inside the coin guide groove 406 as being guided with the bottom surface 410 and the first and second side surfaces 412 and 414. In other words, coins of different outer diameters and thicknesses are set to be transferred within a predetermined range.

The first side surface 412 of the coin guide groove 406 is formed along a curve 418 with a plurality of segments of circles centering on the third, fifth, seventh, ninth, and eleventh rotational axis lines 332C, 332E, 332G, 332I, and 332K connected together. The second side surface 414 of the coin guide groove 406 is formed along a curve 416 with a plurality of segments of circles centering on the second, fourth, sixth, eighth, tenth, and twelfth rotational axis lines 332B, 332D, 332F, 332H, 332J, and 332L connected together.

The front surface 402 and the back surface 404 of the top plate 400 are approximately parallel to the front surface 302 of the base body 300, and is curved correspondingly to the shape of the front surface 302 of the base body 300. The coin guide groove 406 has a bottom surface 410 having a second curved surface portion 228 facing the first curved surface portion 226 of the base body 300.

Figure 28:
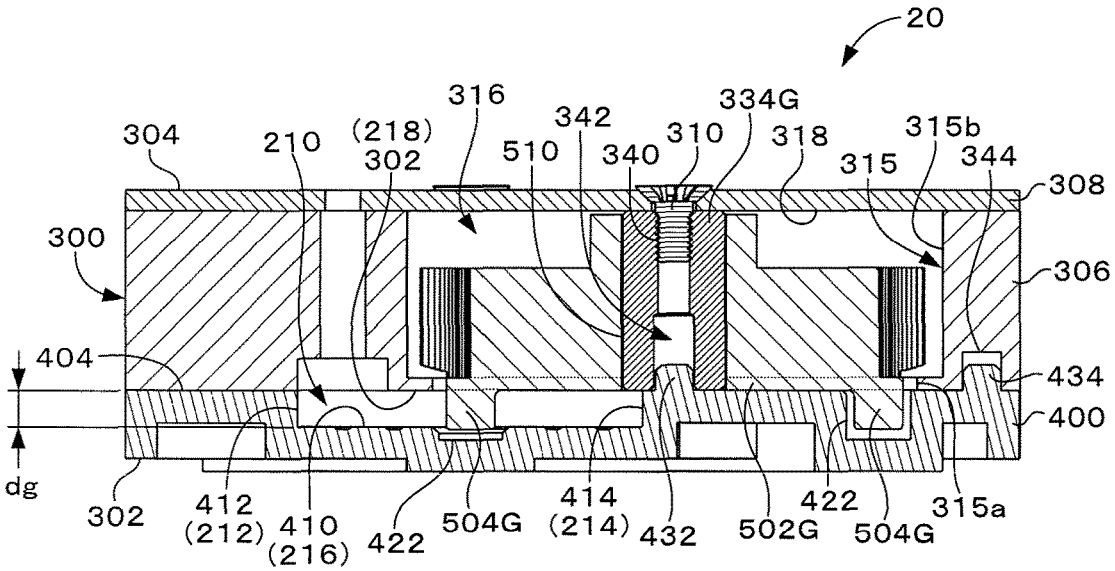
FIG. 28 is a sectional view along a XXVIII-XXVIII line of FIG. 19.

On the back surface 404 of the top plate 400, an annular groove 422 is formed correspondingly to the first to twelfth rotational axis lines 332A to 332L so as to prevent a contact with the top plate 400 when the coin pushers 504A to 504L and 506A to 506L, which will be described further below, make a rotational movement. Also, as shown in FIGS. 26 and 28, on the back surface 404 of the top plate 400, a positioning protrusion 432 is formed at a position corresponding to each of the third to twelfth rotational axis lines 332C to 332L, and a positioning protrusion 434 is formed at a predetermined position of a peripheral part of the top plate 400. The positioning protrusion 432 is inserted in a positioning hole 342 formed in each of third to twelfth spindles 334C to 334L, which will be described further below, and the positioning protrusion 434 is inserted in a positioning hole 344 formed at a predetermined position of the peripheral part on the front surface 302 of the base body 300. With this, the top plate 400 can be fixed as being positioned with respect to the base body 300.

The front surface 302 of the base body 300, the bottom surface 410 of the coin guide groove 406 of the top plate 400, and the first and second side surfaces 412 and 414 configure the coin guide path 210. In other words, the front surface 302 of the base body 300 functions as a back guide surface 218 of the coin guide path 210, the bottom surface 410 of the coin guide groove 406 of the top plate 400 functions as a front guide surface 216 of the coin guide path 210, and the first and second side surfaces 412 and 414 of the coin guide groove 406 of the top plate 400 function as left and right guide surfaces 212 and 214 of the coin guide path 210. In the coin guide path 210, the peripheral surface of a coin introduced from the coin reception opening 202 is guided with the left and right guide surfaces 212 and 214 of the coin guide groove 406 (that is, the first and second side surfaces 412 and 414 of the coin guide groove 406). Also, the front surface and the back surface of a coin are guided with the front and back surfaces 216 and 218 of the coin guide path 210 (that is, the bottom surface 410 of the coin guide groove 406 and the front surface 302 of the base body 300).

The coin reception guide member 450 forms the coin reception opening 202 of the coin guide path 210 together with the top plate 400. As shown in FIGS. 21 and 23, the coin reception guide member 450 has an approximately pentagonal mounting part 452, a protruding part 456 extending from the mounting part 452 toward the first rotational axis line 332A, and a circular plate 454 rotatably supported by a spindle provided to the protruding part 456. The circular plate 454 is arranged on a back surface side of the protruding part 456 so as to cover a recessed part 502Aa formed at a center portion of the first rotary disk 502A, which will be described further below. As shown in FIG. 21, the protruding part 456 is arranged with its downward side surface 458 being oriented toward the coin delivery port 190 of the coin delivering device 10. The downward side surface 458 of the protruding part 456 has a function of guiding the peripheral surface of a coin delivered from the coin delivery port 190 and smoothly introducing the coin to the coin reception opening 202 of the coin guide path 210.

(Coin Pushing Mechanism)

As shown in FIGS. 23 to 25 and 27, the coin pushing mechanism 500 has the first to twelfth rotary disks 502A to 502L rotating about the first to twelfth rotational axis lines 332A to 332L. The first to twelfth rotary disks 502A to 502L are rotatably supported by first to twelfth spindles 334A to 334L, respectively, arranged on the base body 300. The first to twelfth spindles 334A to 334L each have an approximately columnar outer shape with a relevant one of the first to twelfth rotational axis lines 332A to 332L as a center axis line, and have an approximately same diameter. The first rotary disk 502A has an approximately circular outer shape in a planar view, with the circular-shaped recessed part 502Aa (refer to FIG. 23) formed at the center. In other words, the first rotary disk 502A has an annular peripheral part protruding in a direction parallel to the first rotational axis line 332A. The second to twelfth rotary disks 502B to 502L each have an approximately circular outer shape in a planar view.

On the front surface of the first rotary disk 502A, paired coin pushers 504A and 506A are provided each having a planar shape of an approximately oval (or ellipse) extending as being bent along an periphery of the first rotary disk 602A and having a columnar outer shape protruding in a direction parallel to the first rotational axis line 332A. The coin pushers 504A and 506A have a function of pushing a coin toward a major axis direction of the approximately oval shape (or elliptic) shape. Therefore, with the above-described planar shape, mechanical strength and abrasion durability of the coin pushers 504A and 506A can be increased. The coin pushers 504A and 506A are arranged to face each other so as to interpose the first rotational axis line 332A in a peripheral part of the first rotary disk 502A. In other words, the coin pushers 504A and 506A are arranged so as to be symmetrical with respect to the first rotational axis line 332A on the first rotary disk 502A. The coin pushers 504A and 506A function as first coin pushers (or first coin pushing means) making a rotational movement about the first rotational axis line 332A in accordance with the first rotary disk 502A.

As with the first rotary disk 502A, on the front surfaces of the second to twelfth rotary disks 502B to 502L, paired coin pushers 504B to 504L and 506B to 506L are provided, respectively, each having a planar shape similar to those of the coin pushers 504A and 506A and having a columnar outer shape protruding in a direction parallel to a relevant one of the second to twelfth rotational axis lines 332B to 332L. The coin pushers 504B to 504L and 506B to 506L are arranged to face each other so as to interpose the rotational axis lines 332B to 332L in a peripheral part of the rotary disks 502B to 502L, respectively. In other words, the coin pushers 504B to 504L and 506B to 506L are arranged so as to be symmetrical with respect to the rotational axis lines 332B to 332L on the rotary disks 502B to 502L, respectively. The coin pushers 504B to 504L and 506B to 506L function as second to twelfth coin pushers (or coin pushing means) making a rotational movement about the rotational axis lines 332B to 332L in accordance with the rotary disks 502B to 502L, respectively.

The height of each of the coin pushers 504A, 504B, 506A, and 506B functioning as the first and second coin pushers (or coin pushing means) (in other words, a protrusion length from the surface of the rotary disk) is set to be larger than the height of each of the coin pushers 504C to 504L and 506C to 506L functioning as the third to twelfth coin pushers (or coin pushing means). The reason for this is that, in order to transfer a coin while a coin traveling angle is changed, it is required to reliably push the coin even when the coin is tilted. The coin pushers 504C to 504L and 506C to 506L have the same height.

The coin pushers 504A to 504L and 506A to 506L may be integrally formed with the first to twelfth rotary disks 502A to 502L, respectively, or can be formed by fixing each separately-fabricated body to a relevant one of the first to twelfth rotary disks 502A to 502L with an appropriate method. In the present embodiment, they are integrally formed in view of reducing fabrication cost. The coin pushers 504A to 504L and 506A to 506L may be columnar bodies or rotatable roller-type ones each having a support shaft covered with a cylindrical collar. In the case of roller-type ones, abrasion of the coin pushers 504A to 504L and 506A to 506L is advantageously suppressed to increase durability.

As described above, the second to twelfth rotational axis lines 332B to 332L are alternately arranged in a zigzag manner on the first and second axis arrangement lines 312 and 314. The coin pushers 504B, 504D, 504F, 504H, 504J, 504L, 506B, 506D, 506F, 506H, 506J, and 506L corresponding to the second, fourth, sixth, eighth, tenth, and twelfth rotational axis lines 332B, 332D, 332F, 332H, 332J, and 332L arranged on the first axis arrangement line 312 configure a first pusher group. The coin pushers 504C, 504E, 504G, 504I, 504K, 506C, 506E, 506G, 506I, and 506K corresponding to the third, fifth, seventh, ninth, and eleventh rotational axis lines 332C, 332E, 332G, 332I, and 332K arranged on the second axis arrangement line 314 configure a second pusher group. The second, fourth, sixth, eighth, tenth, and twelfth rotary disks 502B, 502D, 502F, 502H, 502J, and 502L configure a first rotary disk group, and the third, fifth, seventh, ninth, and eleventh rotary disks 502C, 502E, 502G, 502I, and 502K configure a second rotary disk group.

On the back surfaces of the second to twelfth rotary disks 502B to 502L, gear wheels 522B to 522L are coaxially provided functioning as driven gear wheels for rotationally driving the rotary disks 502B to 502L, respectively. In each of the second to twelfth rotary disks 502B to 502L and the gear wheels 522B to 522L, a shaft insertion hole 510 shown in FIG. 28 is formed. In each of these shaft insertion holes 510, a corresponding one of the spindles 334B to 334L is inserted. The gear wheels 522B to 522L may be integrally formed with the second to twelfth rotary disks 502B to 502L, or can be formed by fixing each separately-fabricated body to a relevant one of the rotary disks 502B to 502L with an appropriate method. The second to twelfth rotary disks 502B to 502L and the gear wheels 522B to 522L can be formed in any manner as long as they can integrally rotate. In the present embodiment, they are integrally formed in view of reducing fabrication cost and increasing coaxial accuracy.

Adjacent ones of the gear wheels 522B to 522L engage with each other. That is, the gear wheel 522C engages with the gear wheels 522B and 522D. Similarly, the gear wheel 522E engages with the gear wheels 522D and 522F, and the gear wheel 522G engages with the gear wheels 522F and 522H. The gear wheel 5221 engages with the gear wheels 522H and 522J, and the gear wheel 522K engages with the gear wheels 522J and 522L. Therefore as shown in FIG. 27, the second, fourth, sixth, eighth, tenth, and twelfth rotary disks 502B, 502D, 502F, 502H, 502J, and 502L belonging to the first rotary disk group rotate in a counterclockwise direction, and the third, fifth, seventh, ninth, and eleventh rotary disks 502C, 502E, 502G, 502I, and 502K belonging to the second rotary disk group rotate in a clockwise direction. That is, the second, fourth, sixth, eighth, tenth, and twelfth rotary disks 502B, 502D, 502F, 502H, 502J, and 502L belonging to the first rotary disk group and the third, fifth, seventh, ninth, and eleventh rotary disks 502C, 502E, 502G, 502I, and 502K belonging to the second rotary disk group rotate in directions in reverse to each other. Therefore, the coin pushers 504B, 504D, 504F, 504H, 504J, 504L, 506B, 506D, 506F, 506H, 506I, and 506L belonging to the first pusher group and the coin pushers 504C, 504E, 504G, 504I, 504K, 506C, 506E, 506G, 506I, and 506K belonging to the second pusher group make a rotational movement in directions in reverse to each other.

In adjacent paired ones among the second to twelfth rotary disks 502B to 502K, the coin pushers 504B to 504L and 506B to 506L are arranged so as to keep a predetermined rotational phase difference. For example, in the second and third rotary disks 502B and 502C adjacent to each other, the coin pushers 504B and 504C and the coin pushers 506B and 506C are arranged so as to keep a predetermined rotational phase difference. Specifically, as shown in FIG. 27, when a plane including the second and third rotational axis lines 332B and 332C is defined as a plane P, the coin pushers 504B and 504C are arranged so that, when the coin pusher 504B making a rotational movement reaches the plane P, the coin pusher 504C making a rotational movement reaches a position ½ of a gear wheel pitch back from the plane P. Similarly, the coin pushers 506B and 506C are arranged so that, when the coin pusher 506B making a rotational movement reaches the plane P, the coin pusher 506C making a rotational movement reaches a position ½ of a gear wheel pitch back from the plane P. The same goes for the third rotary disk 502C and the fourth rotary disk 502D, the fourth rotary disk 502D and the fifth rotary disk 502E, the fifth rotary disk 502E and the sixth rotary disk 502F, the sixth rotary disk 502E and the seventh rotary disk 502G, the seventh rotary disk 502G and the eighth rotary disk 502H, the eighth rotary disk 502H and the ninth rotary disk 502I, the ninth rotary disk 502I and the tenth rotary disk 502J, the tenth rotary disk 502J and the eleventh rotary disk 502K, and the eleventh rotary disk 502K and the twelfth rotary disk 502L.

As such, the coin pushers 504B to 504L and 506B to 506L each make a rotational movement about a corresponding one of the second to twelfth rotational axis lines 332B to 332L in synchronization to each other so as to keep a predetermined rotational phase difference. Moreover, among the coin pushers 504B to 504L and 506B to 506L, ones with their rotational axis lines adjacent to each other make a rotational movement in directions in reverse to each other.

On the back surface of the first rotary disk 502A, a gear wheel 612 having a spur gear portion 622 and a bevel gear portion 626 is coaxially provided. On the back surface of the second rotary disk 502B, a gear wheel 614 having a spur gear portion 624 and a bevel gear portion 628 is coaxially provided. These two gear wheels 612 and 614 have the same shape, and the bevel gear portions 626 and 628 each have a cone angle of approximately 30 degrees. In other words, the two bevel gear portions 626 and 628 each have a cone angle corresponding to the angle $\alpha$ formed by the first rotational axis line 332A and the second rotational axis line 332B.

The bevel gear portion 626 of the gear wheel 612 and the bevel gear portion 628 of the gear wheel 614 engage with each other. Therefore, the first and second rotary disks 502A and 502B rotate each other in directions in reverse to each other. That is, as shown in FIG. 27, the first rotary disk 502A rotates in a clockwise direction, and the second rotary disk 502B rotate in a counterclockwise direction. Therefore, the coin pushers 504A and 506A and the coin pushers 504B and 506B make a rotational movement in directions in reverse to each other. Also in the first and second rotary disks 502A and 502B, the coin pushers 504A and 504B and the coin pushers 506A and 506B are arranged so as to keep a predetermined rotational phase difference. In this manner, the coin pushers 504A and 504B and the coin pushers 506A and 506B make a rotational movement about the first and second rotational axis lines 332A and 332B, respectively, in directions in reverse to each other in synchronization with each other so as to keep the predetermined rotational phase difference.

As described above, the bevel gear portions 626 and 628 have the cone angle corresponding to the angle $\alpha$ formed by the first rotational axis line 332A and the second rotational axis line 332B. Therefore, though a simple structure in which the gear wheels 612 and 614 engage with each other, with the angle $\alpha$ being formed by the first and second rotational axis lines 332A and 332B, the first and second rotary disks 502A and 502B can be rotationally driven.

The spur gear portion 622 and the bevel gear portion 626 may be integrally formed, or can be formed by fixing separately-fabricated portions to each other with an appropriate method. In the present embodiment, they are integrally formed in view of reducing fabrication cost and increasing coaxial accuracy. The same goes for the spur gear portion 624 and the bevel gear portion 628. Also, the gear wheel 612 can be integrally formed with the rotary disk 502A, and the gear wheel 614 can be integrally formed with the gear wheel 522B. It is advantageous to integrally form them in view of reducing fabrication cost and increasing coaxial accuracy, and they are integrally formed in the present invention. However, it goes without saying that they can be formed by fixing separately-fabricated portions to each other with an appropriate method. The first and second rotary disks 502A and 502B and the gear wheels 612 and 614 can be formed in any manner as long as they can integrally rotate.

(Driving-Force Transmitting Mechanism)

Figure 34:
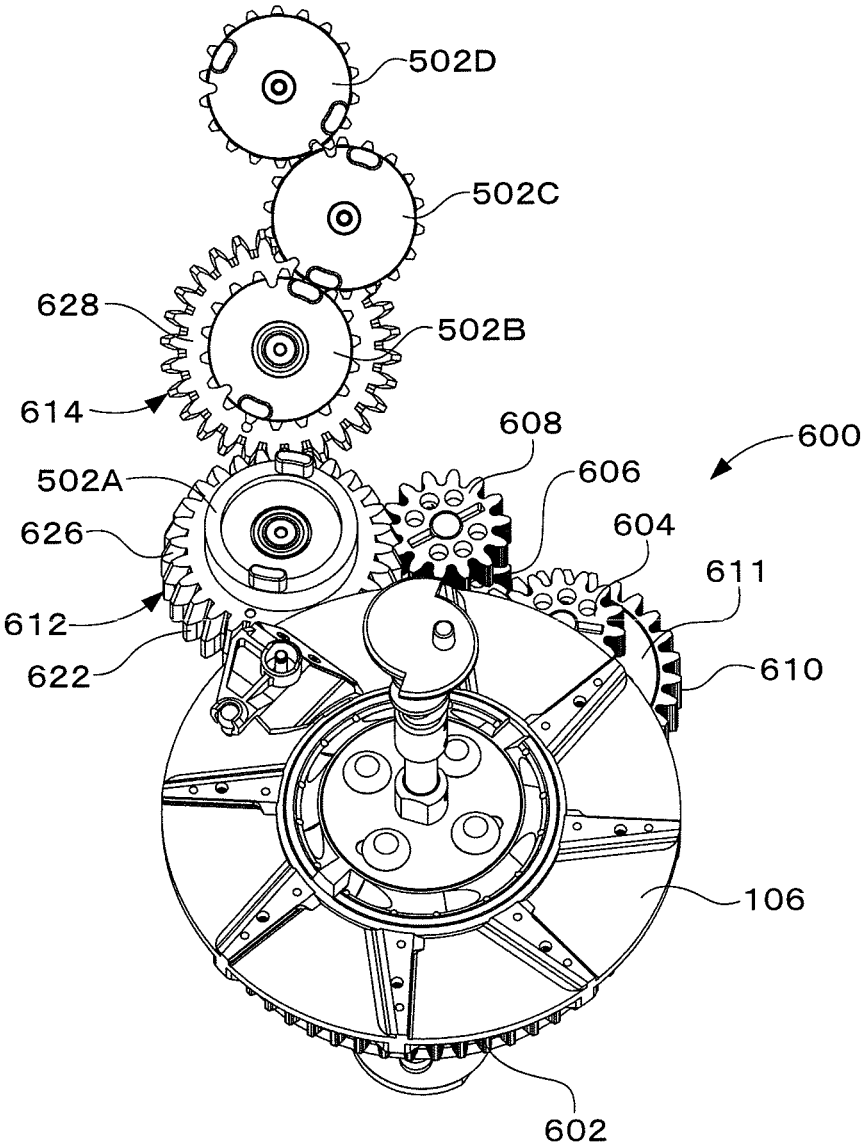
FIG. 34 is a front view of a driving-force transmitting mechanism of the coin dispensing device of FIG. 18.
Figure 35:
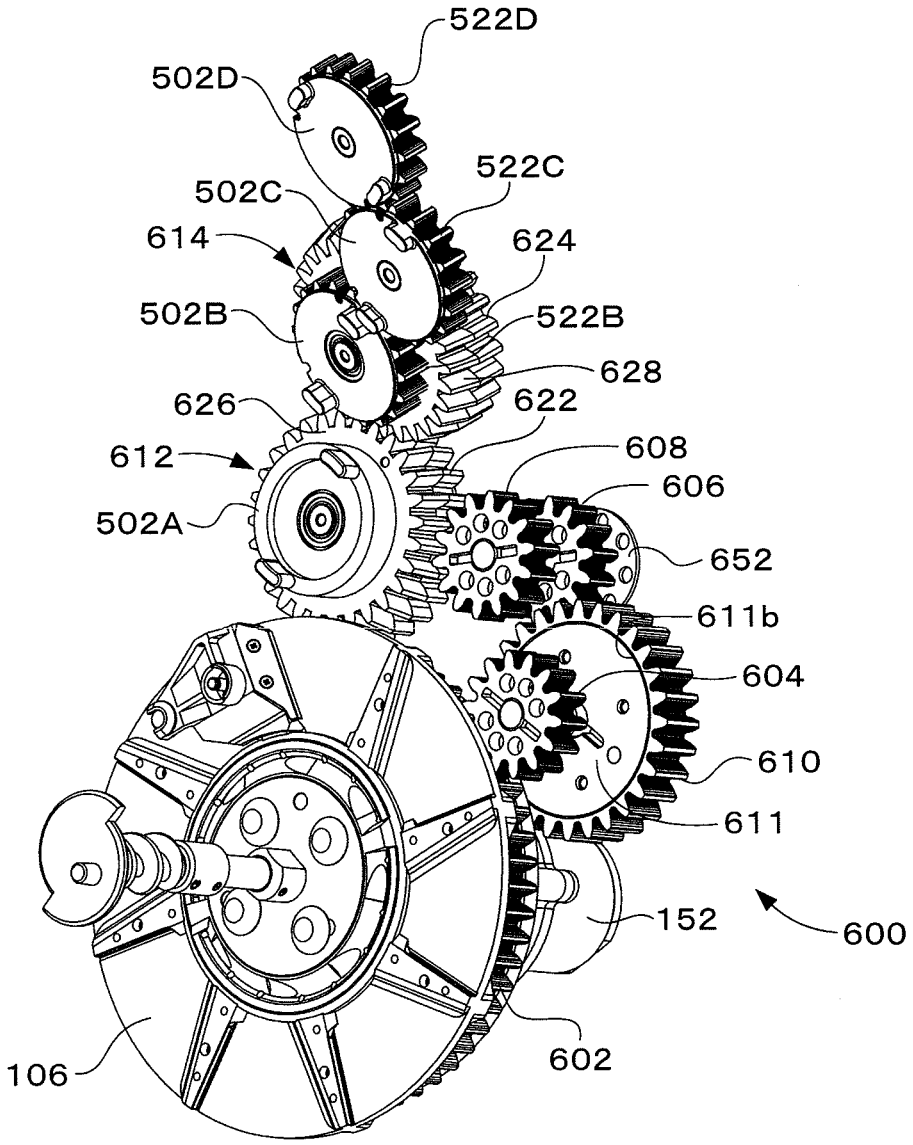
FIG. 35 is a perspective view of the driving-force transmitting mechanism of FIG. 34.
Figure 36:
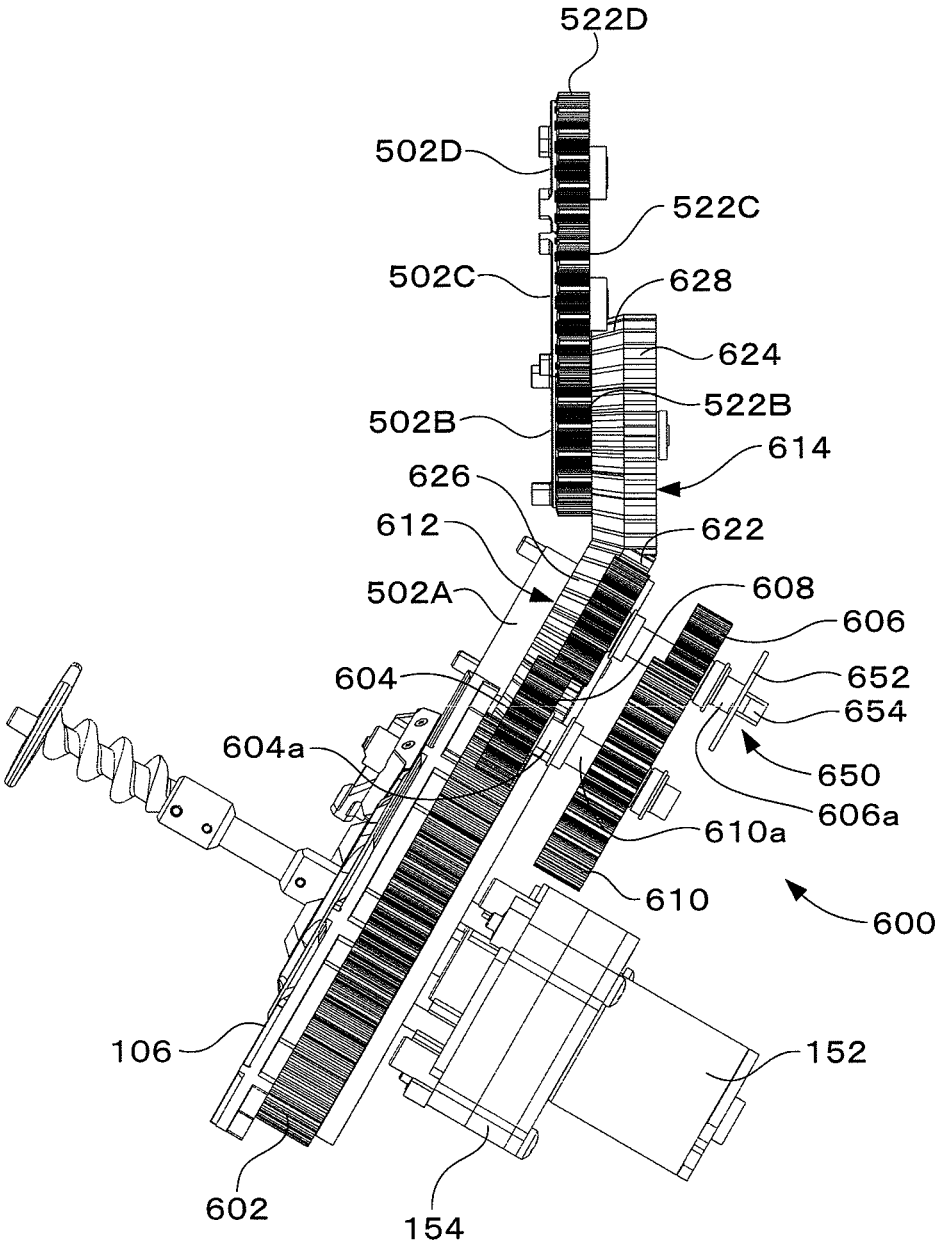
FIG. 36 is a side view of the driving-force transmitting mechanism of FIG. 34.

As shown in FIGS. 34 to 36, a driving-force transmitting mechanism 600 includes a gear wheel 602 arranged on a back surface side of the rotary disk 106 of the coin delivering device 10, a gear wheel 604 engaging with the gear wheel 602, a gear wheel 610 provided coaxially with the gear wheel 604 and having a torque limiter 611 mounted thereon, a gear wheel 606 engaging with the gear wheel 610, and a gear wheel 608 coaxially with the gear wheel 606. The gear wheel 602 is fixed to the rotary disk 106, and the gear wheel 608 engages with the spur gear portion 622 of the gear wheel 612.

When the rotary disk 106 is rotated by the driver 108 of the coin delivering device 10, the gear wheel 602 integrally rotates with the rotary disk 106, and its rotational driving force is transmitted via the gear wheels 604, 610, 606, and 608 to the gear wheel 612. The gear wheel 612 having the rotational driving force transmitted thereto rotates, and its rotational driving force is transmitted via the gear wheel 614 to the gear wheels 522B to 522L. With this, all of the gear wheels 612 and 614 and the gear wheels 522B to 522L rotate, thereby causing all of the first to twelfth rotary disks 502A to 502L to rotate.

The driving-force transmitting mechanism 600 is configured so that the rotary disk 106 of the coin delivering device 10 and the first rotary disk 502A of the coin transferring device 20 have a predetermined rotation speed difference. That is, the rotation speeds of the rotary disk 106 and the first rotary disk 502A are set so that the first rotary disk 502A rotates 180 degrees every time the rotary disk 106 rotates 45 degrees. With the rotation speeds being set as described above, when each of eight pushing edges 138 included in the rotary disk 106 delivers a coin in cooperation with the coin receiver 112, the coin pushers 504A and 506A each move to an optimum position for pushing each delivered coin. In other words, all of the coins delivered by each of the eight pushing edges 138 included in the rotary disk 106 can be reliably pushed by either one of the coin pushers 504A and 506A.

Note that even when the overload preventing function of the driver 108 is activated to reversely rotate the rotary disk 106, the first to twelfth rotary disks 502A to 502L are also reversely rotated. When the first to twelfth rotary disks 502A to 502L are reversely rotated, the coins in the coin guide path 210 are pushed in a reverse direction by the coin pushers 504A to 504L and 506A to 506L. Then, the pushed coins are transferred from the coin ejection opening 204 toward the coin reception opening 202, and part of the coins are returned onto the rotary disk 106 via the coin delivery port 190. Also in this case, an optimum positional relation between the rotary disk 106 and the first rotary disk 502A described above is kept, and therefore the coins in the coin guide path 210 are smoothly moved onto the rotary disk 106.

To a center shaft 610*a* as an input shaft of the torque limiter 611, a rotating shaft 604*a* of the gear wheel 604 is connected and fixed. In an peripheral surface 611*b* as an output shaft of the torque limiter 611, a fitting hole (not shown) of the gear wheel 610 fits to be fixed. With this, when an excessive torque equal to or larger than a predetermined value acts on the gear wheel 604, that torque is interrupted to cause the gear wheel 604 to idle running. In other words, when coin biting or the like occurs in the coin transferring device 20 to cause an excessive rotation resistance equal to or larger than a predetermined value to be added to the first to twelfth rotary disks 502A to 502L, a rotational force is escaped between an input axis and an output axis of the torque limiter 111, thereby forcibly preventing the first to twelfth rotary disks 502A to 502L from rotating. With this, an excessive load is not put on an associated component, thereby advantageously preventing component damage and improving durability. Furthermore, since an excessive load is not exerted, component strength to be required can be small, thereby advantageously decreasing component size and, in turn, decreasing the size of the entire device.

As shown in FIG. 36, the rotating shaft 606*a* of the gear wheel 606 is provided with a rotation monitoring sensor 650 monitoring a rotation state of the first to twelfth rotary disks 502A to 502L. The rotation monitoring sensor 650 includes an encoder circular plate 652 fixed to a lower end of the rotating shaft 606*a* and a transmission photoelectric sensor 654. In the encoder circular plate 652, a plurality of penetrating holes (not shown) equidistantly provided each along its peripheral edge. The photoelectric sensor 654 is configured of a floodlight projector (not shown) emitting light toward the penetrating holes on the encoder circular plate 652 and a light receiver (not shown) receiving light from the light projector to generate an electric signal. When the first to twelfth rotary disks 502A to 502L rotate, the rotation monitoring sensor 650 outputs a pulse signal in synchronization with its rotation angle. In other words, the rotation monitoring sensor 650 functions as a sensor for monitoring the state of the rotational movement of the coin pushers 504A to 504L and 506A to 506L. By monitoring the state of this pulse signal, the activation state of the torque limiter 611 can be detected. That is, when the torque limiter 611 is in a non-activated state, a pulse signal with a predetermined cycle is outputted from the rotation monitoring sensor 650. When the torque limiter 611 is in an activated state, a pulse signal with a cycle equal to or larger than the predetermined cycle is outputted from the rotation monitoring sensor 650. Therefore, by measuring the cycle of this pulse signal, the non-activated/activated state of the torque limiter 611 can be detected. When the torque limiter 611 is activated, the electric motor 152 is stopped to stop the rotation of the rotary disk 106. With this, coin delivery from the coin delivering device 10 is suspended, and it is prevented to continuously supply coins to the coin transferring device 20 where coin biting occurs, thereby preventing unnecessary load from being exerted on an associated component and improving durability.

As the torque limiter 611, a known one can be used, such as, for example, a torque limiter having a steel ball and a recessed groove disclosed in Japanese Unexamined Patent Application Publication No. 2001-263364. In particular, one having paired recessed grooves facing each other across a rotational axis line is preferable. In this case, a non-activated state of the torque limiter 611 (that is, the state in which the steel ball is stopped in the recessed groove) occurs at a rotation angle of 180 degrees, and therefore a rotational phase difference between the rotary disk 106 of the coin delivering device 10 and the first rotary disk 502A of the coin transferring device 20 can be maintained.

(Coin Transferring Unit)

As shown in FIGS. 21 to 23, the first coin transferring unit 21 includes a first base portion 300A and a first top plate portion 400A provided on the first base portion 300A. On the first base portion 300A, as shown in FIG. 27, the first to forth rotational axis lines 332A to 332D and the first to forth rotary disks 502A to 502D are arranged. In other words, the first to fourth rotational axis lines 332A to 332D and the first to forth rotary disks 502A to 502D are arranged in the first coin transferring unit 21. The first base portion 300A has a cover body 180 formed integrally with the storing bowl 102, and a first member 306A and a second member 308A.

The cover body 180 has an inclined surface 181 formed in parallel to the upward upper surface 104U of the first mounting part 104B, and an opening 188 is formed on an upper left part of the cover body 180. Around the opening 188, a recessed part 182 having a peripheral wall 184 is formed, and part of the recessed part 182 is further retreated to form a partial annular surface 186. The recessed part 182 has a bottom surface 183 in parallel to the upward upper surface 104U of the first mounting part 104B and, in other words, as with the holding surface 134 of the rotary disk 106, has a tilt angle of approximately 60 degrees with respect to the horizontal plane. The depth of the recessed part 182 (in other words, the height of the peripheral wall 184) is set larger than the thickness of a thickest coin. In the opening 188, the rotary disk 502A is arranged. On an upper right part of the recessed part 182, the coin reception guide member 450 described above is arranged.

The first member 306A of the first base portion 300A is formed of left and right divisional portions 306Aa and 306Ab. With these divisional portions 306Aa and 306Ab being put together, a part 315A of a through hole 315 shown in FIG. 24 is formed. The second member 308A of the first base portion 300A has a flat-shaped first plate part 308Aa and paired second plate parts 308Ab extending from both side ends of the first plate part 308Aa at a right angle. On the first plate part 308Aa, third and fourth spindles 334C and 334D are provided. In the shaft insertion hole 510 of the third rotary disk 502C and the gear wheel 522C, the third spindle 334C is inserted. In the shaft insertion hole 510 of the fourth rotary disk 502D and the gear wheel 522D, the fourth spindle 334D is inserted. At a lower part of the first plate part 308Aa, an opening 308Ac is formed. With the second plate part 308Ab being fixed to the second mounting part 104C, the second member 308A is mounted on the second mounting part 104C. In the second mounting part 104C, a second spindle 334B passing through the opening 308Ac to protrude from the first plate part 308Aa is provided. In the shaft insertion hole 510 of the second rotary disk 502B, the gear wheel 522B, and the gear wheel 614, the second spindle 334B is inserted. At an upper end of the second mounting part 104C, as shown in FIG. 22, a portion 104Ca bent in an L shape is formed. With the second member 308A being mounted on the second mounting part 104C, a space 308Ad is formed between the first plate part 308Aa of the second member 308A and the second mounting part 104C of the mount base 104. In the space 308Ad, part of the gear wheel 614 is accommodated. The first member 306A of the first base portion 300A is fixed onto the second member 308A with a lower part being arranged on the partial annular surface 186.

On an upper left part of the first mounting part 104B of the mount base 104, the First spindle 334A is provided. The first spindle 334A is arranged so as to be coaxial with the opening 188 of the cover body 180 with the cover body 180 (that is, the storing bowl 102) being mounted on the mount base 104. In a shaft insertion hole (not shown) of the first rotary disk 502A and the gear wheel 612, the first spindle 334A is inserted. With this, the first rotary disk 502A is arranged in the opening 188 of the cover body 180. Furthermore, on the first mounting part 104B of the mount base 104, the gear wheel 604 and the gear wheel 608 are arranged.

The first top plate portion 400A has a first coin guide groove portion 406A for forming the first coin guide path portion 210A corresponding to the first to fourth rotational axis lines 332A to 332D. The second curved surface portion 228 described above is formed on the first top plate portion 400A. In the first top plate portion 400A, a groove 422 is formed preventing a contact when the coin pushers 504A to 504D and 506A to 506D make a rotational movement about the first to fourth rotational axis lines 332A to 332D.

As shown in FIG. 21, the first coin transferring unit 21 has a connecting part 251 for connecting the second coin transferring unit 22 to its upper end. In the connecting part 251, the first member 306A of the first base portion 300A has an end face 322A functioning as an abutting surface when the first and second coin transferring units 21 and 22 are connected to each other. As shown in FIG. 23, the end face 322A is configured to include a first end face portion 322Aa positioned at an upper left end of the first coin transferring unit 21 and a second end face portion 322Ab positioned at an upper right end of the first coin transferring unit 21. The second end face portion 322Ab is arranged at a position retreated downward along a direction in which the first guide path portion 210A (in other words, the coin guide path 210) extends, with respect to the first end face portion 322Aa. In other words, a step is formed between the first and second end face portions 322Aa and 322Ab. In the end face 322A, an opening 253 exposing the gear wheel 522D is formed. Part of the tooth row of the gear wheel 522D is exposed to outside via the opening 253.

In the connecting part 251, notched edges 252*a* and 252*b* are formed in the second member 308A of the first top plate portion 400A and the first base portion 300A. The notched edges 252*a* and 252*b* are each formed in an arc shape along a contact preventing portion of the coin pushers 504D and 506D of the groove 422, and extend in an upper direction and a right direction from its arced portion. In other words, part of the notched edges 252*a* and 252*b* is formed along a peripheral edge of the fourth rotary disk 502D. Between the notched edge 252*a* and the first member 306A, an coin ejection opening 211Aa of the first coin guide path portion 210A is formed.

At an upper right end of the first member 306A of the first base portion 300A, a connection protruding part 258 is provided protruding upward from the second end face portion 322Ab and having a screw insertion hole 259 formed therein. At an upper left end of the first coin transferring unit 21, between the first top plate portion 400A and the second member 308A of the first base portion 300A, a groove part 255 is formed in which the connection protruding part 268 of the second coin transferring unit 22, which will be described further below, can be inserted. In an upper left part of the First top plate portion 400A, a screw insertion hole 256 is formed, and a screw hole 257 is formed in an upper left part of the second member 308A of the first base portion 300A.

Figure 29:
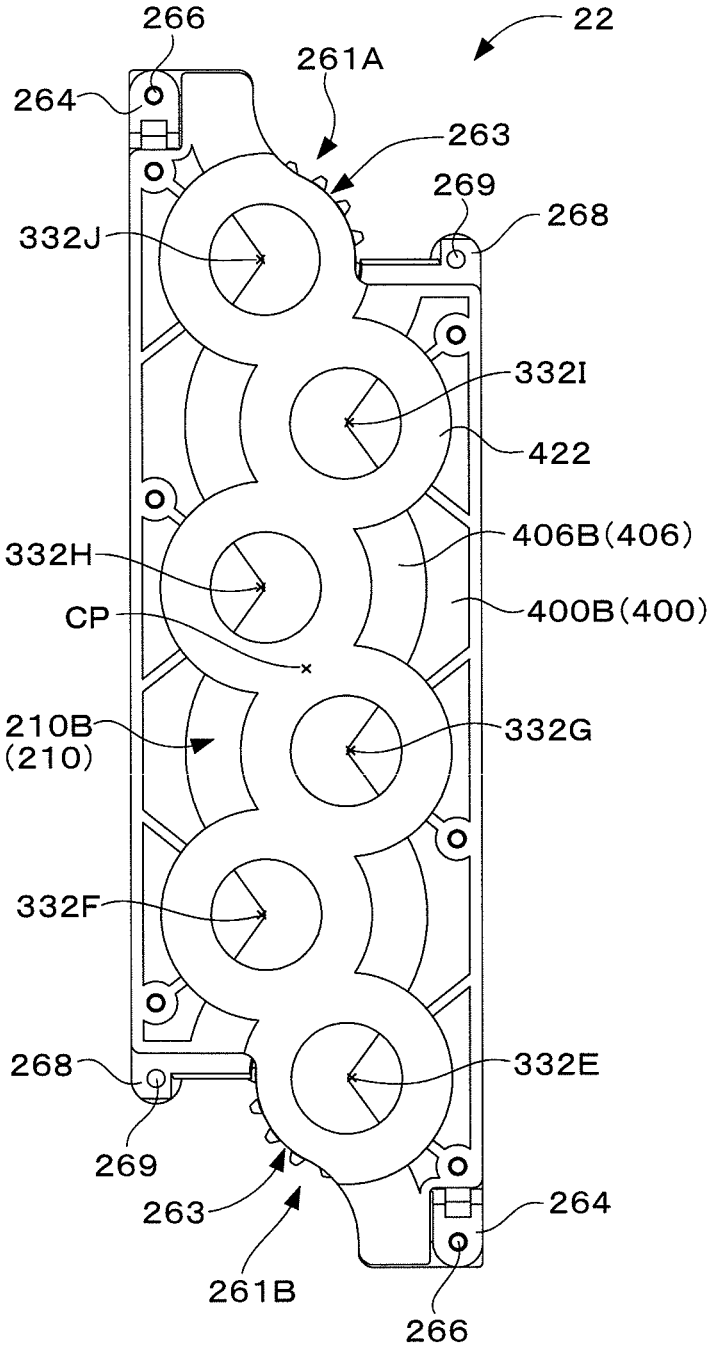
FIG. 29 is a front view of a second coin transferring unit of the coin transferring device configuring the coin dispensing device of FIG. 18.
Figure 30:
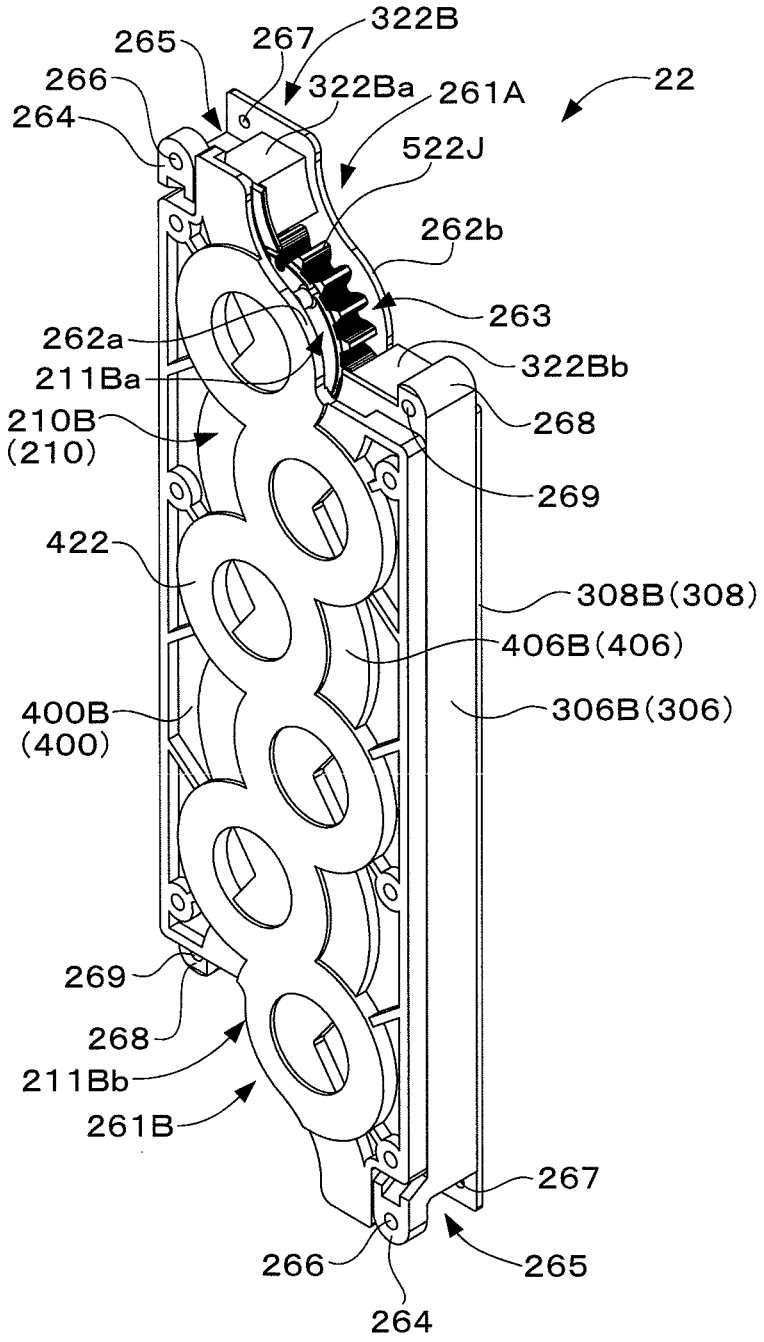
FIG. 30 is a perspective view of the second coin transferring unit of FIG. 29.

As shown in FIGS. 29 and 30, the second coin transferring unit 22 includes a second base portion 300B and a second top plate portion 400B provided on the second base portion 300B. On the second base portion 300B, as shown in FIG. 27, the fifth to tenth rotational axis lines 332E to 332J and the fifth to tenth rotary disks 502E to 502J are arranged. In other words, the fifth to tenth rotational axis lines 332E to 332J and the fifth to tenth rotary disks 502E to 502J are arranged in the second coin transferring unit 22. The second base portion 300B has a first member 306B and a second member 308B.

In the first member 306B of the second base portion 300B, a part (not shown) of the through hole 315 shown in FIG. 24 is formed. The second member 308B is provided with the fifth to tenth spindles 334E to 334J. In the shaft insertion holes 510 of the fifth rotary disk 502E and the gear 522E, the fifth spindle 334E is inserted. Similarly, in the shaft insertion holes 510 of the sixth to tenth rotary disks 502F to 502J and the gear wheels 522F to 522J, the sixth to tenth spindles 334F to 334J are inserted.

The second top plate portion 400B has a second coin guide groove portion 406B for forming a second coin guide path portion 210B corresponding to the fifth to tenth rotational axis lines 332E to 332J. In the second top plate portion 400B, a groove 422 is formed preventing a contact when the coin pushers 504E to 504J and 506E to 506J make a rotational movement about the fifth to tenth rotational axis lines 332E to 332J.

The second coin transferring unit 22 has connecting parts 261A and 261B for connecting the first and third coin transferring units 21 and 23 at an upper end and a lower end. The connecting parts 261A and 261B are rotationally symmetrical to a symmetric axis line CP (that is, symmetrical with respect to a point) and also has the same structure. Therefore, only the connecting part 261A is described, and description of the connecting part 261B is omitted.

In the connecting part 261A, the first member 306B of the second base portion 300B has an end face 322B functioning as an abutting surface when the second and third coin transferring units 22 and 23 are connected to each other. The end face 322B is configured to include a first end face portion 322Ba positioned at an upper left end of the second coin transferring unit 22, and a second end face portion 322Bb positioned at an upper right end of the second coin transferring unit 22. The second end face portion 322Bb is arranged at a position retreated downward along a direction in which the second coin guide path portion 210B (in other words, the coin guide path 210) extends, with respect to the first end face portion 322Ba. In other words, a step is formed between the first and second end face portions 322Ba and 322Bb. In the end face 322B, an opening 263 exposing the gear wheel 522J is formed. A part of the tooth row of the gear wheel 522J is exposed to the outside via the opening 263.

In the connecting part 261A, notched edges 262*a* and 262*b* are formed in the second members 308B of the second top plate portion 400B and the second base portion 300B. The notched edges 262*a* and 262*b* are each formed in an arc shape along a contact preventing portion of the coin pushers 504J and 506J of the groove 422, and extend in an upper direction and a right direction from its arc-shaped portion. In other words, a part of the notched edges 262*a* and 262*b* is formed along a peripheral edge of the tenth rotary disk 502J. Between the notched edge 262*a* and the first member 306B, an coin ejection opening 211Ba of the second coin guide path portion 210B is formed. Note that in the connecting part 261B, an coin reception opening 211Bb of the second coin guide path portion 210B is formed between the notched edge 262*a* and the first member 306B.

At an upper right end of the first member 306B of the second base portion 300B, a connection protruding part 268 is provided protruding upward from the second end face portion 322Bb and having a screw insertion hole 269 formed therein. At an upper left end of the second coin transferring unit 22, in the first member 306B of the second base portion 300B, a holding piece 264 is formed protruding from its surface to a second top plate portion 400B side and extending in an approximately L shape. Between this holding piece 264 and the second member 308B, a groove part 265 is formed into which a connection protruding part 278 of the third coin transferring unit 23, which will be described further below, can be inserted. In the second base portion 300B, a screw insertion hole 266 is formed in the holding piece 264 of the first member 306B, and a screw hole 267 is formed in an upper left part of the second member 308B.

Figure 31:
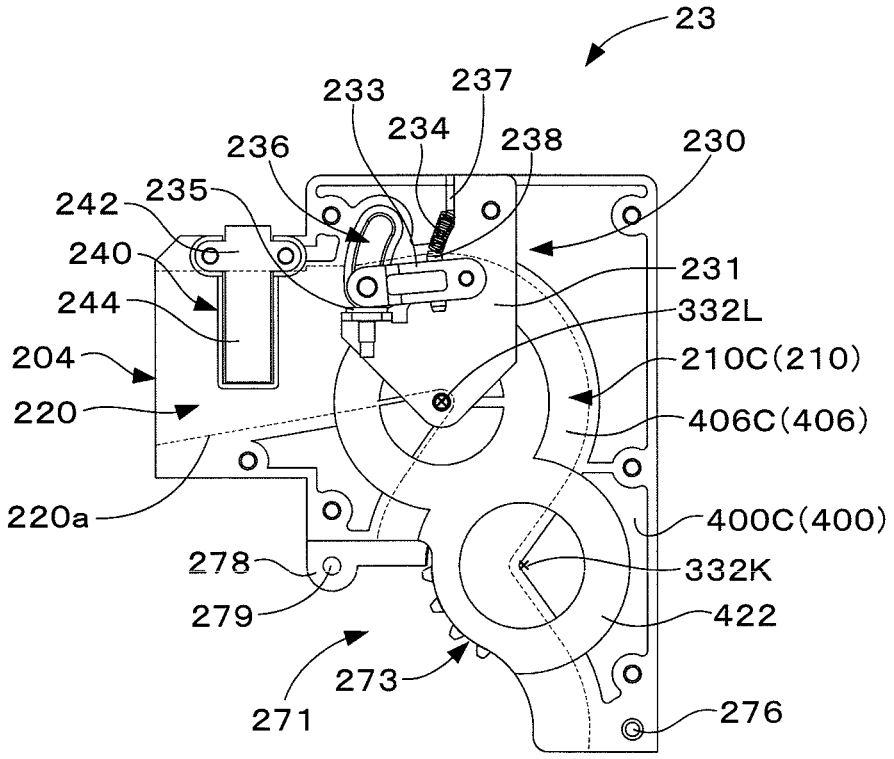
FIG. 31 is a front view of a third coin transferring unit of the coin transferring device configuring the coin dispensing device of FIG. 18.
Figure 32:
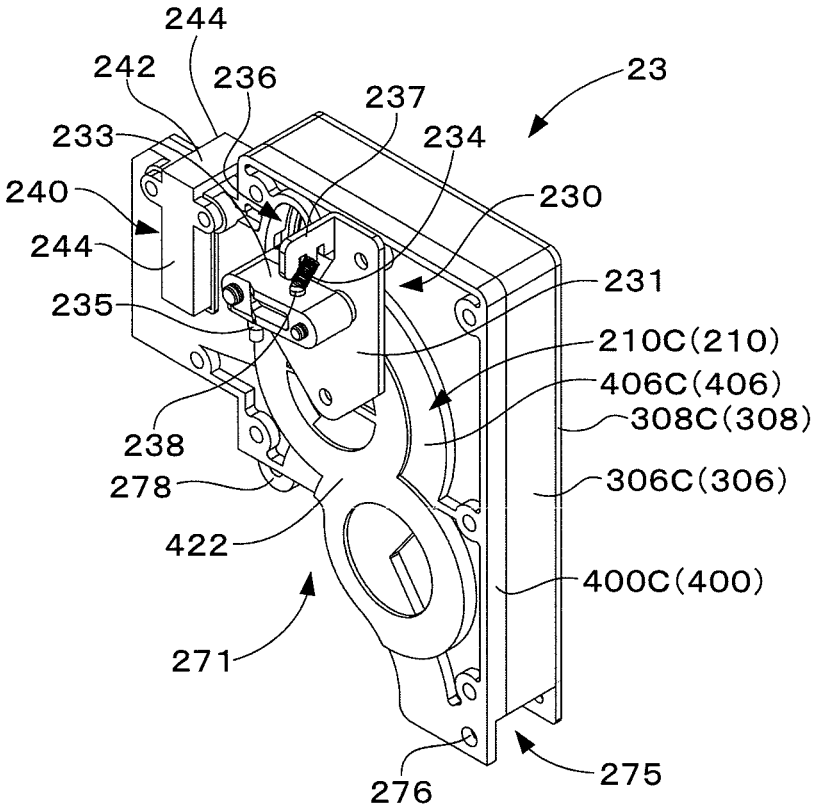
FIG. 32 is a perspective view of the third coin transferring unit of FIG. 31 when viewed from an upper right side.
Figure 33:
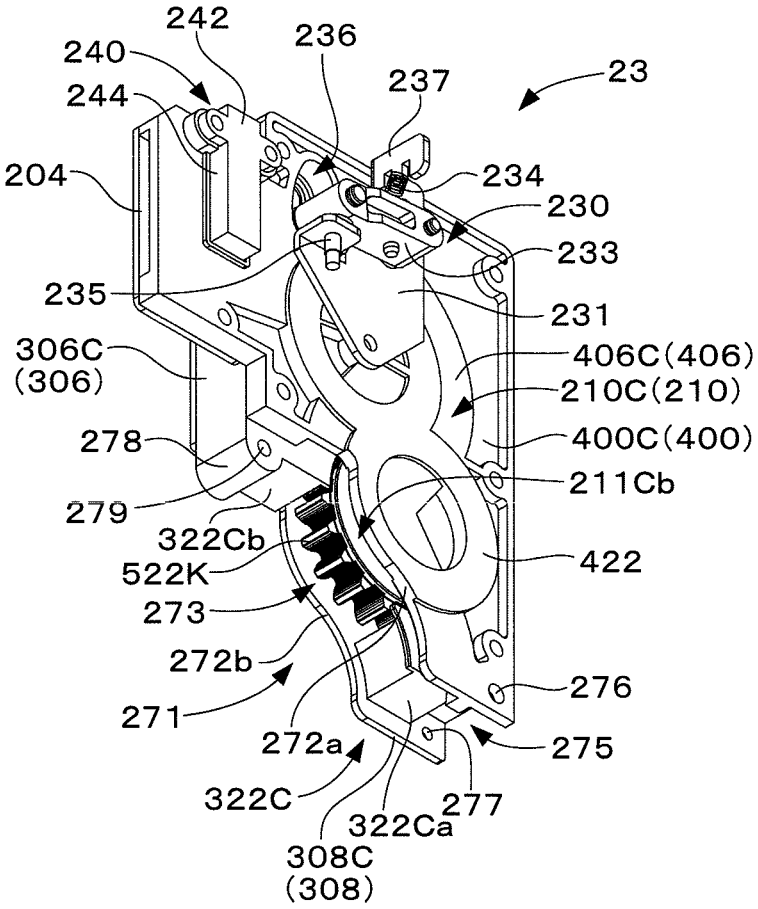
FIG. 33 is a perspective view of the third coin transferring unit of FIG. 31 when viewed from a lower left side.

The third coin transferring unit 23 includes, as shown in FIGS. 31 and 33, a third base portion 300C, a third top plate portion 400C provided on the third base portion 300C, the coin discharger 230, and the coin dispensing detection sensor 240. In the third base portion 300C, as shown in FIG. 27, the eleventh and twelfth rotation axis lines 332K and 332L and the eleventh and twelfth rotary disks 502K and 502L are arranged. In other words, the eleventh and twelfth rotational axis lines 332K and 332L and the eleventh and twelfth rotary disks 502K and 502L are arranged in the third coin transferring unit 23. The third base portion 300C has a first member 306C and a second member 308C.

In the first member 306C of the third base portion 300C, a part (not shown) of the through hole 315 shown in FIG. 24 is formed. In the second member 308C, the eleventh and twelfth spindles 334K and 334L are provided. In the shaft insertion holes 510 of the eleventh rotary disk 502K and the gear wheel 522K, the eleventh spindle 334K is inserted. In the shaft insertion holes 510 of the twelfth rotary disk 502L and the gear wheel 522L, the twelfth spindle 334L is inserted.

The third top plate portion 400C has a third guide groove portion 406C for forming a third coin guide path portion 210C corresponding to the eleventh and twelfth rotational axis lines 332K and 332L. In the top plate portion 400C, a groove 42 is formed preventing a contact when the coin pushers 504K, 504L, 506K, and 506L make a rotational movement about the eleventh and twelfth rotational axis lines 332K and 332L.

The third coin guide path portion 210*c* is curved to a left side while centering on the twelfth rotational axis line 332L, and extends approximately just horizontally toward the coin ejection opening 204 arranged on a left side. A region on the left side of the twelfth rotational axis line 332L in the third coin guide path portion 210C has a width wg wider as is closer to an coin ejection opening 204 side. In other words, the third coin guide path portion 210C includes an coin ejection opening path region 220 having a coin guide surface 220*a* tilted diagonally downward toward the coin ejection opening 204. Thereby, coins can be easily discharged diagonally downward from the coin ejection opening 204.

The third coin transferring unit 23 has a connecting part 271 provided at its lower end, the connecting part 271 for connecting the second coin transferring unit 22. In the connecting part 271, the first member 306C of the third base portion 300C has an end face 322C functioning as an abutting surface when the second and third coin transferring units 22 and 23 are connected to each other. The end face 322C is configured to include a first end face portion 322Ca positioned at a lower right end of the third coin transferring unit 23, and a second end face portion 322Cb positioned at a lower left end of the third coin transferring unit 23. The second end face portion 322Cb is arranged at a position retreated upward along a direction in which the third coin guiding path portion 210C (in other words, the coin guide path 210) extends, with respect to the first end face portion 322Ca. In other words, a step is formed between the first and second end face portions 322Ca and 322Cb. In the end face 322C, an opening 273 exposing the gear wheel 522K is formed. A part of the tooth row of the gear wheel 522K is exposed to the outside via the opening 273.

In the connecting part 271, notched edges 272*a* and 272*b* are formed in the second members 308C of the third top plate portion 400C and the third base portion 300C. The notched edges 272*a* and 272*b* are each formed in an arc shape along a contact preventing portion of the coin pushers 504K and 506K of the groove 422, and extend in an lower direction and a left direction from its arc-shaped portion. In other words, a part of the notched edges 272*a* and 272*b* is formed along a peripheral edge of the eleventh rotary disk 502K. Between the notched edge 272*a* and the first member 306C, an coin reception opening 211Ca of the third coin guide path portion 210C is formed.

At a lower left end of the first member 306C of the third base portion 300C, a connection protruding part 278 is provided protruding downward from the second end face portion 322Cb and having a screw insertion hole 279 formed therein. At a lower right end of the third coin transferring unit 23, between the third top plate portion 400C and the second member 308C of the third base portion 300C, a groove part 275 is formed in to which the connection protruding part 268 of the second coin transferring unit 22 can be inserted. At a lower right part of the third top plate portion 400C, a screw insertion hole 276 is formed. At a lower right part of the second member 308C of the third base portion 300C, a screw hole 277 is formed.

The coin discharger 230 is composed of a frame 231 for mounting components, an ejection roller 232 (refer to FIG. 24) elastically making contact with the peripheral surface of a coin, a turning lever 233 turnably supporting the ejection roller 232 and turning about a spindle (not shown), a spiral spring 234 pressing the turning lever 233 to an coin ejection opening path region 220 side so that the ejection roller 232 comes to the coin ejection opening path region 220 of the third coin guide path portion 210C, and a stopper 235 for receiving and holding the turning lever 233 at a standing position with the ejection roller 232 coming to the coin ejection opening path region 220. The frame 231 is provided with a fastening plate 237 bent so as to form a right angle with the surface of the frame 231 and having a downward E shape. In an upper part of the turning lever 233, a stop pin 238 is provided. The spiral spring 234 has one end suspended in a groove of the fastening plate 237, and the other end suspended in the stop pin 238. The ejection roller 232 is exposed to the coin ejection opening path region 220 of the third coin guide path portion 210C via a long aperture for ejection roller 236 in an arc shape formed in the third top plate portion 400C. The coin discharger 230 is mounted on the third coin transferring unit 23 by fixing the frame 231 to the third base portion 300C with a screw (not shown) penetrating through the third top plate portion 400C.

The coin dispensing detection sensor 240 is arranged so as to go across the coin ejection opening path region 220 of the third coin guide path portion 210C immediately before the coin ejection opening 204. The coin dispensing detection sensor 240 is a photoelectric sensor having a channel-type-shaped exterior case 242 made of resin and having a floodlight projector incorporated in one of two columnar parts 244 and a light receiver incorporated in the other thereof, with these parts being arranged to face each other. In the coin ejection opening path region 220, a coin interrupts an optical path when passing through between the two columnar parts 244 and, based on a detection signal outputted based on the interruption, coins are detected one by one.

(Connection of Coin Transferring Unit)

When the first coin transferring unit 21 and the second coin transferring unit 22 are connected together, with the gear wheel 522D exposed from the opening 253 of the connecting part 251 and the gear wheel 522E exposed from the opening 263 of the connecting part 261B engaging with each other, the protruding part 268 of the connecting part 261B is inserted in the groove part 255 of the connecting part 251, and the protruding part 258 of the connecting part 251 is inserted in the groove part 265 of the connecting part 261B. When the gear wheels 552D and 552E engage with each other, the positions of the teeth of the gear wheels 552D and 552E are adjusted so that the above-described predetermined phase difference occurs between the fourth rotary disk 502D and the fifth rotary disk 502E. In this state, when the second coin transferring unit 22 is pushed onto the first coin transferring unit 21, the end face 322A of the connecting part 251 abuts on the end face 322B of the connecting part 261B to stop insertion. In other words, the end faces 322A and 322B function as abutting surfaces to achieve positioning. Furthermore, a screw (not shown) inserted in the screw insertion hole 256 of the connecting part 251 and the screw insertion hole 269 of the connecting part 261B is screwed in the screw hole 257 of the connecting part 251. Similarly, a screw (not shown) inserted in the screw insertion hole 266 of the connecting part 261B and the screw insertion hole 259 of the connecting part 251 is screwed in the screw hole 267 of the connecting part 261B. With this, the second coin transferring unit 22 is fixed to the first coin transferring unit 21.

When the second coin transferring unit 22 and the third coin transferring unit 23 are connected together, with the gear wheel 522J exposed from the opening 263 of the connecting part 261A and the gear wheel 522K exposed from the opening 273 of the connecting part 271 engaging with each other, the protruding part 278 of the connecting part 271 is inserted in the groove part 265 of the connecting part 261A, and the protruding part 268 of the connecting part 261A is inserted in the groove part 275 of the connecting part 271. When the gear wheels 552J and 552K engage with each other, the positions of the teeth of the gear wheels 552J and 552K are adjusted so that the above-described predetermined phase difference occurs between the tenth rotary disk 502J and the eleventh rotary disk 502K. In this state, when the third coin transferring unit 23 is pushed onto the second coin transferring unit 22, the end face 322B of the connecting part 261A abuts on the end face 322C of the connecting part 271 to stop insertion. In other words, the end faces 322B and 322C function as abutting surfaces to achieve positioning. Furthermore, a screw (not shown) inserted in the screw insertion hole 266 of the connecting part 261A and the screw insertion hole 279 of the connecting part 271 is screwed in the screw hole 267 of the connecting part 261A. Similarly, a screw (not shown) inserted in the screw insertion hole 276 of the connecting part 271 and the screw insertion hole 269 of the connecting part 261A is screwed in the screw hole 277 of the connecting part 271. With this, the third coin transferring unit 23 is fixed to the second coin transferring unit 22.

In this manner, the first and third coin transferring units 21 and 23 are connected together via the second coin transferring unit 22, thereby achieving the states shown in FIGS. 18 to 20 and FIGS. 24 to 27. That is, the first to third base portions 300A to 300C configure the base body 300, and the first to third top plate portions 400A to 400C configure the top plate 400. The first to third coin guide path portions 210A to 210C communicate with each other to configure the coin guide path 210. Also, as shown in FIG. 24, in the base body 300, the first members 306A to 306C of the first to third base portions 300A to 300C configure the first member 306, and the second members 308A to 308C of the first to third base portions 300A to 300C configure the second member 308.

That is, the base body 300 has a structure in which the first member 306 is put on the second member 308, and the through hole 315 is formed in the first member 306. The through hole 315 has a flat shape with eleven circular holes having the same inner diameter connected in a zigzag manner as partially overlapping in a zigzag manner and, as shown in FIG. 28, has a first opening 315*a* with a small inner diameter arranged on a front surface side of the base body 300 and a second opening 315*b* with a larger inner diameter arranged on a back surface side of the base body 300. The back surface side of the through hole 315 is closed with the second member 308, and a recessed part 316 is formed in the base body 300.

On the front surface 302 side of the based body 300, the second to twelfth rotary disks 502B to 502L are accommodated in the first opening 315*a*, and the gear wheels 522B to 522L are accommodated in the second opening 315*b*. In other words, the second to twelfth rotary disks 502B to 502L and the gear wheels 522B to 522L are accommodated in the recessed part 316. On the bottom surface 318 of the recessed part 316, the third to twelfth spindles 334C to 334L are provided. As shown in FIGS. 25 and 28, the third to twelfth spindles 334C to 334L are fixed to the base body 300 with a fixing screw 310 inserted in a screw hole 340 from the back surface 304 side of the base body 300 via the second member 308.

The respective surfaces of the first to twelfth rotary disks 502A to 502L are arranged so as to be approximately flush with the front surface 302 of the base body 300. Therefore, the coin pushers 504A to 504L and 506A to 506L provided on the surfaces of the first to twelfth rotary disks 502A to 502L, respectively, protrude upward from the front surface 302 of the base body 300. In other words, the coin pushers 504A to 504L and 506A to 506L each protrude into the coin guide path 210.

The coin pushers 504A to 504L and 506A to 506L protruding into the coin guide path 210 make a rotational movement in accordance with the rotation of the first to twelfth rotary disks 502A to 502L to push the coins in the coin guide path 210. The pushed coins are moved through the coin guide path 210 while the coins have their peripheral surfaces guided with the left and right guide surfaces 212 and 214 and have their front surfaces and back surfaces guided with the front and back guide surfaces 216 and 218. In this case, the range of outer diameters or thicknesses of transferrable coins is widened. That is, since the coin pushers 504A to 504L and 506A to 506L protruding into the coin guide path 210 are arranged between the left and right guide surfaces 212 and 214, if a coin has an outer diameter in a range of being larger than the space between the left and right guide surfaces 212 and 214 and the coin pushers 504A to 504L and 506A to 506L (in other words, larger than a space occurring between the left and right guide surfaces 212 and 214 and a trail of a rotational movement of each of the coin pushers 504A to 504L and 506A to 506L) and being smaller than a space between the left and right guide surfaces 212 and 214, such a coin can be moved and transferred as being supported by either one of the left and right guide surfaces 212 and 214 and the coin pushers 504A to 504L and 506A to 506L. Therefore, the range of outer diameters of the transferrable coins is widened. On the other hand, since the coins are pushed and transferred by each of the coin pushers 504A to 504L and 506A to 506L one by one, adjacent coins are prevented from overlapping each other in the coin guide path 210. Therefore, even if a space between the front and back guide surfaces 216 and 218 is set widely, coin clogging does not occur. Therefore, the range of thicknesses of transferrable coins can be widened.

(Operation of Coin Dispensing Device)

Next, the operation of the coin dispensing device 1 is described with reference to FIGS. 37 to 47. In an actual operation, many coins are stored so as to be stacked in the storing bowl 102. However, for the purpose of simplifying description, it is assumed herein that four coins C1 to C4 are stored in the storing bowl 102.

Figure 37:
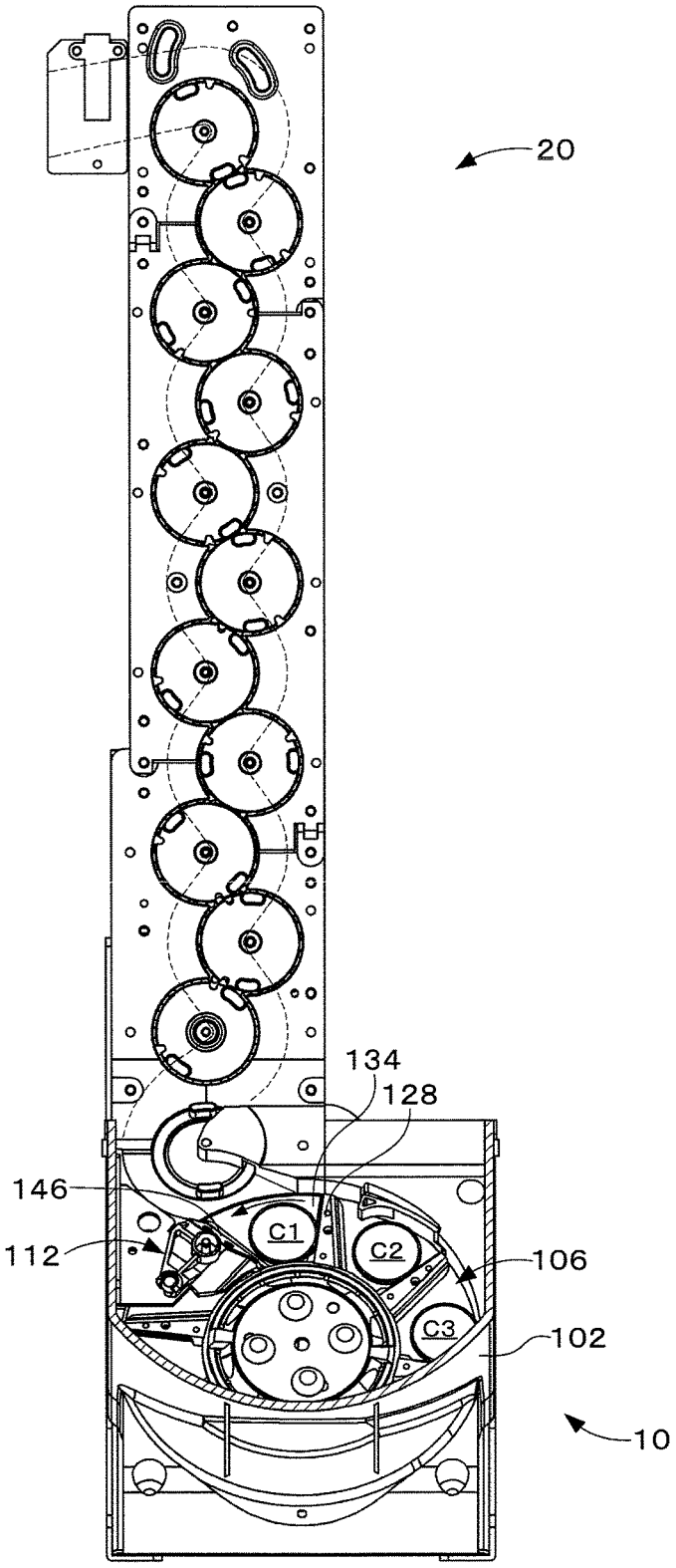
FIG. 37 is a front view for describing the operation of the coin dispensing device of FIG. 18 with the top plate removed.

FIG. 37 shows the state in which the coins C1 to C4 are transferred by the rotary disk 106 of the coin delivering device 10, with the coins C1 to C4 (where C4 is not shown) being held on four holding surfaces 134 among eight holding surfaces 134 included in the rotary disk 106. The coins C1 to C4 are moved by being pushed by the coin stoppers 128 of the rotary disk 106 rotating in a counterclockwise direction, and the coin C1 comes close to the receiving edge 146 of the coin receiver 112.

Figure 38:
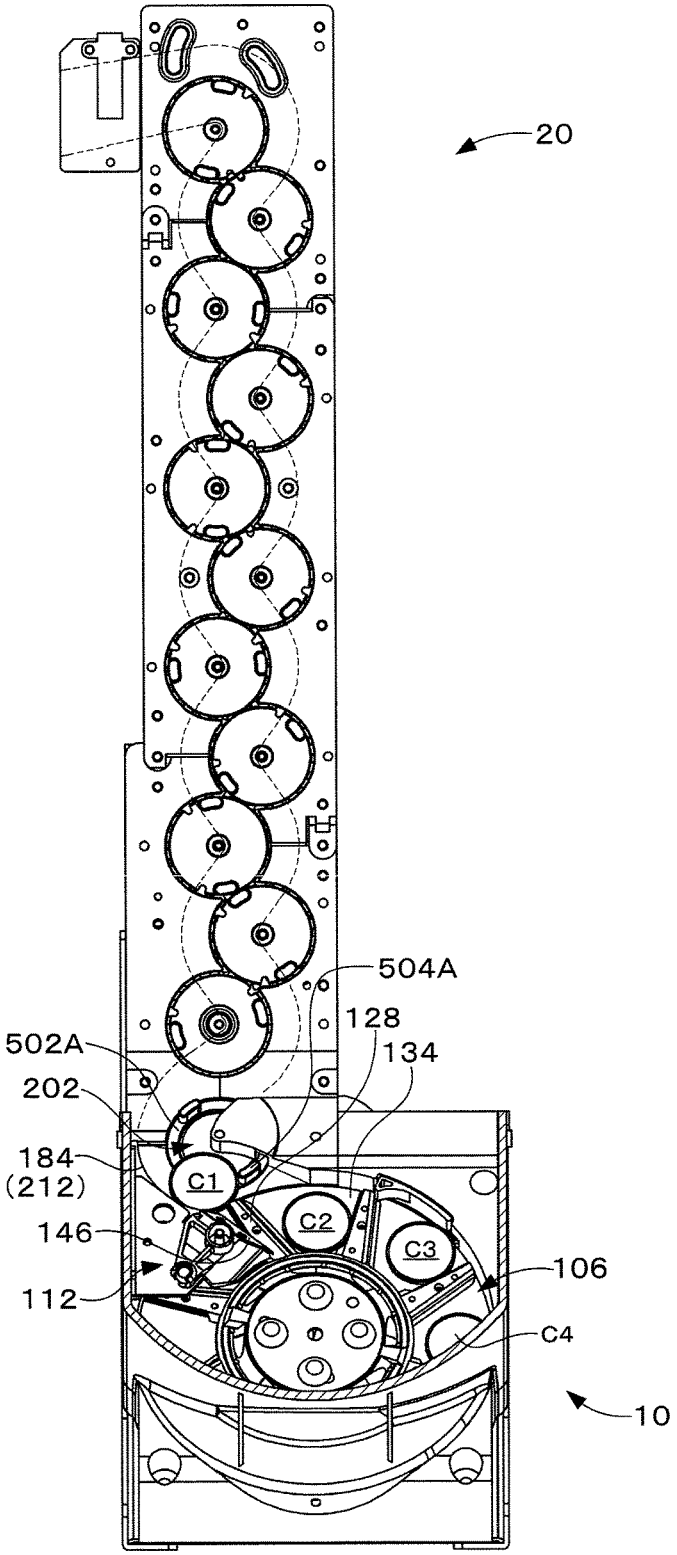
FIG. 38 is a front view continued from FIG. 37 for describing the operation of the coin dispensing device of FIG. 18 with the top plate removed.

Furthermore, when the rotary disk 106 rotates, as shown in FIG. 38, the coin C1 is pushed by the coin stopper 128 as being in contact with the receiving edge 146 of the coin receiver 112, and is moved in a peripheral direction of the rotary disk 106. Then, while being pushed to the outside of the rotary disk 106, the coin C1 is caused to stand still at a passing position supported by the tip of the coin stopper 128 and the peripheral wall 184. When the coin pusher 504A making a rotational movement in a clockwise direction comes in contact with the peripheral surface of the coin C1 positioned at this passing position, the coin C1 is pushed by the coin pusher 504A.

Figure 39:
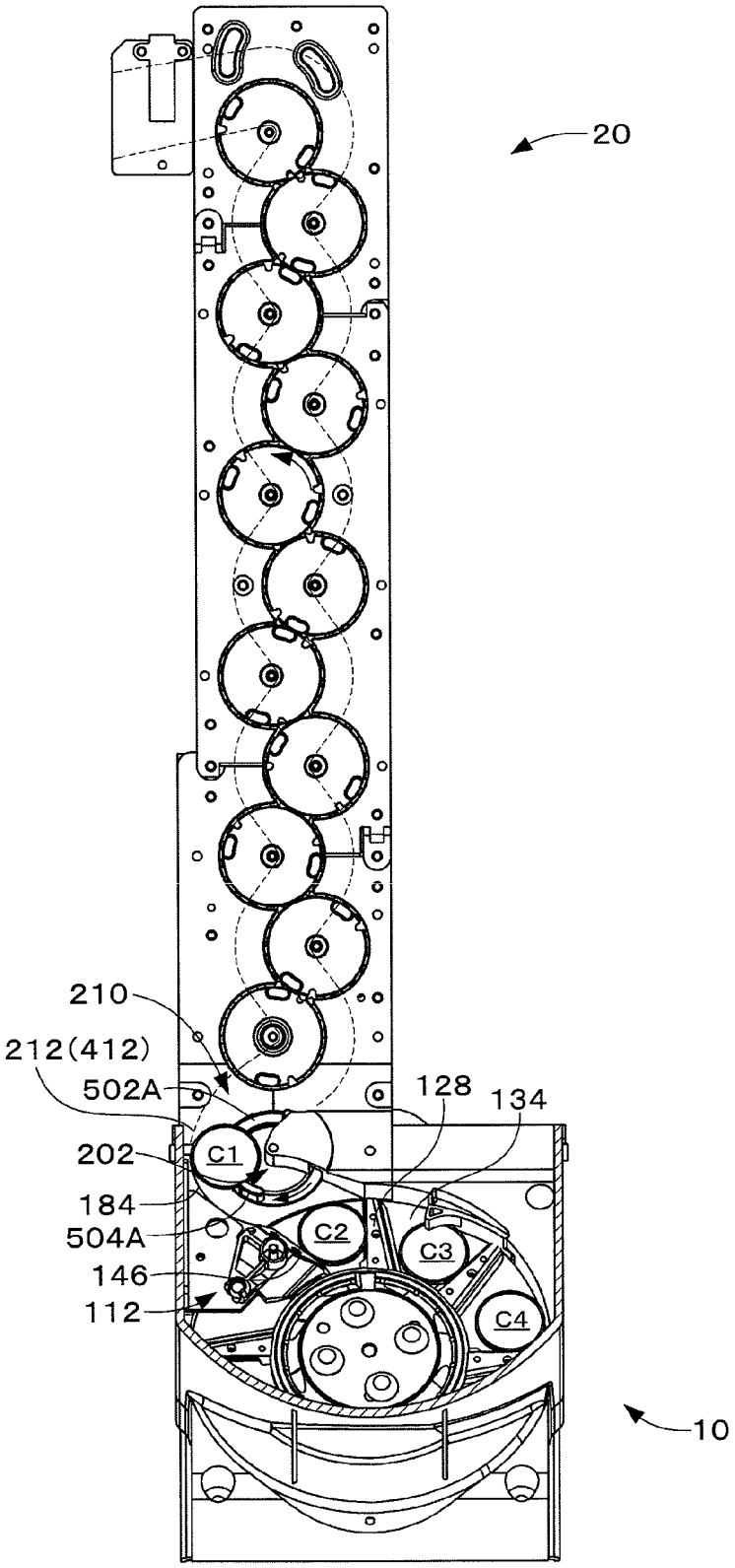
FIG. 39 is a front view continued from FIG. 38 for describing the operation of the coin dispensing device of FIG. 18 with the top plate removed.

In accordance with the rotation of the first rotary disk 502A, as shown in FIG. 39, the coin C1 is pushed by the coin pusher 504A, and the peripheral surface of the coin C1 is pressed onto the peripheral wall 184. Then, the coin C1 is moved upward with the peripheral surface being guided with the peripheral wall 184 and the left guide surface 212 of the coin guide path 210, and passes through the coin reception opening 202 to be introduced into the coin guide path 210. Also, the next coin C2 pushed by the coin stopper 128 of the rotary disk 106 comes into contact with the receiving edge 146 of the coin receiver 112.

Figure 40:
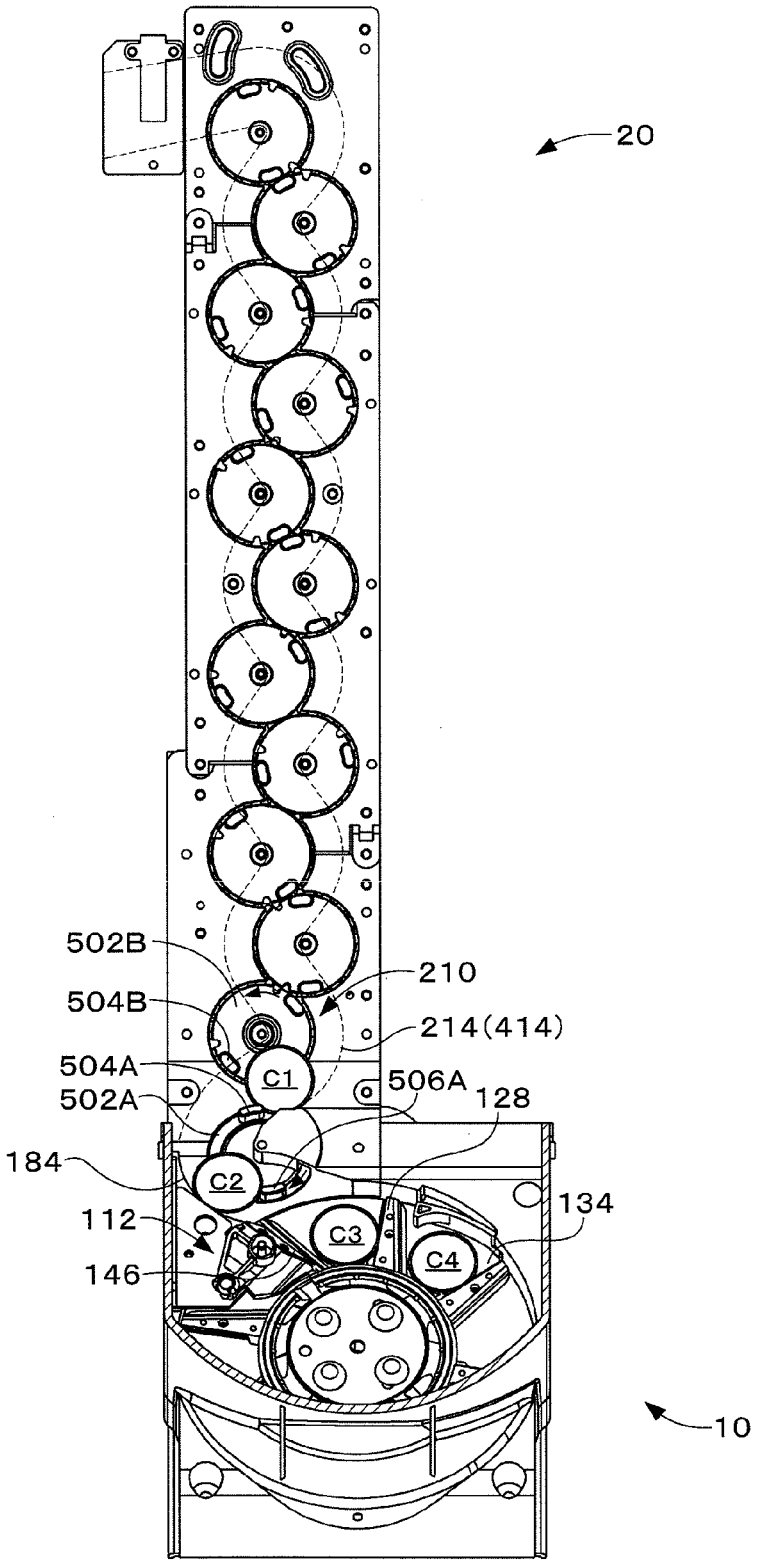
FIG. 40 is a front view continued from FIG. 39 for describing the operation of the coin dispensing device of FIG. 18 with the top plate removed.

When the first rotary disk 502A further rotates, the coin C1 continues to be pushed by the coin pusher 504A continues and, as shown in FIG. 40, the coin C1 is moved upward with the peripheral surface being pressed onto the right guide surface 214 of the coin guide path 210. At this time, the rotation of the second rotary disk 502B in a counterclockwise direction, brings the coin pusher into contact to the coin C1. Also, as with the case of the coin C1, the coin 2 pushed to the outside of the rotary disk 106 by the coin stopper 128 and the receiving edge 146 of the coin receiver 112 is pushed by the coin pusher 506A to be moved upward with the peripheral surface being guided with the peripheral wall 184. The next coin C3 pushed by the coin stopper 128 of the rotary disk 106 comes close to the receiving edge 146 of the coin receiver 112.

Figure 41:
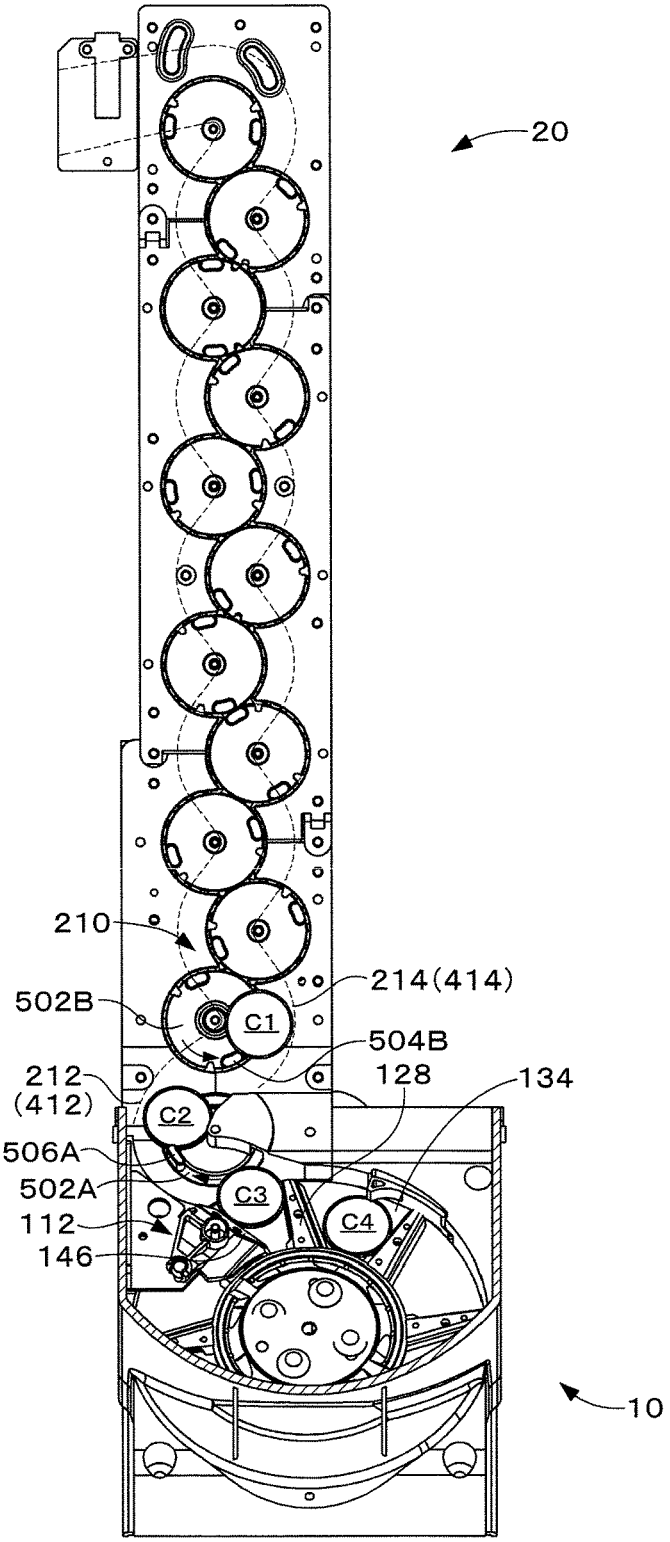
FIG. 41 is a front view continued from FIG. 40 for describing the operation of the coin dispensing device of FIG. 18 with the top plate removed.

Furthermore, as shown in FIG. 41, the coin pusher 504B comes in contact with the coin C1 to push the coin C1, and the coin C1 is moved upward while being guided with the right guide surface 214 of the coin guide path 210. The coin C2 pushed by the coin pusher 506A passes through the coin reception opening 202 to be introduced into the coin guide path 210. The coin C3 is pushed by the coin stopper 128 as being in contact with the receiving edge 146 of the coin receiver 112, and is moved in a peripheral direction of the rotary disk 106.

In the movement of the coin C1 in FIGS. 39 to 41, the coin C1 is moved from the first guide surface portion 222 to the second guide surface portion 224 of the back guide surface 218, and the traveling angle of the coin C1 is changed from approximately 60 degrees to approximately 90 degrees with respect to a horizontal plane. At this time, with the coin C1 being guided by the first curved surface portion 226 formed between the first and second guide surface portions 222 and 224 and the second curved surface portion 28 arranged so as to face the first curved surface portion 226, the traveling angle is gradually changed, thereby allowing the coin C1 to be smoothly moved through the coin guide path 210.

Figure 42:
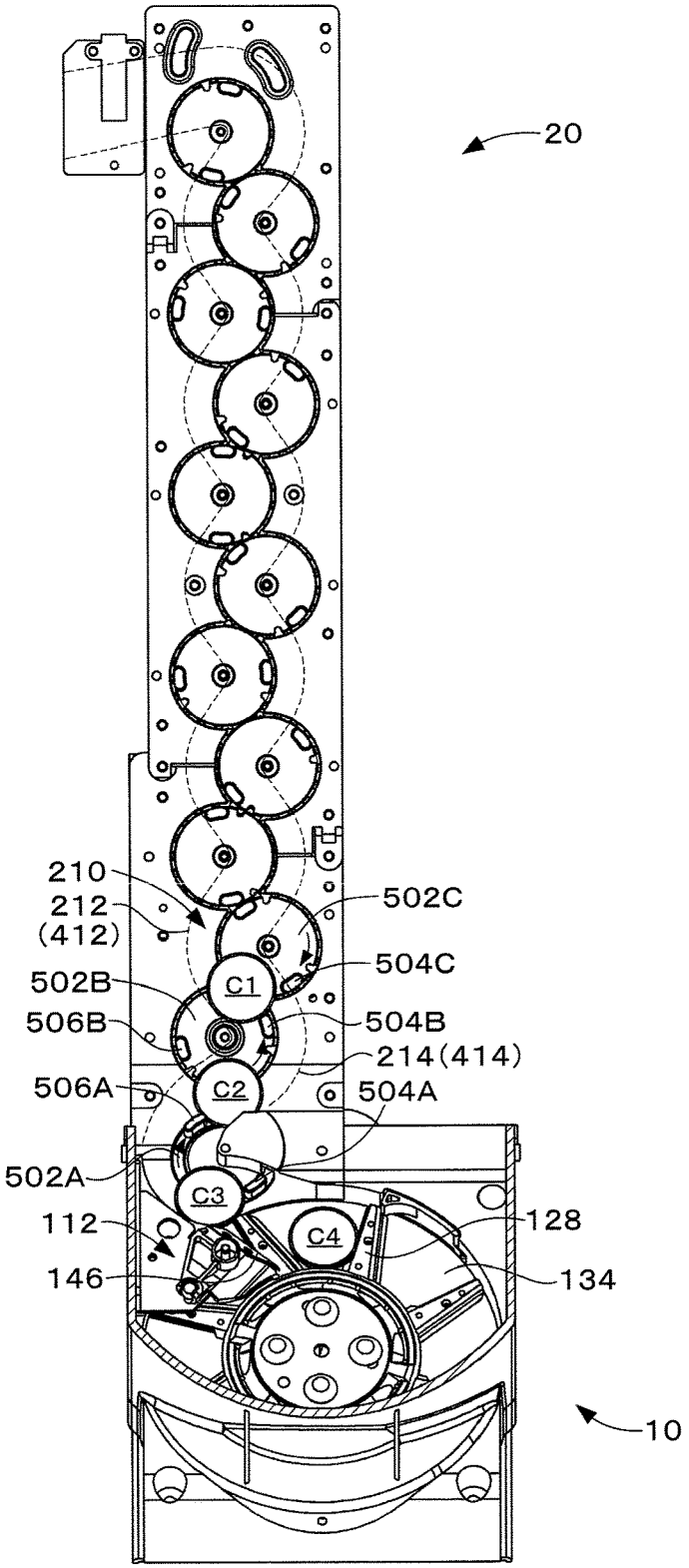
FIG. 42 is a front view continued from FIG. 41 for describing the operation of the coin dispensing device of FIG. 18 with the top plate removed.

Next, as shown in FIG. 42, the coin C1 pushed by the coin pusher 504B is moved upward while being guided with the left guide surface 212 of the coin guide path 210. The coin pusher 504C making a rotational movement in accordance with the rotation of the third rotary disk 502C in a clockwise direction comes close to the coin C1. As with the case of the coin C1, the coin C2 pushed by the coin pusher 506A is moved upward while being guided by the first and second curved surface portions 226 and 228, with the traveling angle being gradually changed. The coin C3 pushed to the outside of the rotary disk 106 is pushed by the coin pusher 504A. The next coin C4 pushed by the coin stopper 128 of the rotary disk 106 comes close to the receiving edge 146 of the coin receiver 112.

Figure 43:
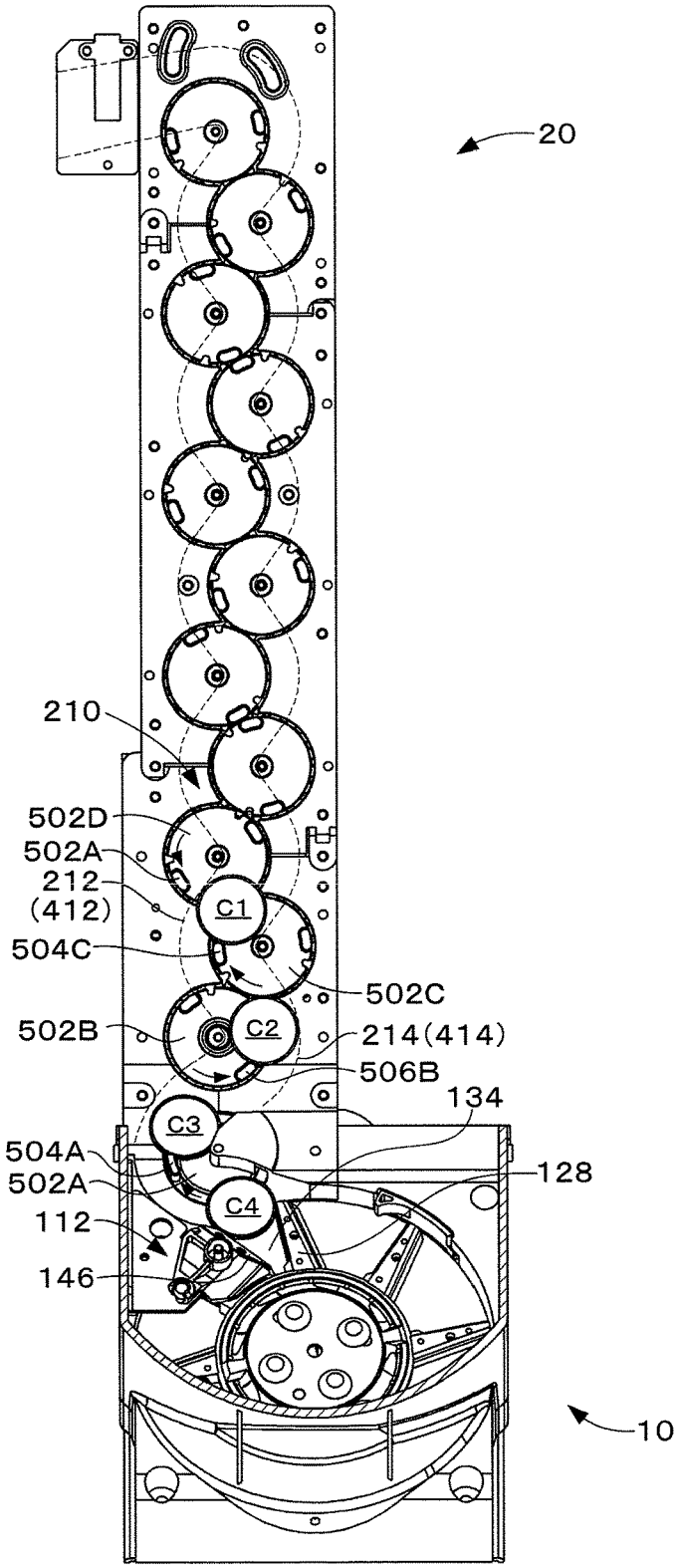
FIG. 43 is a front view continued from FIG. 42 for describing the operation of the coin dispensing device of FIG. 18 with the top plate removed.

Next, as shown in FIG. 43, the coin C1 is moved upward by the pushing of the coin pusher 504C, the coin C2 is moved upward by the pushing of the coin pusher 506B, and the coin C3 is moved upward by the pushing of the coin pusher 504A. The coin C4 is pushed by the coin stopper 128 as being in contact with the receiving edge 146 of the coin receiver 112 to be moved in a peripheral direction of the rotary disk 106.

Figure 44:
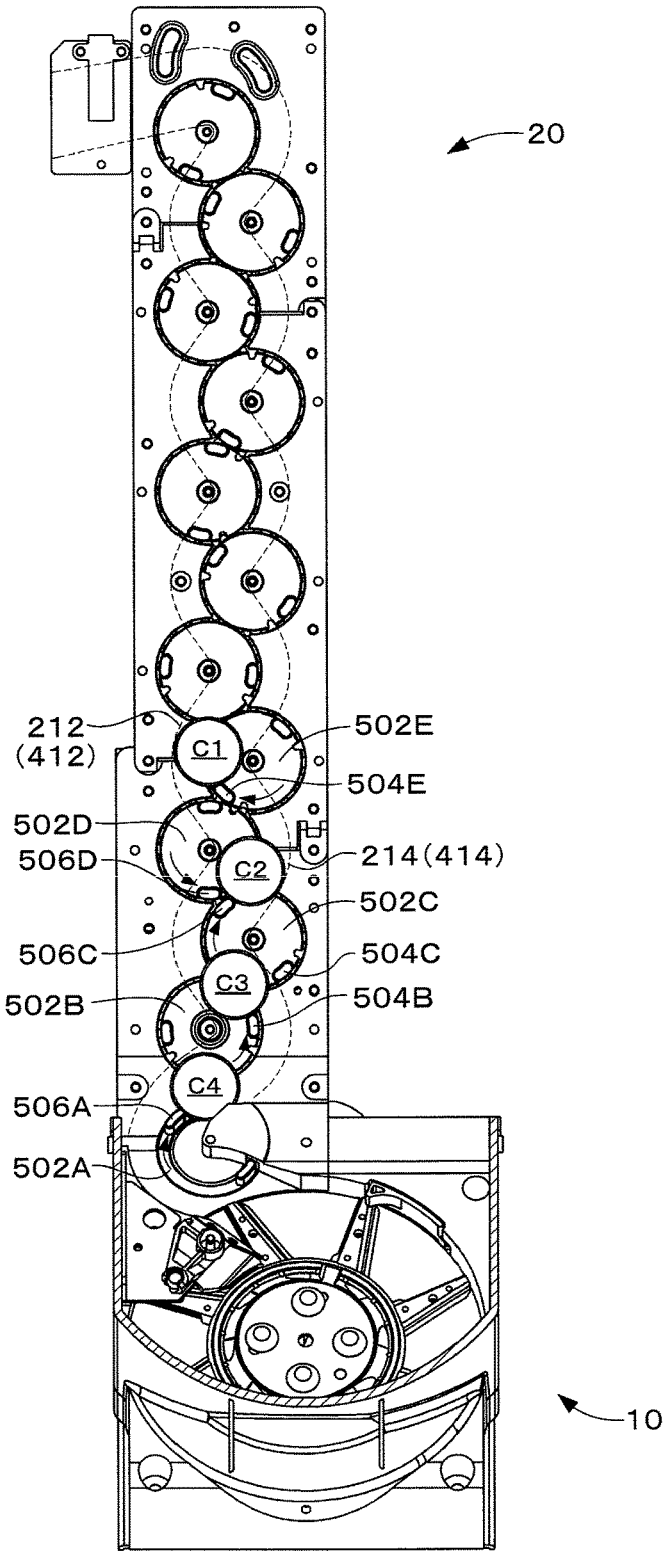
FIG. 44 is a front view continued from FIG. 43 for describing the operation of the coin dispensing device of FIG. 18 with the top plate removed.

Furthermore, as shown in FIG. 44, the coin C1 is moved upward by the pushing of the coin pusher 504E, the coin C2 is moved upward by the pushing of the coin pusher 506C, the coin C3 is moved upward by the pushing of the coin pusher 504B, and the coin C4 is moved upward by the pushing of the coin pusher 506A.

Figure 45:
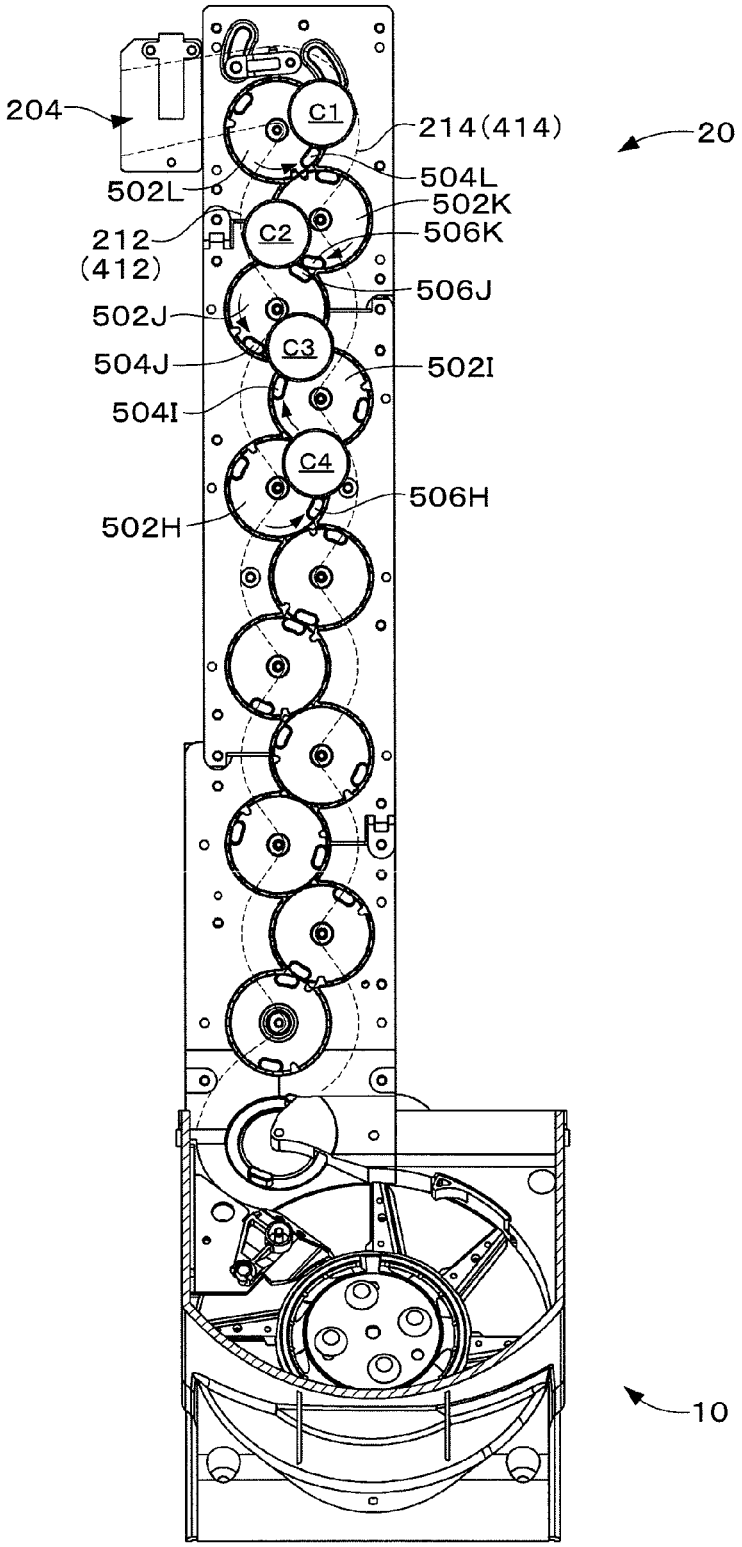
FIG. 45 is a front view continued from FIG. 44 for describing the operation of the coin dispensing device of FIG. 18 with the top plate removed.
Figure 46:
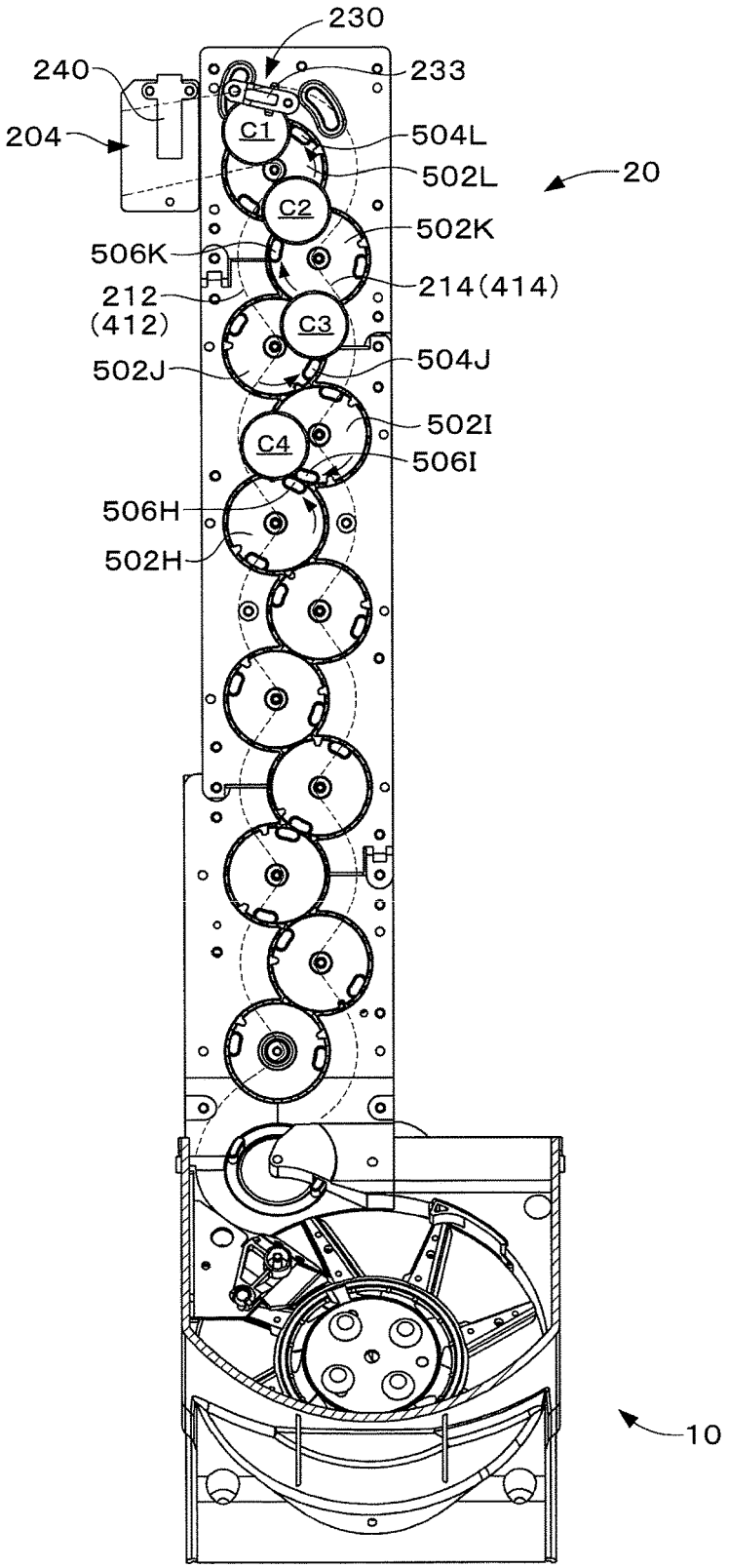
FIG. 46 is a front view continued from FIG. 45 for describing the operation of the coin dispensing device of FIG. 18 with the top plate removed.
Figure 47:
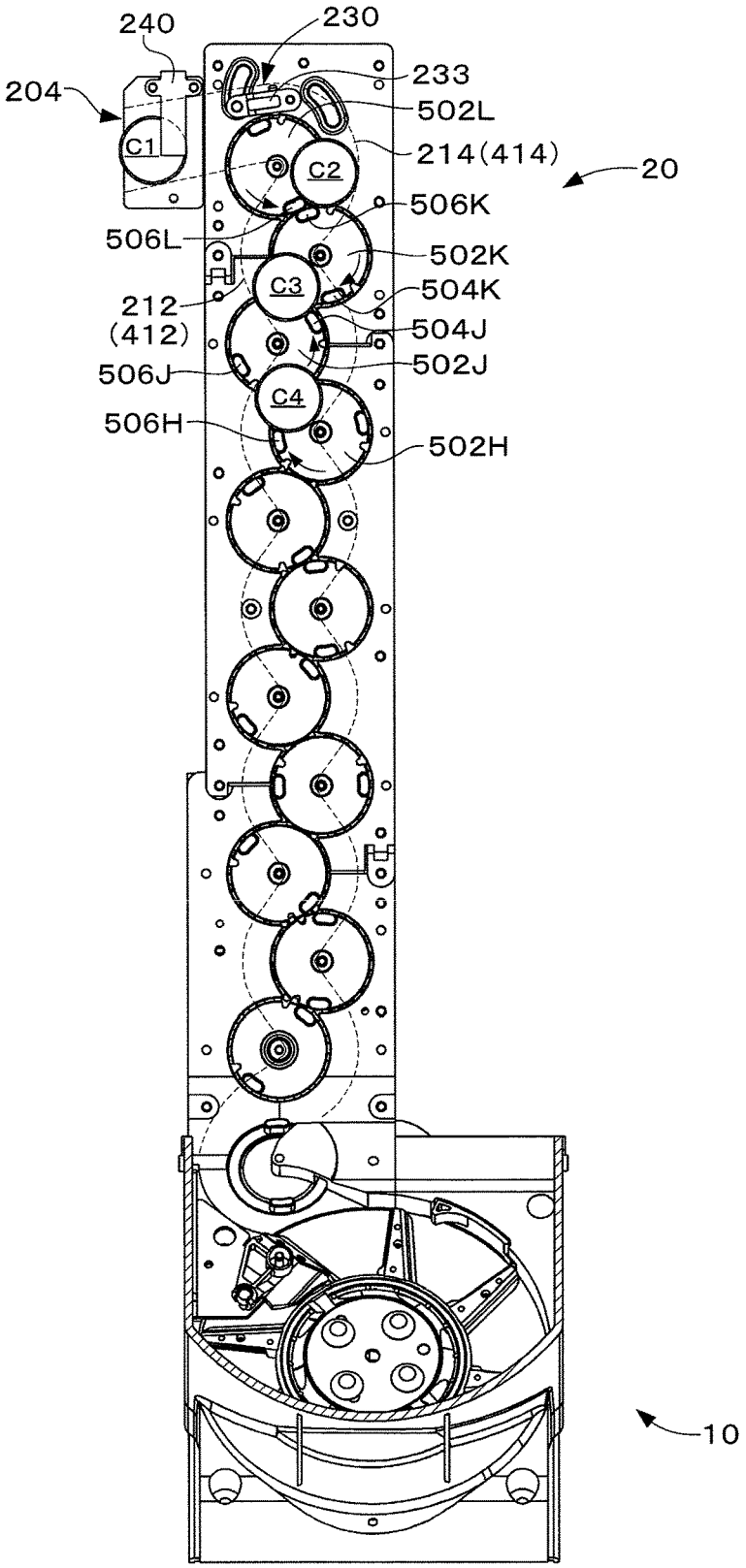
FIG. 47 is a front view continued from FIG. 46 for describing the operation of the coin dispensing device of FIG. 18 with the top plate removed.

With the operation of the above-mentioned coin pushing mechanism 500 being repeated, the state shown in FIG. 45 occurs. In this state, when the twelfth rotary disk 502L further rotates in a counterclockwise direction, the coin C1 pushed by the coin pusher 504L is, as shown in FIG. 46, guided with the right guide surface 214 of the coin guide path 210 to reach the position of the coin discharger 230. When the coin C1 is further pushed by the coin pusher 504L, the coin C1 making contact with the ejection roller 232 is moved toward the coin ejection opening 204 while pushing up the turning lever 233 of the coin discharger 230 against the pressing force of the spiral spring 234. Then, when the maximum diameter portion of the coin C1 passes through the ejection roller 232, the turning lever 233 returns downward by means of the elasticity of the spiral spring 234 and, by the turning force at that time, the coin C1 is ejected toward the coin ejection opening 204. As shown in FIG. 47, after the coin C1 is detected by the coin dispensing detection sensor 240 immediately after ejection, the coin C1 is discharged from the coin ejection opening 204. Then, a similar operation is repeated for the coins C2 to C4, thereby causing the coins C2 to C4 to be discharged from the coin ejection opening 204.

Fourth Embodiment

Figure 48:
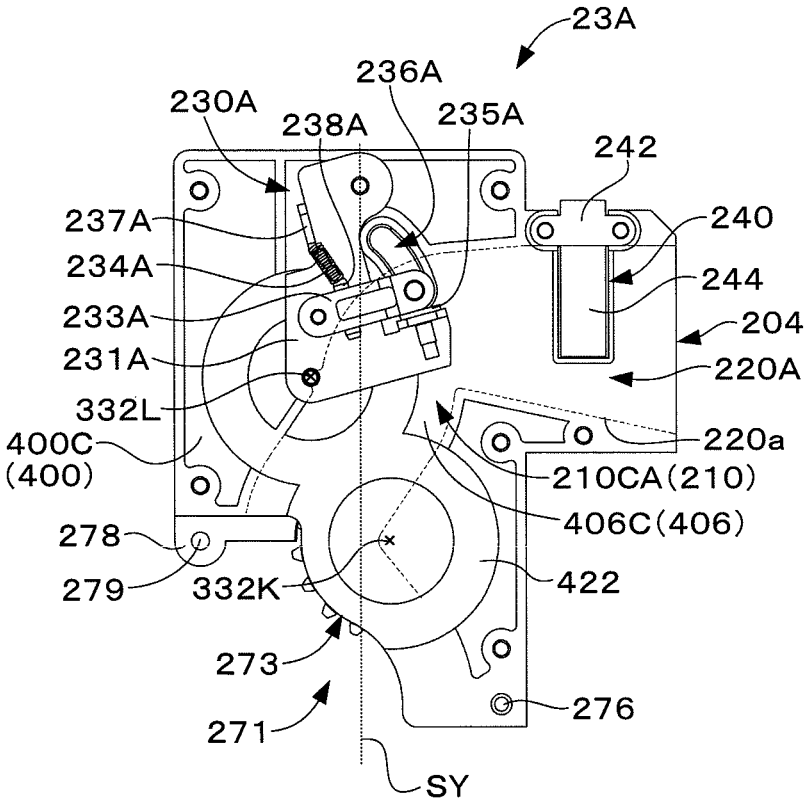
FIG. 48 is a front view of a third coin transferring unit of a coin transferring device configuring a coin dispensing device of a fourth embodiment of the present invention.
Figure 49:
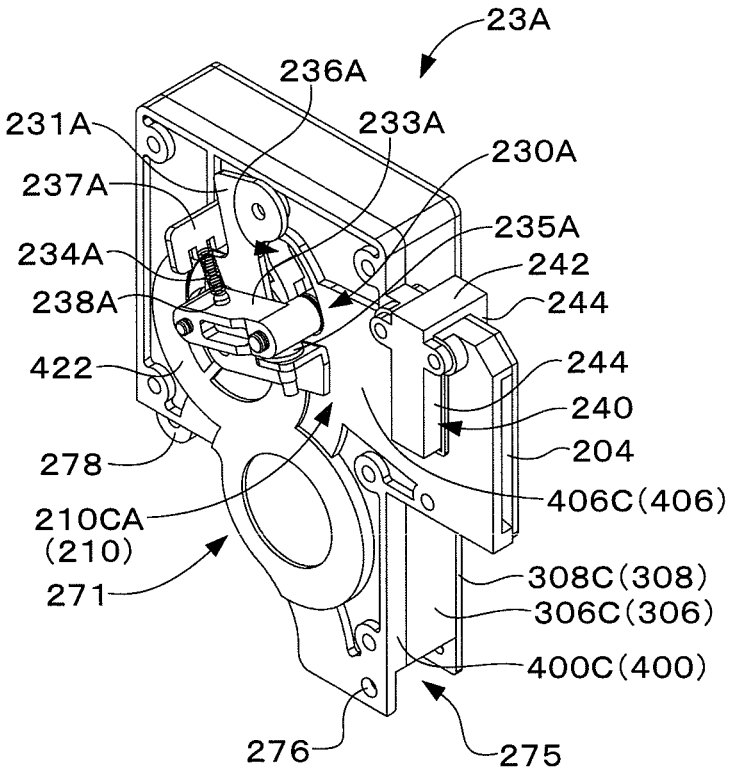
FIG. 49 is a perspective view of the third coin transferring unit of FIG. 48 when viewed from a upper left side.
Figure 50:
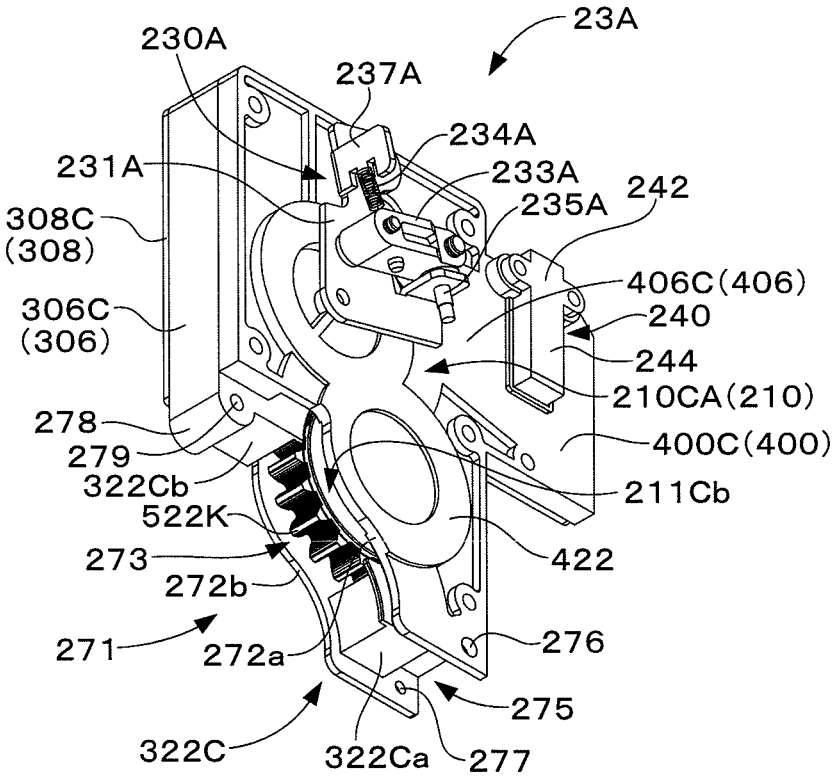
FIG. 50 is a perspective view of the third coin transferring unit of FIG. 48 when viewed from a lower left side.

As another example of the disk dispensing device according to the present invention, FIGS. 48 to 50 show a third coin transferring unit 23A configuring a coin transferring device in a coin dispensing device of a fourth embodiment of the present invention. In the coin dispensing device 1 of the third embodiment, in order to dispense a coin toward a left side of the coin transferring device 20, the coin ejection opening 204 is provided on a left side of the coin guide path 210. On the other hand, in the third coin transferring unit 23A shown in FIGS. 48 to 50, in order to dispense a coin toward a right side of the coin transferring device 20, the coin ejection opening 204 is provided on a right side of the coin guide path 210. In this respect, the third coin transferring unit 23A is different from the third coin transferring unit 23 of FIGS. 31 to 33. Except for this respect, the third coin transferring unit 23A is identical to the third coin transferring unit 23. Therefore, in FIGS. 48 to 50, components identical or corresponding to those of the third coin transferring unit 23 are provided with the same reference characters and are not described herein.

In the third coin transferring unit 23A, as shown in FIGS. 48 to 50, a third coin guide path portion 210CA has an coin ejection opening path region 220A formed upward from the twelfth rotational axis line 332L. This coin ejection opening path region 220A is curved to a right side, and extends approximately horizontally toward the coin ejection opening 204 arranged on the right side. As with the coin ejection opening path region 220 shown in FIG. 31, also in the coin ejection opening path region 220A, a coin guide surface 220*a* tilted diagonally downward toward the coin ejection opening 204 is formed.

Coin discharger 230A has its shape and arrangement changed so as to comply to the right-side arrangement of the coin ejection opening 204. That is, an ejection roller 232A, a turning lever 233A, a spiral spring 234A, a stopper 235A, a fastening plate 237A, and a stop pin 238A correspond to the ejection roller 232, the turning lever 233, the spiral spring 234, the stopper 235, the fastening plate 237, and the stop pin 238 of FIG. 31 arranged in left and right directions approximately reversed with respect to a symmetrical axis line SY of FIG. 48. The same applies to a long aperture for ejection roller 236A in an arc shape formed in a third top plate portion 400C.

The third coin transferring unit 23A has the same connecting part 271 identical to that of the third coin transferring unit 23 of the third embodiment, and therefore can be connected to the second coin transferring unit 22 of FIGS. 29 and 30. In other words, the third coin transferring unit 23A can be used in place of the third coin transferring unit 23 of the third embodiment. Therefore, by appropriately selecting using one of the third coin transferring unit 23 and the third coin transferring unit 23A, the coin ejection opening 204 can be arranged on both of the left and right sides.

Modification Examples

Note that the present invention is not meant to be restricted to the embodiments mentioned above, and can be variously modified. For example, the first and third coin transferring units 21 and 23 may be connected via two or more second coin transferring units 22. In this case, the coin transfer distance can be adjusted. Also, while the rotational axis lines 332A to 332D and the rotary disks 502A to 502D are arranged in the first coin transferring unit 21, the rotational axis lines 332E to 332J and the rotary disks 502E to 502J are arranged in the second coin transferring unit 22, and the rotational axis lines 332K and 332L and the rotary disks 502K and 502L are arranged in the third coin transferring unit 23, the number of rotational axis lines and rotary disks can be changed as appropriate, and thereby the length of the coin transferring unit can be changed. Therefore, by combining coin transferring units of different lengths, a coin transferring device 20 having any length can be obtained in a stepwise manner.

Furthermore, while the paired coin pushers 504A to 504L and 506A to 506L are provided in the rotary disks 502A to 502L, respectively, the present invention is not meant to be restricted to this. For example, one coin pusher can be provided in each of the rotary disks 502A to 502L. However, it is preferable to provide two or more coin pushers is each of the rotary disks 502A to 502L in order to increase transfer efficiency.

The present invention can be suitably used for a disk processing device that processes disks such as coins and medals and, for example, application to a money changer, a vending machine, a ticket vending machine, a game machine, and others.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A disk transferring device transferring disks received at a disk reception opening positioned lower and delivered one by one from a disk reception opening toward a disk ejection opening that is positioned higher than the disk reception opening, the disk transferring device comprising:

a disk guide path having first and second guide surfaces that guide a peripheral surface of each of the disks and third and fourth guide surfaces that guide a front surface and a back surface, respectively, of the disk, the disk guide path extending vertically and in a zigzag manner from the disk reception opening toward the disk ejection opening due to the first and second guide surfaces each being formed along a curve formed by connecting a plurality of segments of circles;

a plurality of rotary disks being arranged in a predetermined sequence along the first or second guide surface and rotating around a plurality of rotational axis lines approximately perpendicular to the third and fourth guide surfaces;

first and second disk pushers protruding from a surface positioned on the disk guide path side on each of the plurality of rotary disks, the first and second disk pushers being positioned opposite each other with a rotational axis line of the corresponding rotary disk therebetween and making a rotational movement about the corresponding rotational axis line by rotating integrally with the corresponding rotary disk;

gear wheels respectively arranged on each of the plurality of rotary disks on a rear surface positioned on a side opposite the disk guide path, the gear wheels on two adjacent rotary disks, of the plurality of rotary disks, engaging with each other;

a base part configuring the fourth guide surface and having an opening accommodating the gear wheels of the plurality of rotary disks formed therein; and a plate having a guide groove formed therein, the guide groove having a bottom surface configuring the third guide surface and a pair of side surfaces mutually opposing each other at a right angle with respect to the bottom surface, the pair of side surfaces configuring the first and second guide surfaces, the plate being fixated to a front surface of the base part such that the guide groove and the front surface of the base part face each other, wherein the front surface of each of the plurality of rotary disks configures the fourth guide surface together with the front surface of the base part due to the plurality of rotary disks being supported by a rotational axis provided to the base part such that the front surface of each of the plurality of rotary disks is substantially flush with the front surface of the base part, and the disks are delivered from the disk reception opening toward the disk ejection opening due to the disk being pushed up by the front surface and the back surface of the disk within the disk guide path being directly guided by the third and fourth guide surfaces while the first and second disk pushers making the rotational movement touch a peripheral surface of the disk.

2. The disk transferring device according to claim 1, wherein the plurality of rotational axis lines are arranged in the disk guide path a predetermined space apart from each other alternately on first and second axis arrangement lines positioned in parallel to each other along the disk guide path.

3. The disk transferring device according to claim 1, wherein the plurality of segments of circles respectively center on the plurality of rotational axis lines.

4. The disk transferring device according to claim 1, wherein the plurality of disk pushers are each provided to a peripheral part of a corresponding one of the rotary disks.

5. The disk transferring device according to claim 4, wherein the gear wheels each rotate integrally with a corresponding one of the rotary disks, and adjacent ones of the gear wheels engage with each other.

6. A disk transferring device receiving disks delivered one by one at a disk reception opening and discharging the disks to a disk ejection opening, comprising:

a disk guide path having first and second guide surfaces that guide a peripheral surface of each of the disks and third and fourth guide surfaces that guide a front surface and a back surface of the disk, the disk guide path extending vertically from the disk reception opening toward the disk ejection opening;

a plurality of rotary disks extending along a direction of the disk guide path and configured to respectively rotate about a plurality of rotational axis lines approximately perpendicular to the third and fourth guide surfaces;

a first disk pusher extending from a surface of each rotary disk of the plurality of rotary disks in a direction of a rotational axis line of the plurality of rotational axis lines of a corresponding rotary disk, the first disk pusher protruding into the disk guide path and pushing each peripheral surface of the delivered disks by making a rotational movement; and a second disk pusher extending from the surface of each rotary disk of the plurality of rotary disks in the direction of the rotational axis line of the plurality of rotational axis lines of the corresponding rotary disk, the second disk pusher protruding into the disk guide path and pushing each peripheral surface of the disks moved with the pushing of the first disk pusher by making a rotational movement, wherein the first disk pusher and second disk pusher are positioned opposite each other with a rotational axis line of the plurality of rotational axis lines of a corresponding rotary disk of the plurality of rotary disks therebetween.

7. The disk transferring device according to claim 6, wherein the plurality of rotary disks extends along a direction of the disk guide path in a zigzag manner.

8. The disk transferring device according to claim 6, wherein the first and second disk pushers each extend in a direction parallel to the plurality of rotational axis lines.

9. The disk transferring device according to claim 6, wherein the first and second disk pushers each have a columnar outer shape.

10. A disk transferring device receiving disks delivered one by one at a disk reception opening and discharging the disks to a disk ejection opening, comprising:

a disk guide path having first and second guide surfaces that guide a peripheral surface of each of the disks and third and fourth guide surfaces that guide a front surface and a back surface of the disk, the disk guide path extending vertically from the disk reception opening toward the disk ejection opening;

first to n-th rotary disks extending along a direction of the disk guide path and configured to respectively rotate about a plurality of first to n-th rotational axis lines; and first to n-th disk pushers, each pusher extending from a surface of a respective first to n-th rotary disk in a direction of a rotational axis line of the plurality of first to n-th rotational axis lines of a corresponding first to n-th rotary disk, the first to n-th disk pushers protruding into the disk guide path and pushing each peripheral surface of the disks by making a rotational movement about a corresponding one of the first to n-th (where n is a positive integer) rotational axis lines approximately perpendicular to the third and fourth guide surfaces, the first and n-th rotational axis lines being arranged in a predetermined sequence from the disk reception opening toward the disk ejection opening, in ones among the first to n-th disk pushers that are adjacent to each other on different rotary disks of the first to n-th rotary disks and corresponding to each of the rotational axis lines, one of the disk pushers making a rotational movement in a first rotational direction and another of the disk pushers making a rotational movement in a second rotational direction opposite to the first rotational direction, and in ones among the first to n-th disk pushers that extend from the same rotary disk as a same pair, said same pair is positioned opposite each other with the rotational axis line of the same rotary disk therebetween.

11. The disk transferring device according to claim 10, wherein the plurality of rotary disks extends along a direction of the disk guide path in a zigzag manner.

12. The disk transferring device according to claim 10, wherein the first to n-th disk pushers respectively extend in a direction parallel to the first to n-th of rotational axis lines.

13. The disk transferring device according to claim 10, wherein the first to n-th disk pushers each have a columnar outer shape.

14. A disk transferring device receiving disks delivered one by one at a disk reception opening and discharging the disks to a disk ejection opening, comprising:

a disk guide path having first and second guide surfaces that guide a peripheral surface of each of the disks and third and fourth guide surfaces that guide a front surface and a back surface of the disk, the disk guide path extending vertically from the disk reception opening toward the disk ejection opening;

first to n-th rotary disks extending along a direction of the disk guide path and configured to respectively rotate about a plurality of first to n-th rotational axes; and first to n-th disk pushers, each pusher extending from a surface of a respective first to n-th rotary disk in a direction of a rotational axis line of the plurality of first to n-th rotational axes of a corresponding first to n-th rotary disk, the first to n-th disk pushers protruding into the disk guide path and pushing each peripheral surface of the disks by making a rotational movement about a corresponding one of first to n-th (where n is a positive integer) rotational axis lines approximately perpendicular to the third and fourth guide surfaces, the first and n-th rotational axis lines being arranged in a predetermined sequence from the disk reception opening toward the disk ejection opening, in ones among the first to n-th disk pushers that are adjacent to each other on different rotary disks of the first to n-th rotary disks and corresponding to each of the rotational axis lines, one of the disk pushers making a rotational movement in a first rotational direction and another of the disk pushers making a rotational movement in a second rotational direction opposite to the first rotational direction, and in ones among the first to n-th disk pushers that extend from the same rotary disk as a same pair, said same pair is positioned opposite each other with the rotational axis line of the same rotary disk therebetween.

15. The disk transferring device according to claim 14, wherein the second to n-th rotational axis lines are arranged in the disk guide path a predetermined space apart from each other alternately on first and second axis arrangement lines positioned in parallel to each other along the disk guide path and are arranged in a zigzag manner along a direction in which the disk guide path extends.

16. The disk transferring device according to claim 14, wherein the fourth guide surface has a first guide surface portion orthogonal to the first rotational axis line and a second guide surface portion orthogonal to the second rotational axis line, and the first and second guide surface portions are connected to each other via a first curved surface portion.

17. The disk transferring device according to claim 16, wherein the third guide surface has a second curved surface portion facing the first curved surface portion.

18. The disk transferring device according to claim 16, wherein the first and second disk pushers are arranged so that trails of the rotational movements of the first and second disk pushers are formed a predetermined space apart from each other.

19. The disk transferring device according to claim 14, wherein the first to n-th disk pushers are configured of at least two or more disk pushers respectively arranged to the first to n-th rotational axis lines.

20. The disk transferring device according to claim 14, wherein the first and second guide surfaces are each formed along a curve formed by connecting segments of circles respectively centering on the first to n-th rotational axis line.

21. The disk transferring device according to claim 14, wherein the first to n-th rotary disks respectively corresponding to the first to n-th rotational axis lines are arranged on the fourth guide surface of the disk guide path, and the first to n-th disk pushers are each provided to a peripheral part of a corresponding one of the first to n-th rotary disks.

22. The disk transferring device according to claim 21, wherein first and second gearwheels are respectively and coaxially arranged on the first and second rotary disks, the first and second gear wheels each rotate integrally with a corresponding one of the first and second rotary disks, and the first and second gear wheels engage with each other.

23. The disk transferring device according to claim 22, wherein the first and second gear wheels each include a bevel gear portion having a cone angle corresponding to a predetermined angle.

24. The disk transferring device according to claim 22, wherein the first gear wheel includes a spur gear portion, and a driving force is transmitted from the driver to the first gear wheel via the spur gear portion.

25. The disk transferring device according to claim 22, wherein a driving force is transmitted from the driver to the first gear wheel, and a torque limiter is arranged in a driving-force transmitting route between the driver and the first gear wheel.

26. The disk transferring device according to claim 21, wherein third gear wheels are respectively and coaxially arranged on the second to n-th rotary disks, the third gear wheels rotate integrally with a corresponding one of the second to n-th rotary disks, and adjacent ones of the third gear wheels engage with each other.

27. The disk transferring device according to claim 14, wherein a rotation monitoring sensor is provided detecting the presence or absence of any of the rotational movements of the first to n-th disk pushers and, when detecting a stop of any of the rotational movements of the first to n-th disk pushers, the rotation monitoring sensor outputs a signal indicating the stop of the rotational movement.

28. The disk transferring device according to claim 14, wherein the device includes a plurality of disk transferring units each having a disk guide path portion formed by dividing the disk guide path in an extending direction and an end face provided correspondingly to a disk reception opening or a disk ejection opening of the disk guide path portion, the end faces being able to abut on each other, and having arranged therein a rotational axis line among the first to n-th rotational axis lines corresponding to the disk guide path portion, and the plurality of disk transferring units are connected to each other with the end faces abutting on each other.

29. The disk transferring device according to claim 28, wherein a first disk ejection opening disk transferring unit and a second disk ejection opening disk transferring unit are prepared, the first disk ejection opening disk transferring unit having the n-th rotational axis line arranged therein and the disk ejection opening provided on a left side of the disk guide path, and the second disk ejection opening disk transferring unit having the n-th rotational axis line arranged therein and the disk ejection opening provided on a right side of the disk guide path.

30. The disk transferring device according to claim 14, wherein the device has a disk discharger and a disk dispensing detection sensor, the disk discharger ejecting the disks in the disk guide path toward the disk ejection opening and the disk dispensing detection sensor detecting the disks ejected by the disk discharger.

31. The disk transferring device according to claim 14, wherein the plurality of rotary disks extends along a direction of the disk guide path in a zigzag manner.

32. The disk transferring device according to claim 14, wherein the first to n-th disk pushers respectively extend in a direction parallel to the first to n-th of rotational axis lines.

33. The disk transferring device according to claim 14, wherein the first to n-th disk pushers each have a columnar outer shape.

34. A disk dispensing device having a disk delivering device separating disks in bulk one by one for delivery and a disk transferring device receiving the disks delivered from the disk delivering device at a disk reception opening and transferring the disks to the disk ejection opening, the disk dispensing device dispensing the disks to a predetermined place, the disk delivering device including:

a storing bowl storing the disks in bulk;

a rotatable disk tilted upward at a predetermined angle, having a circular support rack formed at a center of an upper surface, having a plurality of disk stoppers radially extending from the support rack in a peripheral direction, receiving the disks stored in the storing bowl one by one with a surface contact with a holding surface between the plurality of disk stoppers, and pushing the disks with the plurality of disk stoppers while the disks are supported by the support rack and the holding surface;

a disk receiver extending near the support rack in the peripheral direction of the rotatable disk, receiving the disks pushed by the rotatable disk, and delivering the disks one by one in the peripheral direction of the rotatable disk; and a driver rotationally driving the rotatable disk, the disk transferring device including:

a disk guide path having first and second guide surfaces that guide a peripheral surface of each of the disks and third and fourth guide surfaces that guide a front surface and a back surface of the disk, the disk guide path extending vertically from the disk reception opening toward the disk ejection opening;

first to n-th rotary disks extending along a direction of the disk guide path and configured to respectively rotate about a plurality of first to n-th rotational axes; and first to n-th disk pushers, each pusher extending from a surface of a respective first to n-th rotary disk in a direction of a rotational axis line of the plurality of first to n-th rotational axes of a corresponding first to n-th rotary disk, the first to n-th disk pushers protruding into the disk guide path and pushing each peripheral surface of the disks by making a rotational movement about a corresponding one of first to n-th (where n is a positive integer) rotational axis lines approximately perpendicular to the third and fourth guide surfaces, the first and n-th rotational axis lines being arranged in a predetermined sequence from the disk reception opening toward the disk ejection opening, in ones among the first to n-th disk pushers that are adjacent to each other on different rotary disks of the first to n-th rotary disks and corresponding to each of the rotational axis lines, one of the disk pushers making a rotational movement in a first rotational direction and another of the disk pushers making a rotational movement in a second rotational direction opposite to the first rotational direction, and in ones among the first to n-th disk pushers that extend from the same rotary disk as a same pair, said same pair is positioned opposite each other with the rotational axis line of the same rotary disk therebetween.

35. The disk dispensing device according to claim 34, wherein the plurality of rotary disks extends along a direction of the disk guide path in a zigzag manner.

36. The disk dispensing device according to claim 34, wherein the first to n-th disk pushers respectively extend in a direction parallel to the first to n-th of rotational axis lines.

37. The disk dispensing device according to claim 34, wherein the first to n-th disk pushers each have a columnar outer shape.

* * * * *